US009291016B2

(12) United States Patent
Caulfield et al.

(10) Patent No.: US 9,291,016 B2
(45) **Date of Patent: *Mar. 22, 2016**

(54) METHOD FOR PULLING A CROWN PLUG FROM A SUBSEA TREE

(71) Applicant: TETRA TECHNOLOGIES, INC., The Woodlands, TX (US)

(72) Inventors: John Keith Caulfield, Houston, TX (US); Patrick Brown, Spring, TX (US)

(73) Assignee: TETRA TECHNOLOGIES, INC., The Woodlands, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/525,776

(22) Filed: Oct. 28, 2014

(65) Prior Publication Data

US 2015/0107846 A1 Apr. 23, 2015

Related U.S. Application Data

(63) Continuation of application No. 13/400,187, filed on Feb. 20, 2012, now Pat. No. 8,869,899.

(60) Provisional application No. 61/497,282, filed on Jun. 15, 2011, provisional application No. 61/444,892, filed on Feb. 21, 2011.

(51) Int. Cl.

| | |
|---|---|
| ***E21B 23/14*** | (2006.01) |
| ***E21B 31/12*** | (2006.01) |
| ***E21B 33/035*** | (2006.01) |
| ***E21B 33/043*** | (2006.01) |
| ***E21B 41/04*** | (2006.01) |

(52) U.S. Cl.

CPC ..... *E21B 23/14* (2013.01); *E21B 31/12* (2013.01); *E21B 33/035* (2013.01); *E21B 33/043* (2013.01); *E21B 41/04* (2013.01)

(58) Field of Classification Search

CPC ..... E21B 23/14; E21B 33/035; E21B 31/12; E21B 33/043; E21B 41/04

USPC ..... 166/339, 365, 368, 351, 125, 187, 89.3, 166/297, 386, 106, 179, 135

See application file for complete search history.

(56) References Cited

U.S. PATENT DOCUMENTS 8,028,752 B2 * 10/2011 Richards ..... 166/339
8,869,899 B2 * 10/2014 Caulfield et al. ..... 166/339

*Primary Examiner* — James G Sayre

(74) *Attorney, Agent, or Firm* — Garvey, Smith, Nehrbass & North, L.L.C.; Brett A. North

(57) ABSTRACT

Provided is a method and apparatus for pulling a crown plug from a subsea horizontal christmas tree, the method comprising: (a) providing a subsea lubricator having a longitudinal through bore and a jack attached to the subsea lubricator, the jack having a landing area, and the landing area having an opening which is fluidly connected to the lubricator's through bore; (b) providing a jacking string which includes a landing sub and a crown plug connector, the sub having a landing surface; (c) without the jacking string in step "b", lowering the subsea lubricator of step "a", to the horizontal christmas tree and attaching the lubricator to the christmas tree; (d) lowering the jacking string to the lubricator, and, while the landing surface of the landing sub is spaced above and not supported by the landing area of the jack, connecting the plug connector to the crown plug while the landing sub is above and not touching the landing area of the jack; (e) jacking up the jack such that the landing area of the jack contacts the landing surface of the landing sub, and pushes up on the jacking sub and jacking string causing tensile forces to be placed on the crown plug and releasing the crown plug from the profile of the christmas tree; (f) while the lubricator remains attached to the christmas tree, raising the jacking string and crown plug through and out of the lubricator and to the surface of the water to remove the tree; and (g) detaching the crown plug from the crown plug connector.

17 Claims, 50 Drawing Sheets

METHOD FOR PULLING A CROWN PLUG FROM A SUBSEA TREE

CROSS-REFERENCE TO RELATED APPLICATIONS

This is a continuation of U.S. application Ser. No. 13/400,187, filed on Feb. 20, 2012 (issued as U.S. Pat. No. 8,869,899 on Oct. 28, 2014), which is a non-provisional of U.S. provisional patent application Ser. No. 61/497,282, filed Jun. 15, 2011, and also a non-provisional of U.S. provisional patent application Ser. No. 61/444,892, filed Feb. 21, 2011, both of which are incorporated herein by reference and to which priority is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND

The present invention relates to a method and apparatus for pulling crown plugs from deep sea horizontal christmas trees using a jacking apparatus, jacking string located subsea during the pull, and control panel which is located at the surface of the water.

Subsea oil and gas production wells can be sealed off from the sea using production christmas trees. Two types of trees are commonly used: (1) vertical trees and (2) horizontal trees. Vertical trees include gate valves in the production bore which can isolate the well bore. Horizontal trees include crown plugs for sealing their production bores which plugs are run into tubing hangers and installed inside the tree.

Horizontal christmas trees are increasingly being used because of their lower costs and increased functionality compared to vertical trees. For example, horizontal trees typically bring wells into production in shorter periods of time compared to vertical trees. Furthermore, horizontal trees provide the flexibility of using larger bore completion systems.

Notwithstanding their benefits compared to vertical trees, horizontal christmas trees encounter problems with removing stuck crown plugs. Stuck crown plugs can require excessively large pulling forces to unstick and retrieve the plugs from the tree. It is important that the crown plugs, even when stuck, be removed so that downhole operations can be performed in the well when desired.

There is a need for providing a method and apparatus for removing stuck crown plugs using a wireline or slickline retrieval system.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential"

BRIEF SUMMARY

In one embodiment is provided an improved method and apparatus for pulling crown plugs from deep sea horizontal christmas trees using a radially static jacking apparatus and landable jacking sub with separate jacking string. and control panel which is located at the surface of the water. The apparatus employs a radially static jacking section with separated jacking string which can be detachably connected to a crown plug in a horizontal christmas tree to pull the plug.

One embodiment is provided a jacking unit, complete with a landing shoulder on its inside surface.

In one embodiment, when desired, a pulling tool section is landed into a lubricator. The pulling tool section latches onto a stuck crown plug. With the pulling tool section and its landing joint having landed near to the landing shoulder of the jacking section, hydraulic pressure can be applied to the jacking section. The hydraulic force causes upward movement to the jacking section which in turn contacts the landing joint and raises the landing joint and the pulling tool section thereby applying tensile pulling force on the crown plug to pull out the plug (tensile pulling force in amounts far greater than would have been possible with simple wireline tension).

In one embodiment the method and apparatus permits sufficient force to be applied in pulling on the crown plug to remove the plug from connection with the horizontal Christmas tree, without putting undue load or stress on wireline being used to retrieve the plug.

In one embodiment the method and apparatus can be deployed with a deployment system which itself lacks the ability to apply sufficient force to remove a stuck crown plug.

In one embodiment, the method and apparatus can be deployed by wireline deployment system. In another embodiment, the method and apparatus can be deployed by slickline or coiled tubing or any other known method of deploying tools downhole.

In one embodiment the jacking member can be moved longitudinally upward by hydraulic force. In other embodiments, the jacking member can be moved by mechanical, electrical or electro-hydraulic means.

In one embodiment, the method and apparatus can be remotely operated at or above the water's surface to work with horizontal Christmas trees located on the seabed.

In one embodiment the method and apparatus can be releasably connected to a crown plug by conventional crown plug-retrieving tools using wireline.

In one embodiment the jacking string is deployable by wireline. In another embodiment the jacking string is deployable by slickline or coiled tubing or any other known method of deploying tools downhole.

In one embodiment the jacking system or housing is adapted to be connected to a conventional landing string. In another embodiment, the jacking housing is adapted to be connected to a subsea lubricator.

In one embodiment is provided a jacking housing that can be releasably connected to a horizontal Christmas tree, the jacking housing having: (a) a throughbore, and (b) a jacking section, the jacking section having a radially static landing surface, adapted to land the landing joint of a wireline tool which wireline tool is operably connected to a crown plug pulling tool.

In one embodiment is provided a wireline plug jacking or pulling string deployable within the jacking system or housing, the wireline plug jacking or pulling string having a landing joint adapted to land on the landing section of the jacking system or housing, comprising: an outer surface, a portion of the outer surface being profiled to land the landing section.

In one embodiment is provided a method and apparatus for pulling or retrieving a plug from a horizontal Christmas tree, comprising the steps of:

(a) deploying a pulling tool within a jacking system or housing throughbore, the jacking housing being releasably connected to a horizontal Christmas tree, the jacking system or housing including an axially moveable jacking member with a landing surface on which the landing sub of the pulling tool lands upon; (b) releasably connecting the pulling tool to the plug to be retrieved from the horizontal Christmas tree; (c) moving the jacking member away from the horizontal Christmas tree until the plug is retrieved from the tree; and (d) removing the tool and plug from within the jacking housing throughbore.

In one embodiment, during step "b", the landing sub is located above and spaced apart from the landing surface of the jacking member. In one embodiment during step "c", the landing surface first contacts the jacking sub.

In one embodiment washing and/or flushing of the area of the crown plug can be performed before retrieval. Washing and/or flushing of the crown plug area can be important as the crown plug in many times sits in an area that over time accumulates dirt, silt, scale, etc. Washing the debris out of the crown plug area before pulling the crown plug enhances successful plug retrieval. In one embodiment wash fluid can be sea water, and the pumping means is either a hose from a surface pump or a remotely operated vehicle.

In one embodiment is provided, a method and apparatus for pulling a crown plug from a subsea horizontal christmas tree, the method comprising:

(a) providing a subsea lubricator having a longitudinal through bore and a jack attached to the subsea lubricator, the jack having a landing area which remains radially static, and the landing area having an opening which is fluidly connected to the lubricator's through bore; (b) providing a jacking string which includes a landing sub and a crown plug connector, the sub having a landing surface; (c) without the jacking string in step "b", lowering the subsea lubricator of step "a" to the horizontal christmas tree and attaching the lubricator to the christmas tree; (d) lowering the jacking string to the lubricator, and, while the landing surface of the landing sub is spaced above and not supported by the landing area of the jack, connecting the plug connector to the crown plug while the landing sub is above and not touching the landing area of the jack; (e) jacking up the jack such that the landing area of the jack contacts the landing surface of the landing sub, and pushes up on the jacking sub and jacking string causing tensile forces to be placed on the crown plug and releasing the crown plug from the profile of the christmas tree; (f) while the lubricator remains attached to the christmas tree, raising the jacking string and crown plug through and out of the lubricator and to the surface of the water to remove the plug; and (g) detaching the crown plug from the crown plug connector.

In one embodiment is provided a method of pulling a crown plug from a subsea horizontal christmas tree, the method comprising:

(a) providing a subsea lubricator having a longitudinal through bore and a jack attached to the subsea lubricator, the jack having a landing area, and the landing area having an opening which is fluidly connected to the lubricator's through bore; (b) providing a jacking string which includes a landing sub and a crown plug connector, the sub having a landing surface; (c) without the jacking string in step "b", lowering the subsea lubricator of step "a" to the horizontal christmas tree and attaching the lubricator to the christmas tree; (d) lowering the jacking string to the lubricator, and, while the landing surface of the landing sub is spaced above and not supported by the landing area of the jack, connecting the plug connector to the crown plug while the landing sub is above and not touching the landing area of the jack; (e) jacking up the jack such that the landing area of the jack contacts the landing surface of the landing sub, and pushes up on the jacking sub and jacking string causing tensile forces to be placed on the crown plug and releasing the crown plug from the profile of the christmas tree; (f) while the lubricator remains attached to the christmas tree, raising the jacking string and crown plug through and out of the lubricator and to the surface of the water to remove the plug; and (g) detaching the crown plug from the crown plug connector.

In one embodiment the landing area of the jack is radially static.

In one embodiment the landing surface of the landing sub is at least about one half inch above the landing area of the jack. In one embodiment, during step "d", the landing surface of the landing sub is at least about one inch above the landing area of the jack. In one embodiment, during step "d", the landing surface of the landing sub is at least about two inches above the landing area of the jack. In one embodiment, during step "d", the landing surface of the landing sub is at least about 3, 4, 5, or 6 inches above the landing area of the jack. In one embodiment, during step "d", the landing surface of the landing sub is between about one half and one inch above the landing area of the jack. In one embodiment the landing sub is between about one half and 1, 2, 3, 4, 5, or 6 inches above the landing area of the jack.

In one embodiment the method further including the step of before step "c", causing the jack to move to its lowermost position.

In one embodiment, before step "e", the area around the crown plug is washed. In one embodiment the area around the crown plug is washed by jetting. In one embodiment a high volume of fluids are circulated within the subsea lubricator to wash the crown plug.

In one embodiment, during step "c", wireline is used to lower the subsea lubricator. In one embodiment, during step "c", slickline or coiled tubing is used to lower the subsea lubricator. In one embodiment, during step "d", wireline is used to lower the jacking string.

In one embodiment, during step "d", slickline or coiled tubing is used to lower the jacking string.

In one embodiment, before step "e", but after connection to the crown plug in step "d", wireline is used to pull up on the landing string to confirm that a connection has been made between the jacking string and the crown plug.

In one embodiment, during step "c", the jack is fluidly connected to a hydraulic pump, which hydraulic pump is located at or above the surface of the water. In one embodiment, during step "e", the jack is powered by a hydraulic pump, which hydraulic pump is located at or above the surface of the water. In one embodiment, during step "e", the jack is moved from a lower axial movement limiter to an upper axial movement limiter. In one embodiment, during step "e", hydraulic pressure to the jack is monitored from a monitoring station above the surface of the water. In one embodiment contact between the jack and the upper axial movement limiter is determined by a spike in hydraulic pressure being monitored for hydraulic pump.

In one embodiment, during step "e", the subsea lubricator operates to seal the upper end of the christmas tree. In one embodiment, during step "f", the subsea lubricator operates to seal the upper end of the christmas tree. In one embodiment, during step "g", the subsea lubricator operates to seal the upper end of the christmas tree.

In one embodiment the jack comprises a piston and cylinder arrangement, and the piston includes the landing area. In one embodiment the piston includes the opening fluidly connected to the lubricator's through bore. In one embodiment the piston includes a jacking arm which is sealingly and slidably connected to the annular area of the cylinder. In one embodiment the jacking arm is a ring with a sealing member on the perimeter of the ring.

In one embodiment cylinder comprises an annular volume and the piston includes a jacking arm which is sealingly and slidably connected to the annular area of the cylinder. In one embodiment the cylinder has an enlarged diameter in relation to the size of the lubricator through bore. In one embodiment the piston further comprises upper and lower cylindrical body sections and each body section is sealingly connected to the lubricator. In one embodiment the upper and lower cylindrical body sections include an axial through bore, which axial through bore is fluidly connected to the through bore of the lubricator.

In one embodiment the landing area is located between the upper and lower cylindrical body sections. In one embodiment the landing area is located in the middle of the upper and lower cylindrical body sections. In one embodiment the landing area is located at the same level as the jacking arm.

In one embodiment, during step "b", the jacking string includes a fine adjustment member which comprises upper and lower telescoping sections. In one embodiment, during step "e", when contact is made between the landing area of the jack and the landing surface of the landing sub, the lubricator through bore is separated into upper and lower sections and the upper and lower sections remain fluidly connected.

In one embodiment a plurality of axial openings in the jacking sub cause the upper and lower sections to remain fluidly connected. In one embodiment a plurality of axial openings in the landing area of the jack cause the upper and lower sections to remain fluidly connected. In one embodiment a plurality of notches in the landing area of the jack cause the upper and lower sections to remain fluidly connected.

In one embodiment is provided, a method and apparatus for pulling a crown plug from a subsea horizontal christmas tree, the method comprising: (a) providing a subsea lubricator having a longitudinal through bore and a jack attached to the subsea lubricator, the jack having a landing area which remains radially static, and the landing area having an opening which is fluidly connected to the lubricator's through bore; (b) providing a jacking string which includes a landing sub and a crown plug connector, the sub having a landing surface; (c) without the jacking string in step "b", lowering the subsea lubricator of step "a" to the horizontal christmas tree and attaching the lubricator to the christmas tree; (d) lowering the jacking string to the lubricator, and, while the landing surface of the landing sub is spaced above and not supported by the landing area of the jack, connecting the plug connector to the crown plug while the landing sub is above and not touching the landing area of the jack; (e) jacking up the jack such that the landing area of the jack contacts the landing surface of the landing sub, and pushes up on the jacking sub and jacking string causing tensile forces to be placed on the crown plug and releasing the crown plug from the profile of the christmas tree; (f) while the lubricator remains attached to the christmas tree, raising the jacking string and crown plug through and out of the lubricator and to the surface of the water to remove the plug; and (g) detaching the crown plug from the crown plug connector.

In one embodiment the jacking section may be powered hydraulically, electrically, pneumatically, mechanically or the like, or by any suitable combination thereof.

In one embodiment the jacking section may be attached to a horizontal christmas tree to pull a crown plug sealing the bore of the well.

In one embodiment the jacking string and/or jacking section may include a winch assembly having a spoolable medium, such as wireline.

In one embodiment is provided a method and apparatus for pulling a crown plug comprising the steps of: providing a jacking system having a radially static jacking section, mounting the jacking system on a horizontal christmas tree, landing a jacking string on a crown plug, and using the jacking section to raise the jacking string and pull up the crown plug.

In one embodiment the jacking string has a crown plug connecting tool at its end for connecting to the crown plug.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION

FIGS. 1-22 show the preferred embodiment of the apparatus of the present invention, designated generally by the numerals 300 and 500.

Figure 1:
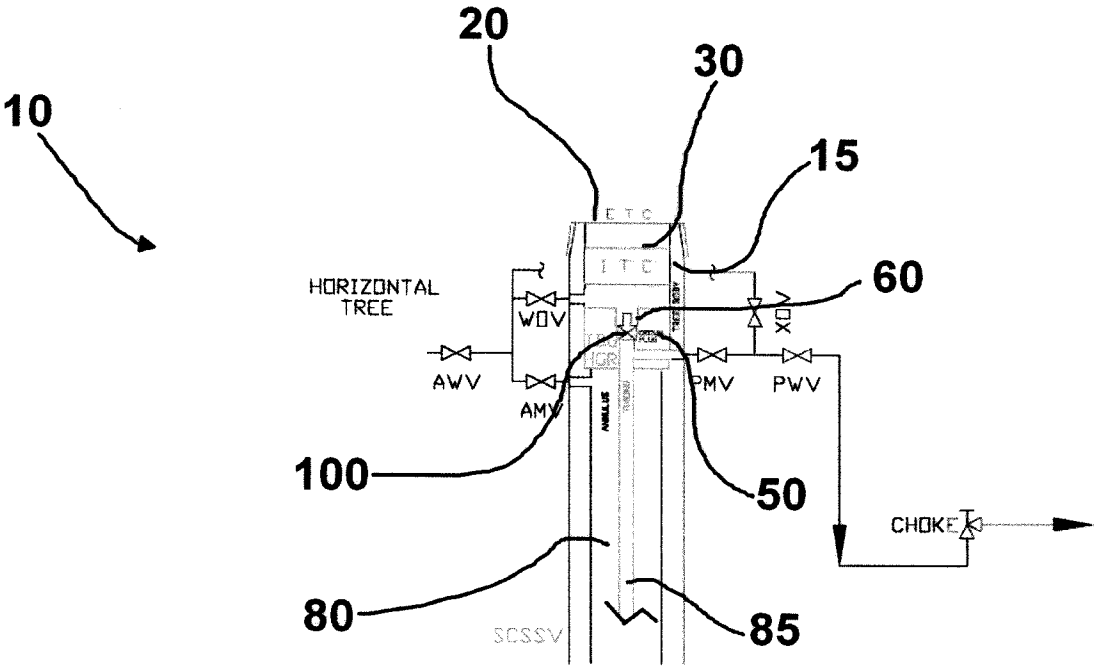
FIG. 1 schematically shows a horizontal christmas tree, after completion, and in the production mode with the crown plug in place with the tree cap in place. The crown plug is to be removed to provide access to the interior of the well.

FIG. 1 schematically shows a horizontal christmas tree 10, after completion, and in the production mode with the crown plug 100 in place with the tree cap (external cap 20 and internal cap 30) in place. The crown plug 100 is to be removed to provide access to the 80 interior of the well, such as through tubing 85.

Figure 2:
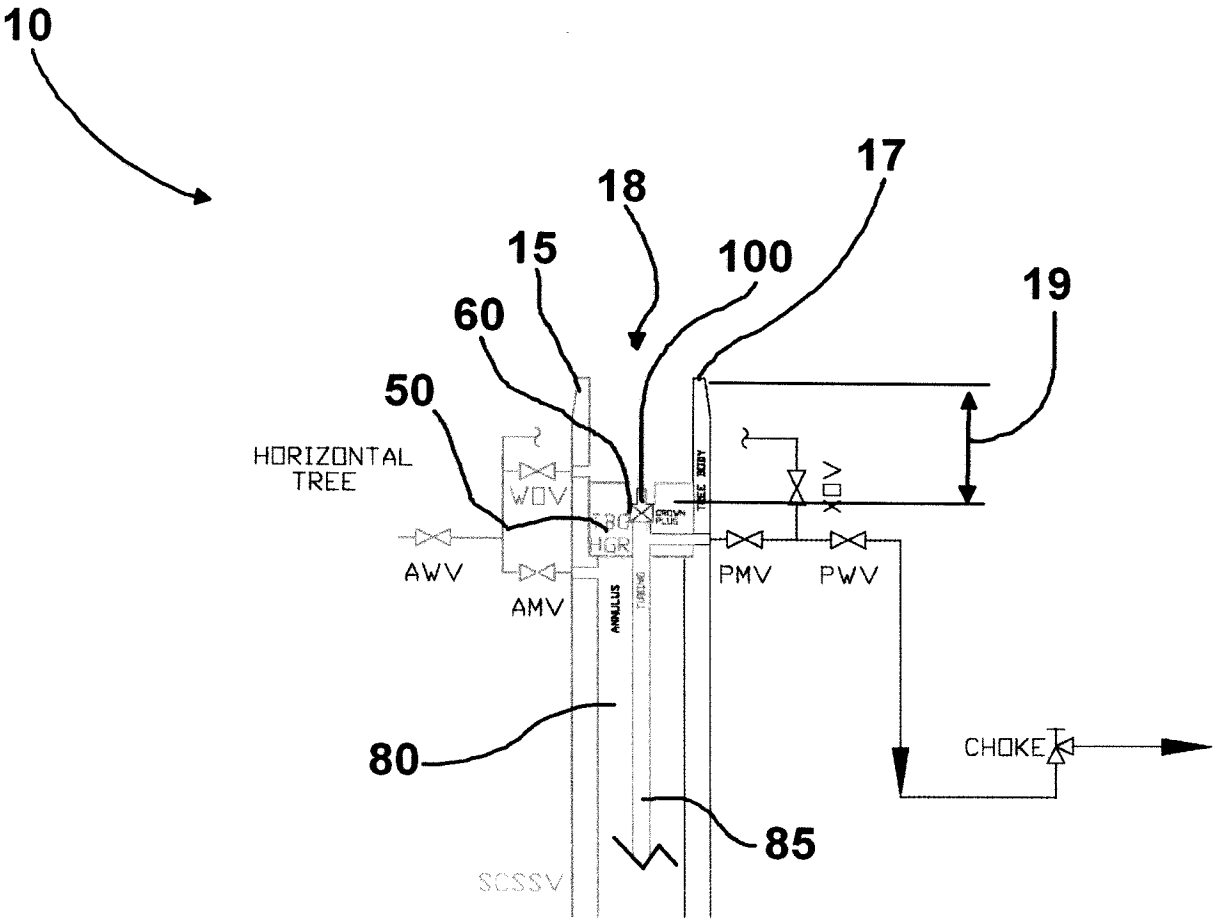
FIG. 2 schematically shows the horizontal christmas tree with the exterior and interior tree caps removed.

FIG. 2 schematically shows the horizontal christmas tree with the exterior 20 and interior tree caps removed. Removal of exterior 20 and internal 30 tree caps provides access to tubing hanger cavity 18 and crown plug 100.

Figure 3:
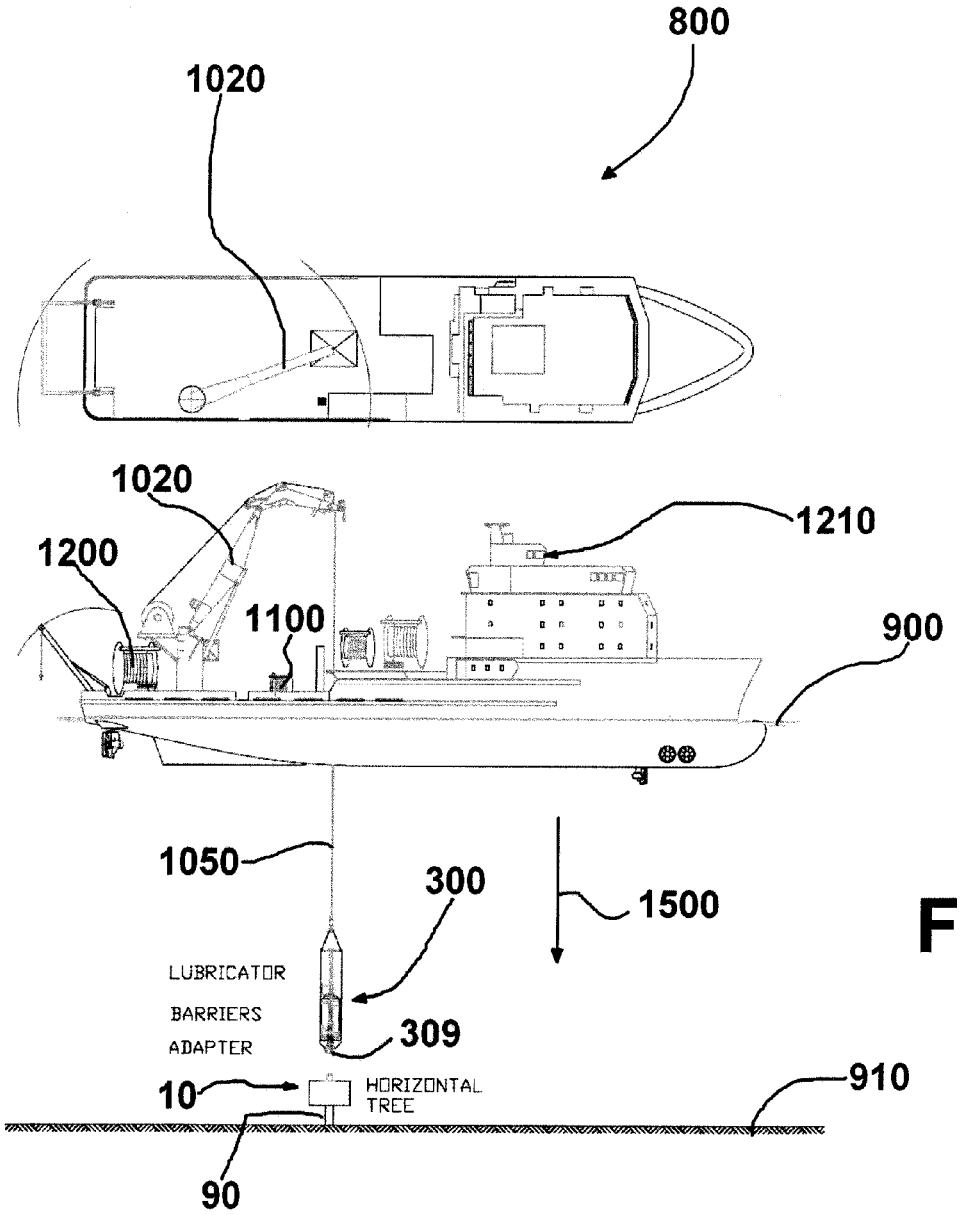
FIG. 3 schematically shows a vessel lowering on a lift line the jacking portion of the method and apparatus to the christmas tree of FIG. 2.
Figure 4:
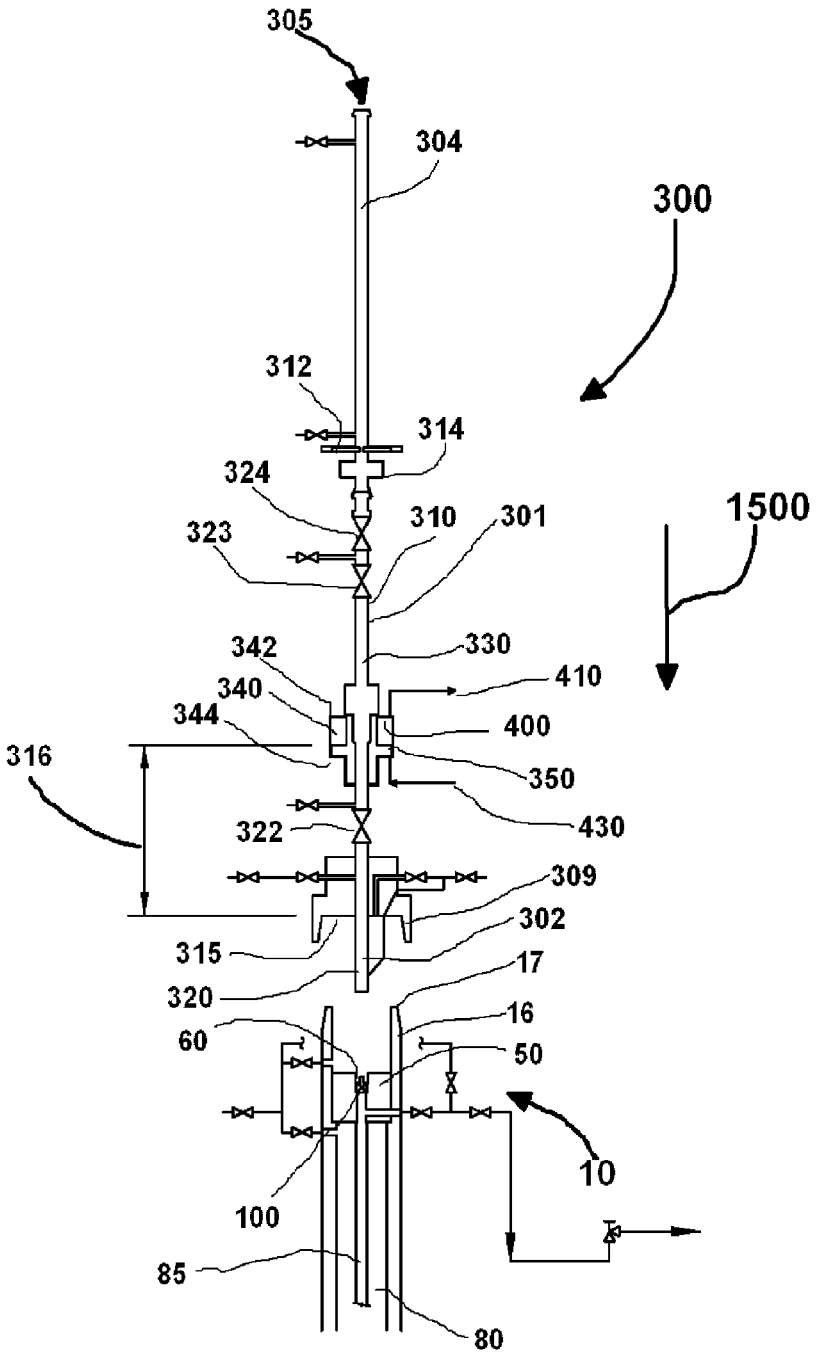
FIG. 4 schematically shows the jacking portion being lowered onto the christmas tree.

As schematically indicated in FIGS. 3 and 4, after access to crown plug 100 has been provided jacking system 300 can be lowered. Jacking system 300 can comprise tubular body 301 and hydraulic cylinder 340 with piston 350 slidingly and sealingly connected to cylinder 340. Jacking system 300 can also comprise lubricator 304 valves 322, 323, and 324, hydraulic connector 309, and stinger 302. In an alternative embodiment jacking system 300 can comprise wireline BOP/valve 312.

As schematically indicated in FIGS. 4-6, 10-11, 13, and 31, body 301 of jacking system 300 can include central longitudinal opening 330 spanning from its upper portion (e.g., upper portion 305 of lubricator 304) to its lower portion. Piston 350 can include central opening 360 which is in line with central opening 330 of body 301.

Piston 350 can comprise upper section 352, lower section 354, and radial portion 356. Radial portion 356 can include upper face or side 357 and lower face or side 358. Between upper and lower sides 357,358 can be a perimeter seal 359.

Hydraulic cylinder 340 can be slidingly and sealingly connected to piston 350. Cylinder 340 can include body 348 and enlarged section 346. Enlarged section 346 can include interior 341 having upper level 342 and lower level 344. Interior 341 can form a hydraulic chamber for piston 350 (i.e., for the radial portion 356 of piston 350).

The cylindrical chamber of interior 341 can be formed by upper seal 353 sealingly connecting upper section 352 of piston 350 to cylinder 340 wall; and lower seal 355 sealingly connecting lower section 354 of piston 350 to cylinder 340 wall.

Upper and lower sections of cylindrical chamber of interior are sealed from each other by perimeter seal 359 of radial portion 356 of piston 350.

Upper fluid port 400 is fluidly connected to the upper level 342 of interior 341. Fluid line 410 is fluidly connected to fluid port 400 and the upper level 342 of interior 341.

Lower fluid port 420 is fluidly connected to the lower level 344 of interior 341. Fluid line 430 is fluidly connected to fluid port 420 and the lower level 344 of interior 341.

Central opening 360 of piston 350 fluidly connects upper and lower portions of central passage 330 of body 301 of jacking system 300.

Figure 13:
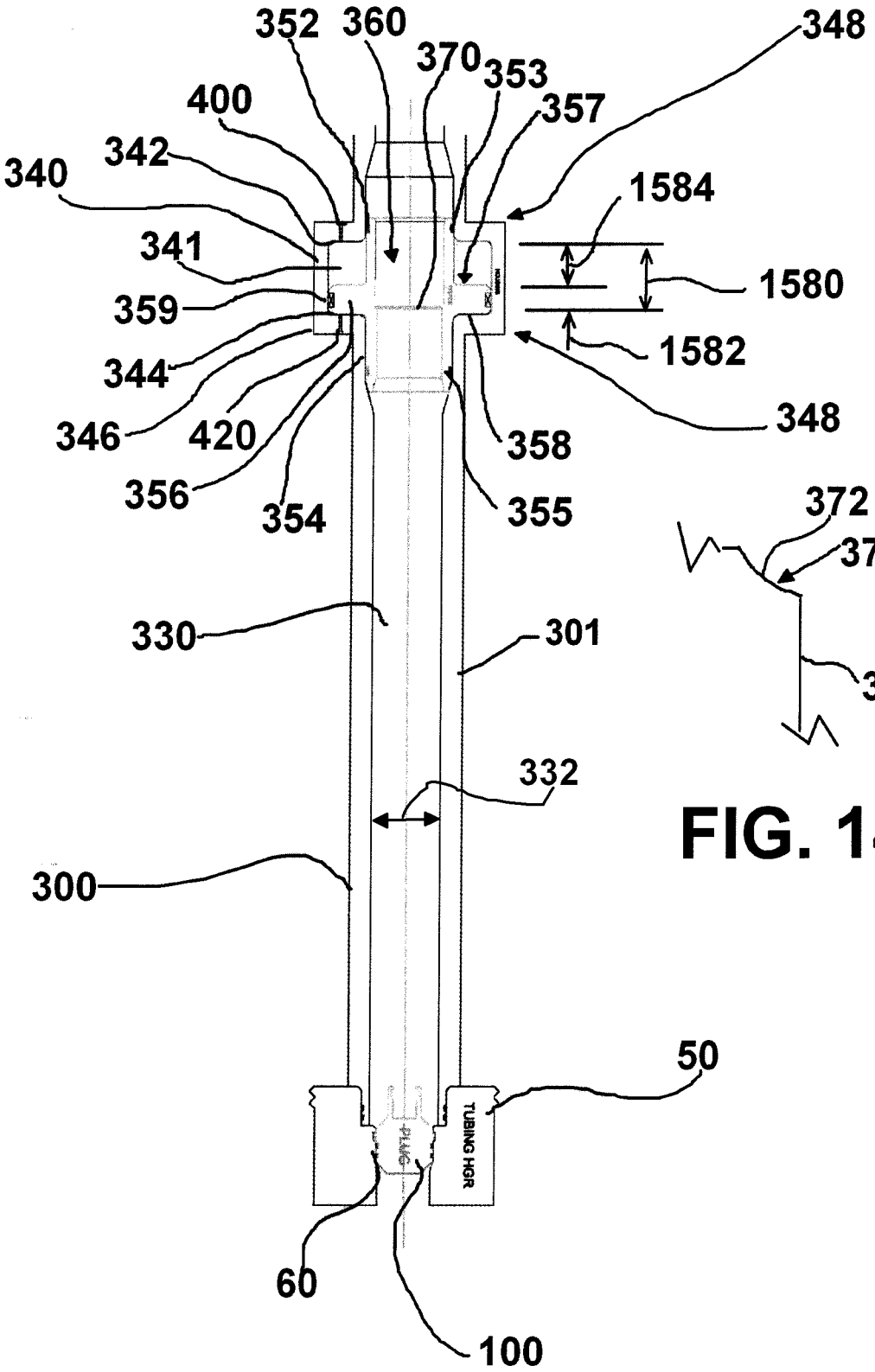
FIG. 13 is an enlarged schematic view of the jacking system of the method and apparatus with the jacking string omitted for clarity.

As schematically indicated in FIG. 13, the maximum amount of travel 1584 of piston 350 is equal the height 1582 of radial portion 356 subtracted from the height 1580 from upper level 342 to lower level 344 of interior 341 of cylinder section 340.

Figure 5:
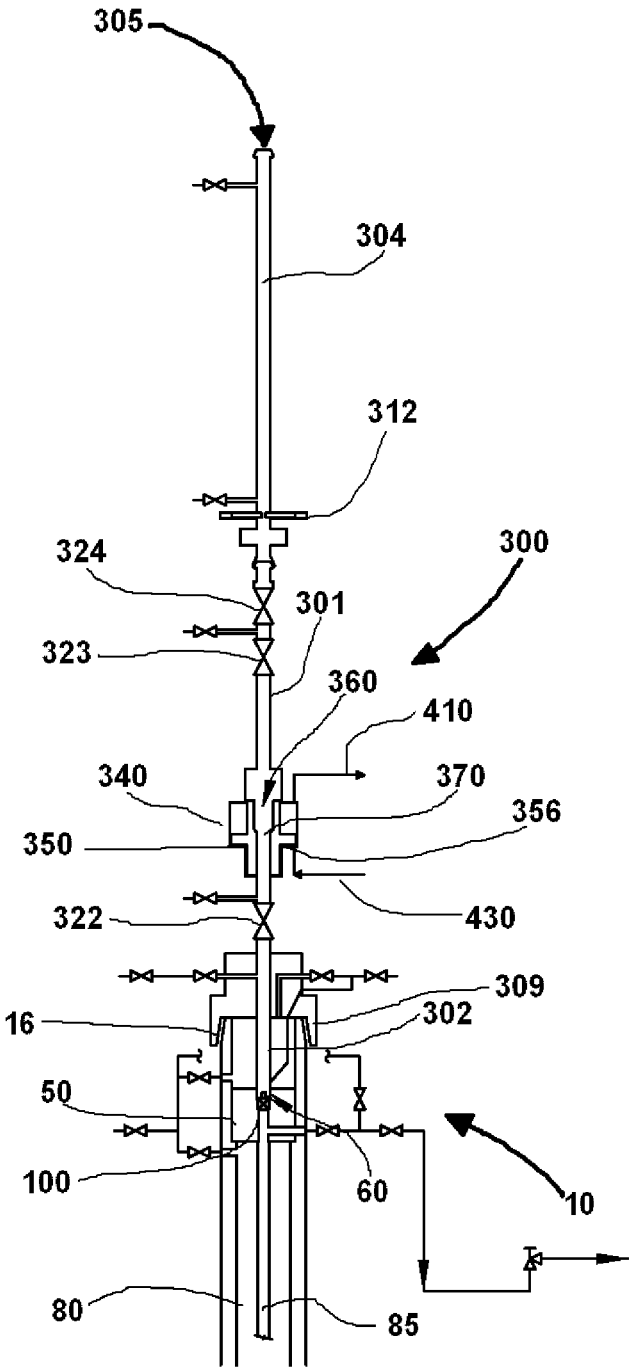
FIG. 5 schematically shows the jacking portion being landed on the christmas tree.

FIG. 3 schematically shows a vessel 800 lowering in the direction of arrow 1500 on a lift line 1050 to the christmas tree 10 jacking system 300 of one embodiment of the method and apparatus. FIG. 4 schematically shows the jacking system 300 being lowered in the direction of arrow 1500 onto the christmas tree 10. FIG. 5 schematically shows the jacking system 300 being landed on the christmas tree 10. After landing stinger 302 will sealably connect with profile 60 of tubing hanger 50. Connector 309 can be activated to attach jacking section 300 to upper section 16 of tree 10.

Figure 6:
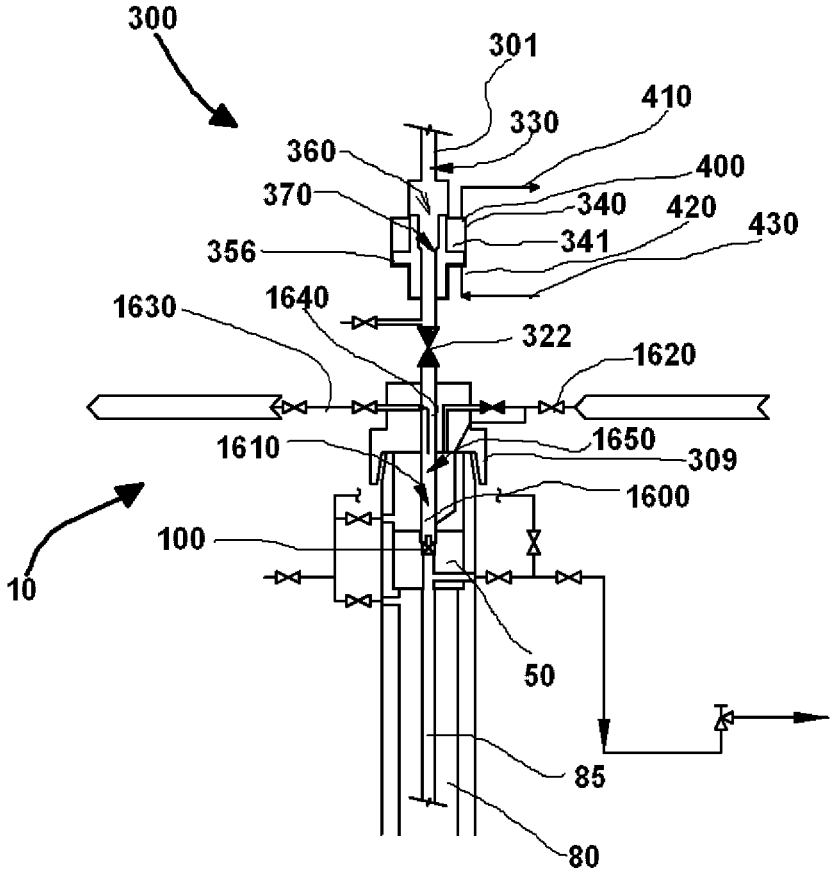
FIG. 6 schematically shows washing and/or jetting of the area around the crown plug before attachment of the jacking string.

FIG. 6 schematically shows washing and/or jetting of the area around the crown plug 100 before attachment of the jacking string 500. Notwithstanding outer and inner tree caps 20 and 30 sediment and/or debris can accumulate over time, and during installation, around the upper portion of crown plug 100. Nozzle 1600 can create a fluid spray 1610 to clean out accumulated sediment and/or debris around the connecting section of crown plug 100. High flow around volume 1650 is preferred to create velocity to remove accumulated sediment and/or debris.

Figure 7:
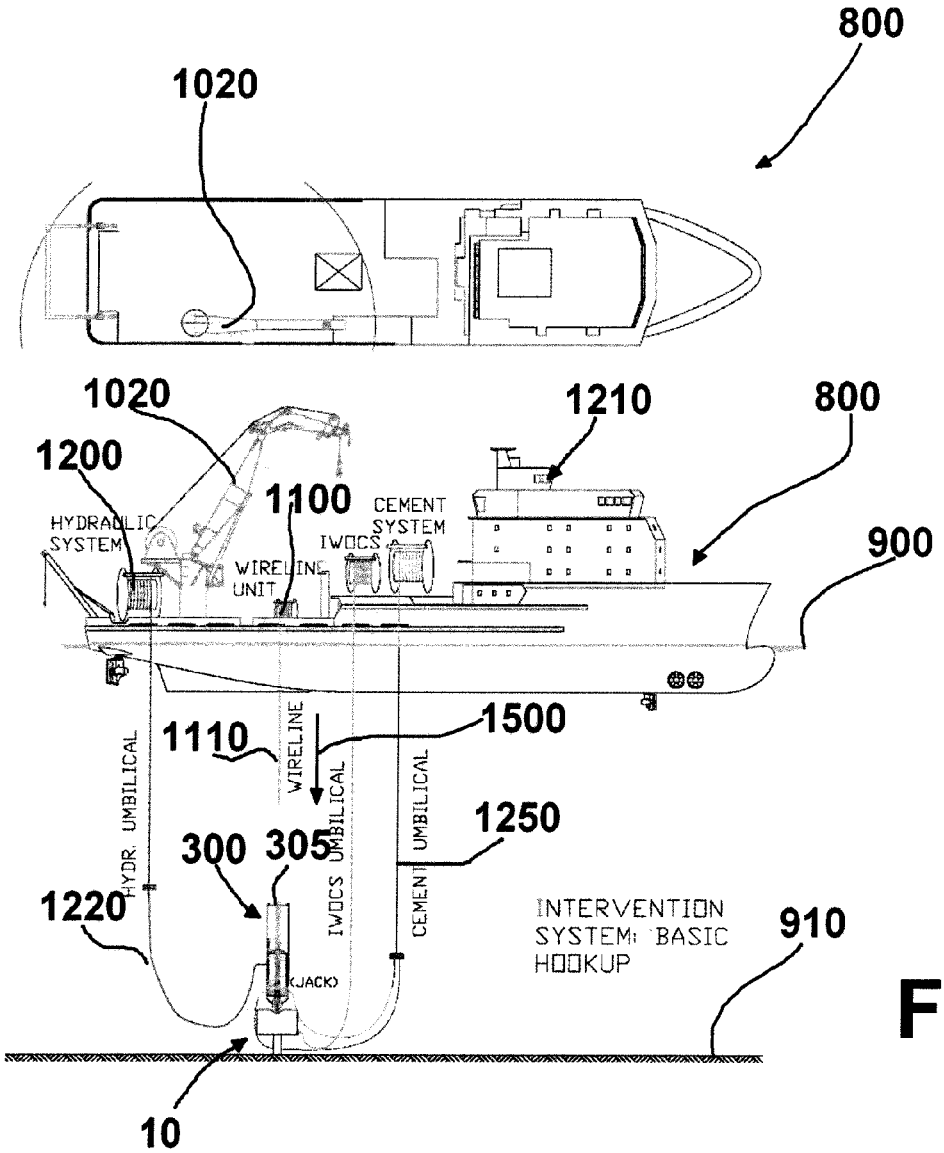
FIG. 7 schematically shows the individual components of an intervention system prior to lowering of the jacking string.

FIG. 7 schematically shows the jacking system 300 attached to christmas tree 10 prior to lowering of jacking string 500.

Figure 8:
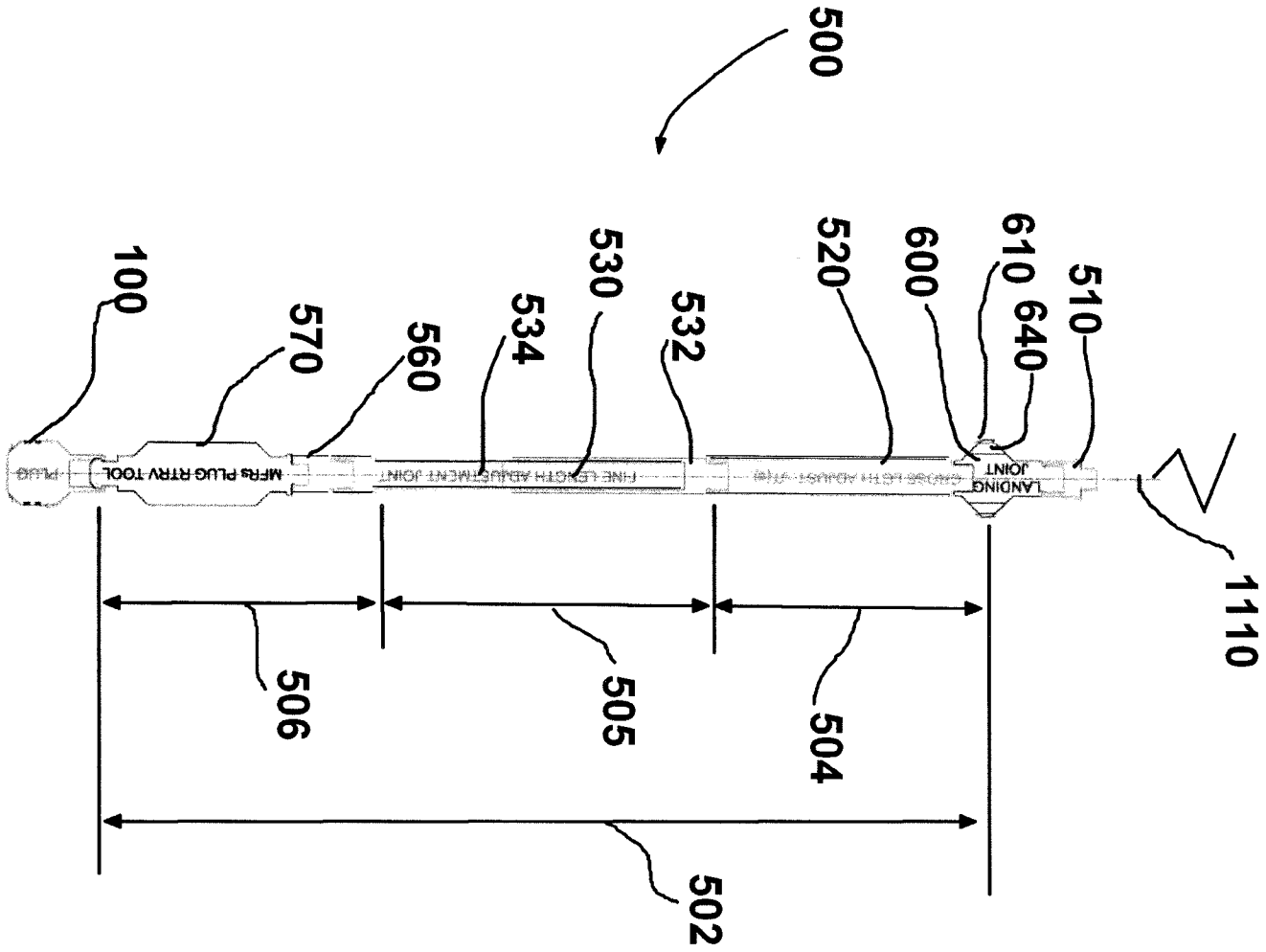
FIG. 8 schematically shows a jacking string which can be used in one embodiment.

FIG. 8 is a schematic diagram of a jacking string 500. Jacking string 500 can include fishing neck 510, landing sub/joint 600, gross length adjustment portion 520, fine length adjustment portion 530, adapter 560, and crown plug pulling tool 570.

From landing portion 610 to connecting portion of crown plug pulling tool 570 can be height 502. Gross length adjustment portion 520 can have a height 504, fine length adjustment portion 530 can have a height 505, and crown plug pulling tool can have a height 506. The individual components are discussed below.

(1) Fishing Neck 510—adapts the string for wireline use.

(2) Jacking sub/Landing Joint 600—"Wide Spot" in the jacking string 500. Lands out on the shoulder 370 of the jacking piston 350. In one embodiment the jacking sub/landing joint 600 possesses flow-by holes or milled slots 640 to allow bore fluids to pass by as it is dropped into the bore of jacking system 300.

(3) Gross Length Adjustment 520 of jacking string 500. This adjustment can take up/fill the vertical distance between the jacking sub/landing joint 600 and the other items in the jacking string 500. Could be comprised of several pup joints, possibly of varying lengths.

(4) Fine Length Adjustment Joint 530—A long assembly with a male half 534 and a female half 532, allows length adjustment for final space-out. In one embodiment this can allow plus/minus 6 inches of length adjustment.

(5) Adapter 560—Fits lower threaded connection of fine length adjustment Joint 530 and connects to conventionally available crown plug pulling tool 570. Because there are different manufacturers for different crown plugs 100 and pulling tools 570, along with different crown plug pulling tools for the same manufacturers, it is envisioned that several adapters will be provided for operable attachment to various sizes and various manufacturers' tools.

(6) Crown Plug Pulling Tool 570, which is conventionally available and can be rented or purchased from original equipment manufacturers. These conventionally available pulling tools have been previously used to pull crown plugs 100 without the use of the method and apparatus disclosed herein.

One embodiment provides the application of a large tensile force to a crown plug 100 which is much greater than the tensile force which can be applied using wireline 1110 pulling or jarring systems.

One embodiment provides a stand alone tensile jacking system which is installed on a horizontal Christmas tree for pulling crown plugs when needed.

One embodiment includes a temporary tensile jacking system which can be part of a subsea plug and abandonment kit where the jacking system is temporarily installed on a horizontal Christmas tree for pulling crown plugs when needed and removed after the crown plug has been pulled.

In one embodiment the apparatus can comprise a housing which includes a jacking section.

In one embodiment the apparatus can comprise a tension string attached to wireline and having a landing joint which lands on the jacking section.

Figure 9:
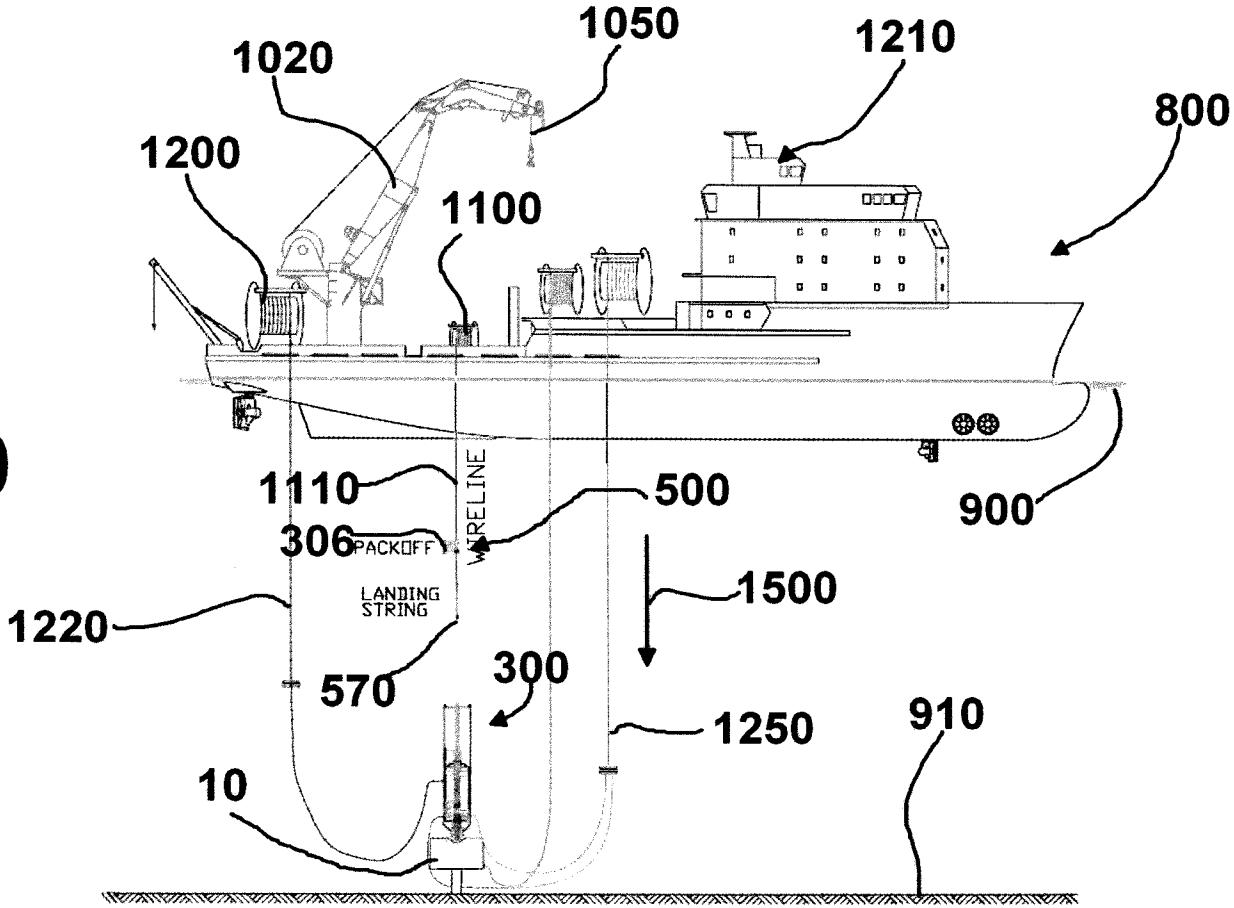
FIG. 9 schematically shows the vessel lowering on wireline the jacking string of the method and apparatus to the jacking system shown in FIG. 5.

FIG. 9 schematically shows vessel 800 lowering in the direction of arrow 1500 on wireline 1110 the jacking string 500 to jacking system 300.

Figure 10:
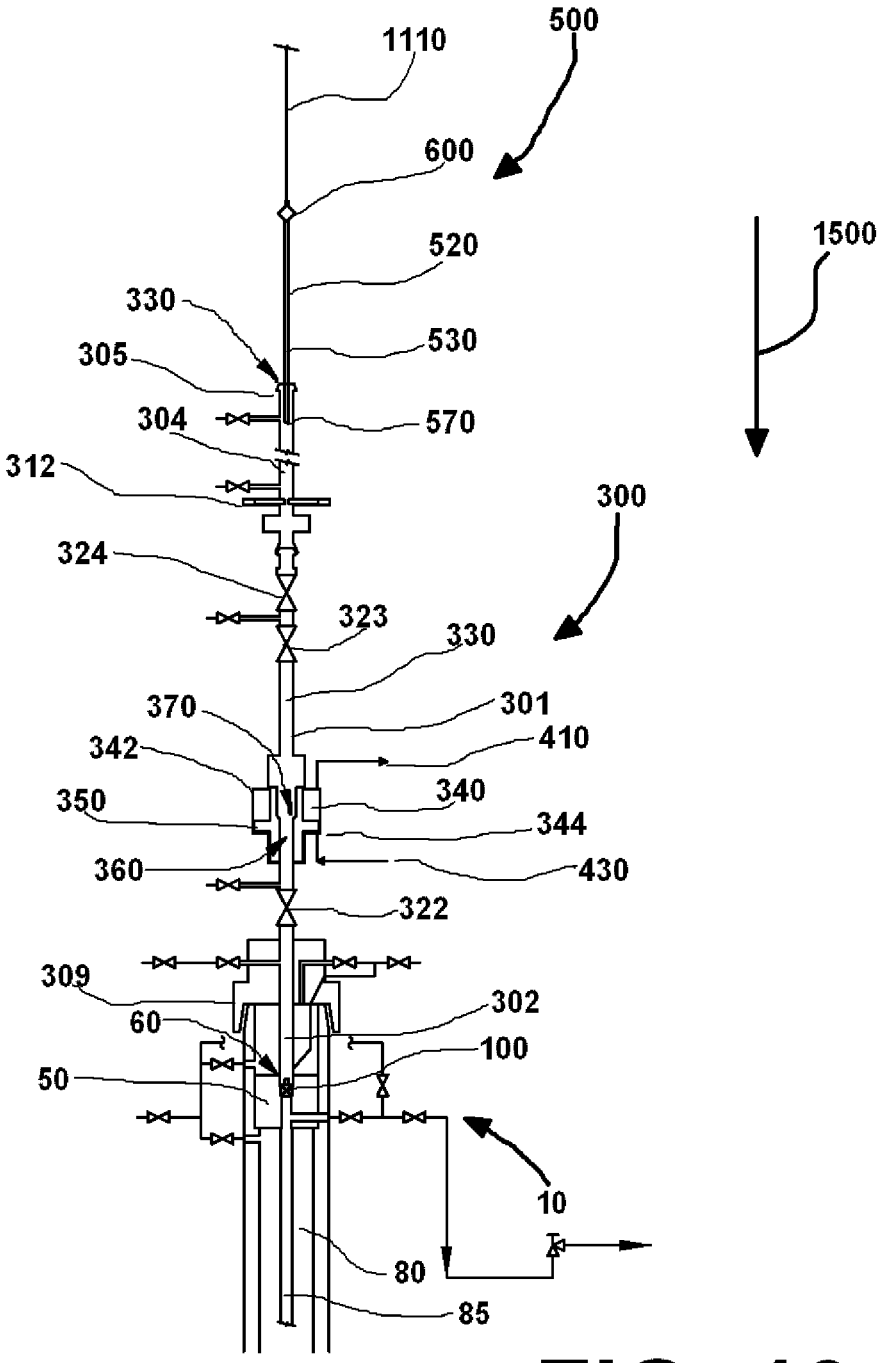
FIG. 10 schematically shows the jacking string entering the top of the lubricator portion of the jacking system.

FIG. 10 schematically shows jacking string 500 entering the top 305 of lubricator 304 portion of jacking system 300. Jacking string 500 will travel downward in the direction of arrow 1500 through central opening 330 past cylinder 340 (and central opening 360 of cylinder 350) and to crown plug 100.

Figure 11:
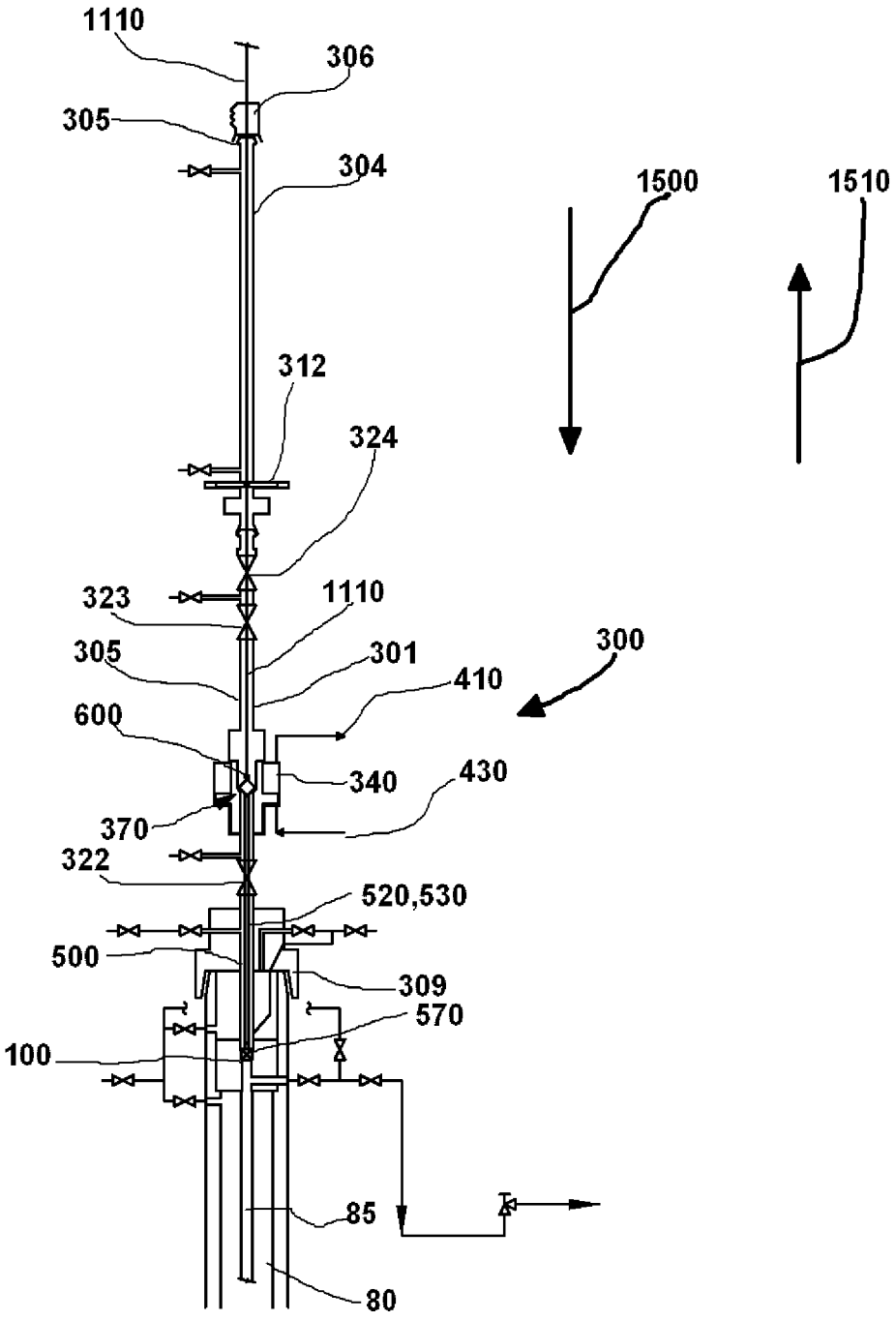
FIG. 11 schematically shows the jacking string connecting to the crown plug.
Figure 12:
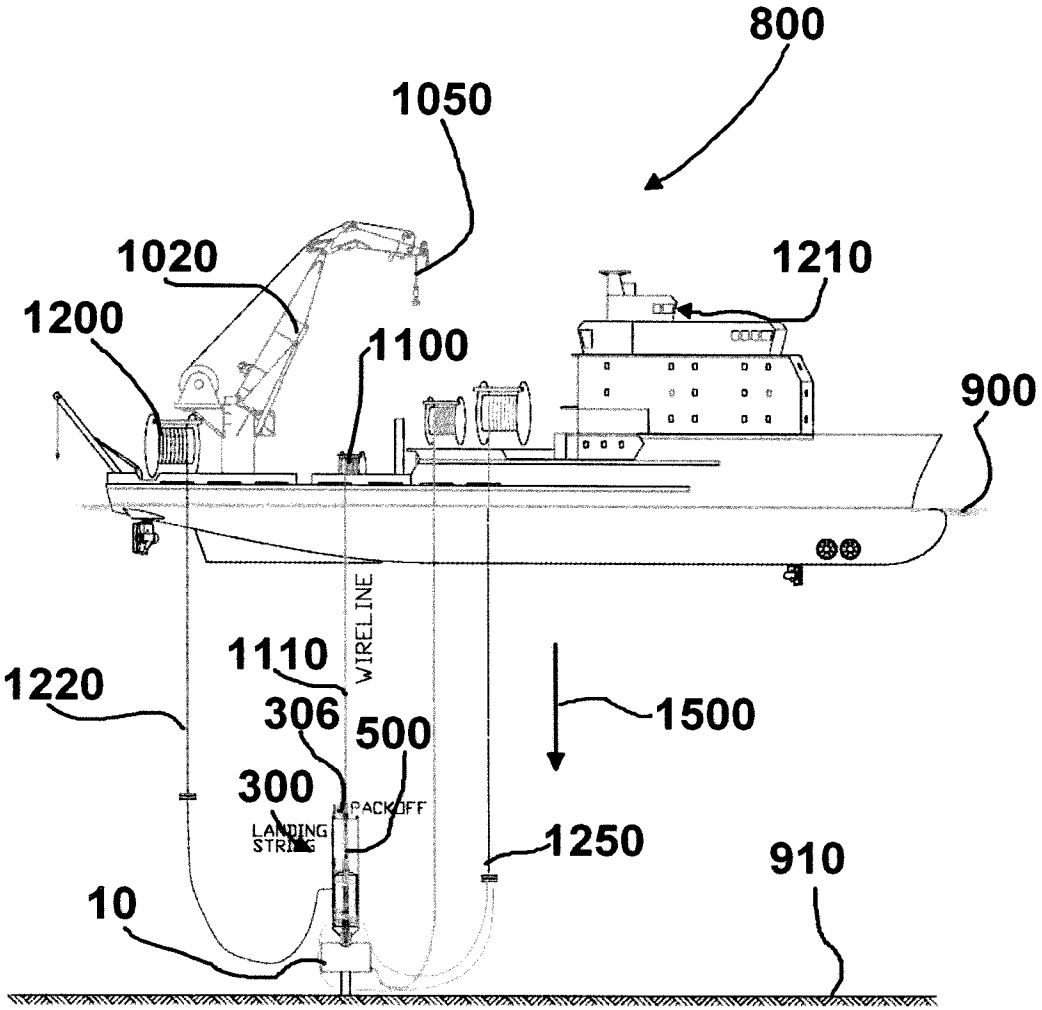
FIG. 12 schematically shows the vessel with the jacking string of the method and apparatus now lowered into the jacking system of the method and apparatus.

FIG. 11 schematically shows jacking string 500, after moving downward in the direction of arrow 1500, and connecting to crown plug 100. FIG. 12 schematically shows vessel 800 with jacking string 500 now lowered into jacking system 300.

At this point crown plug pulling tool 570 is connected to crown plug 100. Also at this point landing area 610 of landing sub/joint 600 is spaced above landing shoulder 370 of piston 350. After connecting to the crown plug 100 tension in the direction of arrow 1510 can be placed on wireline 1110 to see if the plug can be pulled out without using jacking section 300. If crown plug 100 is stuck jacking section 300 can be used to pull out crown plug 100 without having excess tension in wireline 1110.

FIG. 13 is enlarged schematic view of jacking system 300 with jacking string 500 omitted for clarity. The maximum amount of travel 1584 of piston 350 is equal the height 1582 of radial portion 356 subtracted from the height 1580 from upper level 342 to lower level 344 of interior 341 of cylinder section 340.

Figure 14:
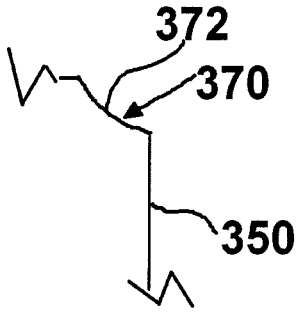
FIG. 14 schematically shows an enlarged view of the landing shoulder of the piston for one embodiment.

FIG. 14 is an enlarged view of the landing area 370 of piston 350. Preferably landing shoulder 370 can be beveled to facilitate landing with landing area 610 of sub 600. Landing shoulder 370 can be rounded in other embodiments. In other embodiments landing shoulder can be flat horizontally.

In various embodiments, as schematically shown in FIG. 6, a washing system 1600 can be provided for washing the crown plug 100 area. If, while jacking string 500 is located inside of jacking section 300, additional washing of crown plug area is desired, washing system 1600 can be used. Washing can be done before and/or after connection to crown plug 100.

Figure 15:
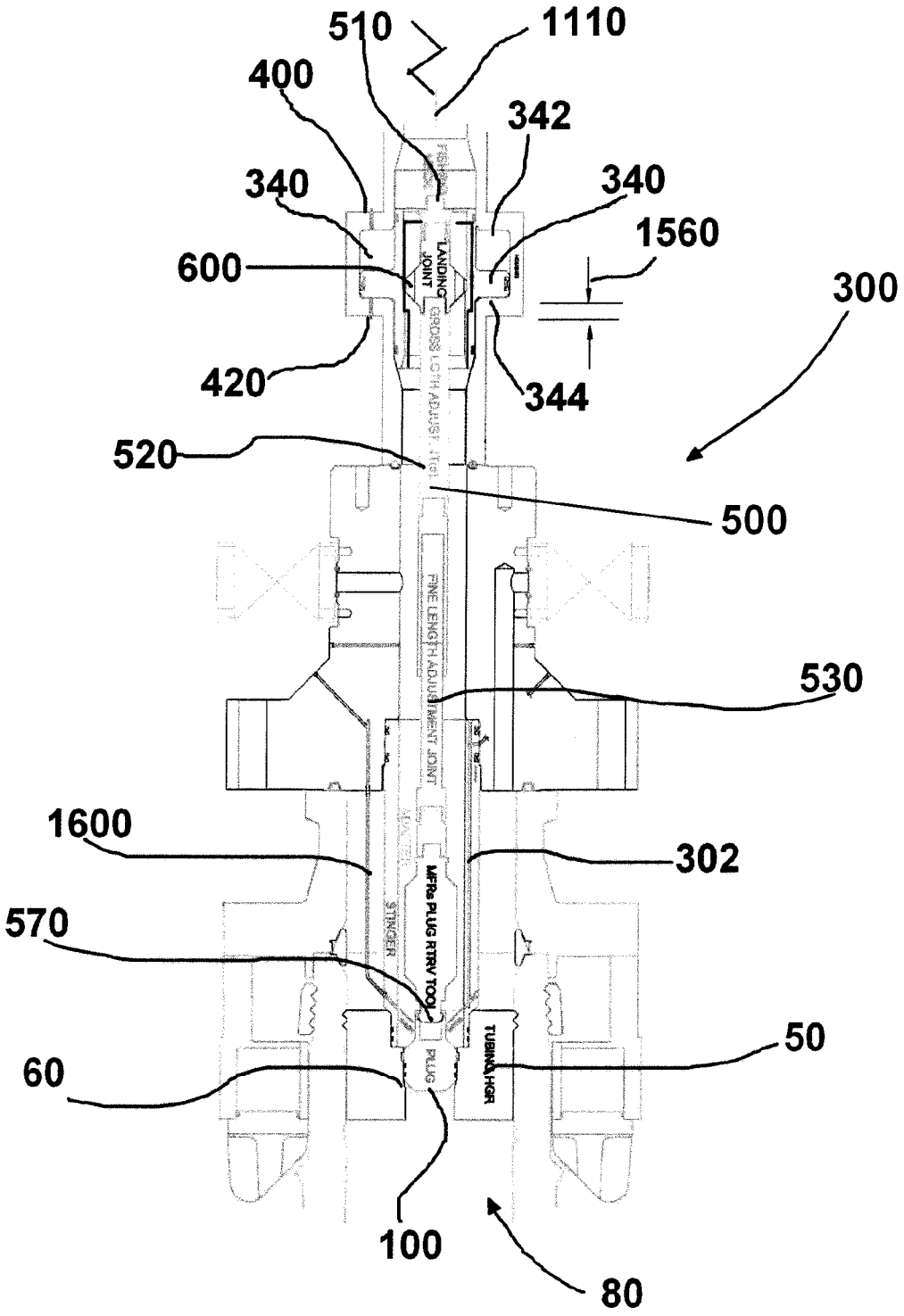
FIG. 15 is an enlarged schematic view of the jacking system of the method and apparatus showing the jacking string attached to the crown plug along with the piston in its lowermost position and a gap existing between the landing shoulder of the piston and the bottom of the landing sub/joint.

FIG. 15 is an enlarged schematic view of jacking system 300 showing jacking string 500 attached to crown plug 100 along with jacking piston 350 in its lowermost position (where lower surface 358 of radial portion 356 of piston 350 is in contact with lower level 344 of cylinder 340). In this figure the height 502 (FIG. 8) from landing area 610 of landing sub/joint 600 to connection point of pulling tool 570 is such that, when connected to crown plug 100, a space 1560 exists between landing area 610 and shoulder 370 of piston.

In various embodiments landing shoulder 370 can be radially static and not move in a direction perpendicular to arrow 1500. Radially static landing shoulder allows flexibility in determining the overall length of jacking string 500. This is because jacking piston 350 has an amount of travel in the direction of arrow 1510 equal to height 1584 which can be greater than the amount landing shoulder 610 of sub 600 is spaced above landing shoulder 370.

Space 1560 can be about ¼, ½, ¾, 1, 1.5, 2, 2.5, 3, 3.5, 4, 4.5, 5, 6, 7, 8, 9, 10, 12, 14, 16, 18, 20, 22, and 24 inches. In various embodiments, space 1560 can be larger than one or more of the specified dimensions. In various embodiments space 1560 can be a range between any two of the specified dimensions.

Figure 16:
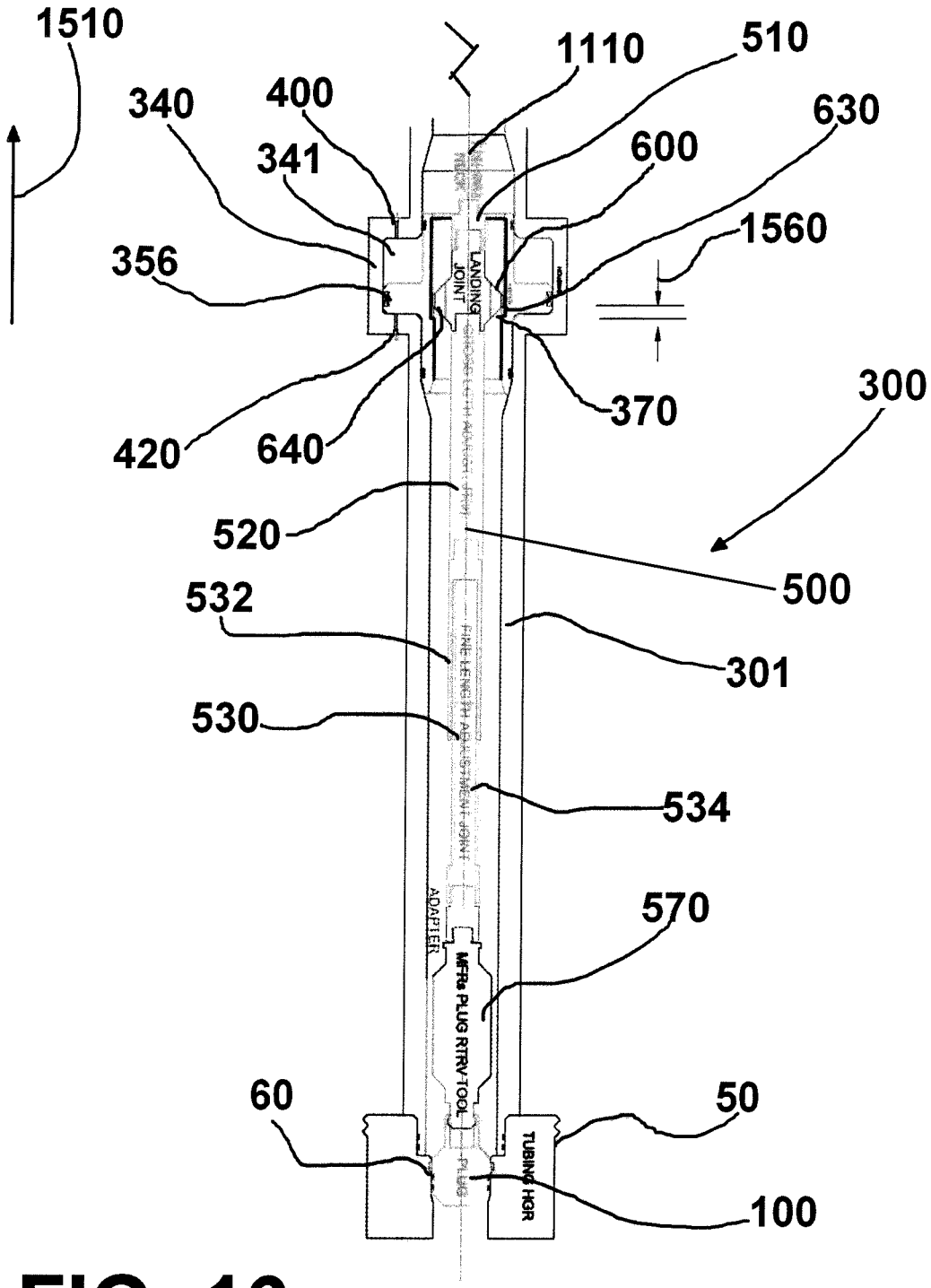
FIG. 16 is an enlarged schematic view of the jacking system of the method and apparatus showing the jacking string attached to the crown plug with the jacking piston now having been raised sufficiently so that its landing shoulder has contacted the bottom of the landing sub/joint.

FIG. 16 is an enlarged schematic view of jacking system 300 showing jacking string 500 attached to crown plug 100 (crown plug pulling tool 570 attached) showing the jacking string 500 attached to the crown plug 100 with the jacking piston 350 now having been raised sufficiently so that its landing shoulder 370 has contacted the bottom landing area 610 of the landing sub/joint 600. In this case jacking piston 350 has moved up until gap 1560 has been closed. Jacking piston 350, after contact, will now impart tensile force to jacking string 500.

Arrow 1510 schematically indicates upward movement of jacking piston 350. To obtain upward movement of jacking piston 350 hydraulic fluid is pumped into lower line 430 to lower fluid port 420 which fluid enters cylinder chamber 341 and pushes upward on radial portion 356 of piston 350 causing piston 350 to move in the direction of arrow 1510. The amount of upward force is approximately equal to the pressure in lower port 420 multiplied by the area of annular surface of radial portion 356. Piston 350 will move up for a distance until it contacts landing area 610 of landing sub 600. The distance moved is equal to the amount spaced landing area 610 was spaced above landing shoulder 370. Once contact between landing shoulder 370 and landing area 610 is achieved upward force (in the direction of arrow 1510) will be applied to landing sub 600 and to jacking string 500, and to crown plug 100. This upward force will be applied independently of any tension on wireline 1110. In one embodiment upward force is placed on jacking string 500 (and crown plug 100) with wireline 1110 in a slacked condition.

The amount of upward jacking force placed on crown plug 100 from jacking string 500 being jacked by piston 350 is dependant on the pressure in inlet port 420.

Hydraulic fluid leaves cylinder 340 through outlet port 400 and outlet line 410.

The total amount of travel in the direction of arrow 1510 that piston 350 has is equal to height 1584.

Figure 17:
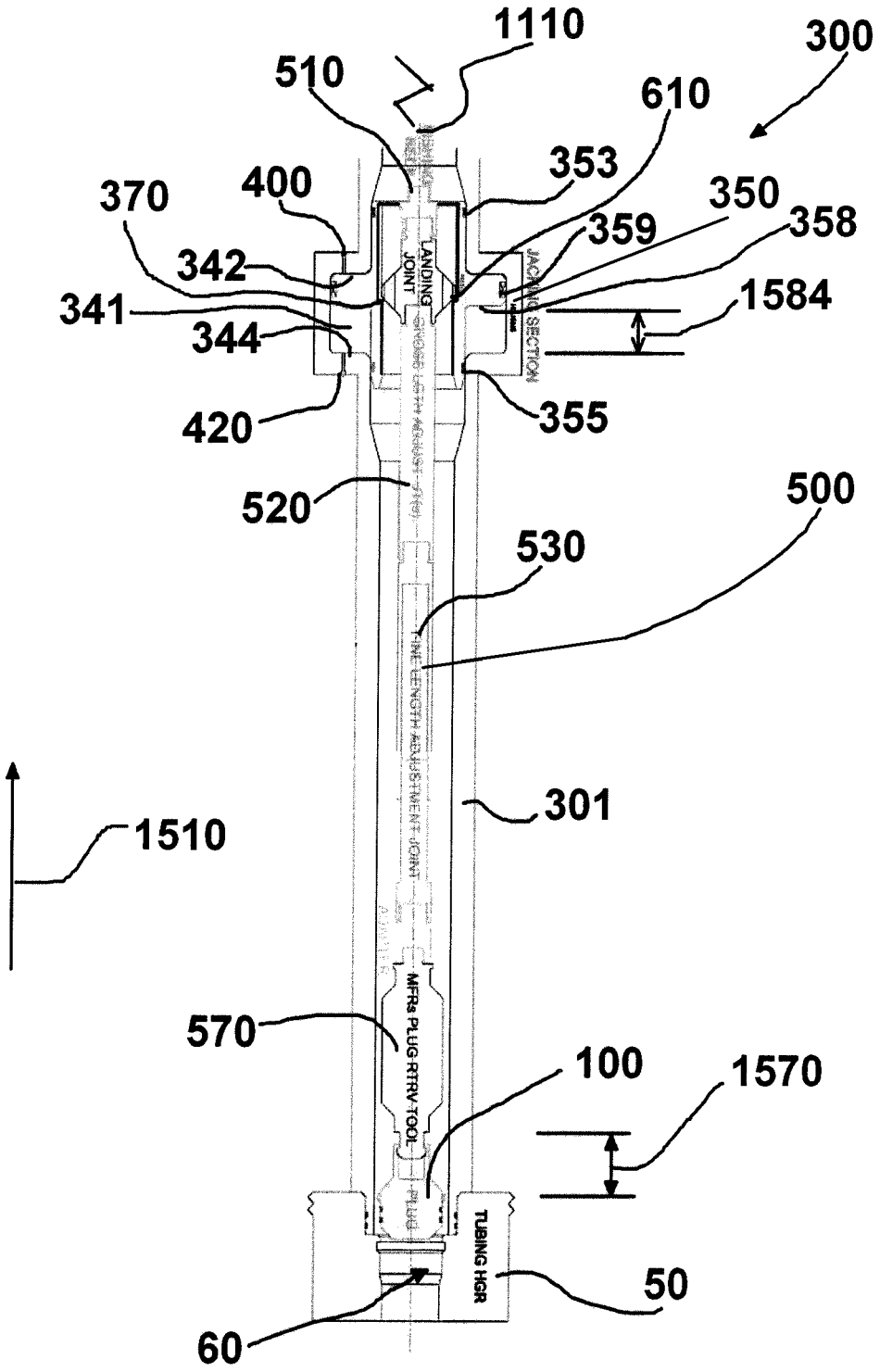
FIG. 17 is an enlarged schematic view of the jacking system of the method and apparatus showing the jacking string attached to the crown plug with the jacking piston in its uppermost position and the crown plug having been pulled and raised.

FIG. 17 is an enlarged schematic view of jacking system 300 showing jacking string 500 attached to crown plug 100 with jacking piston 350 in its uppermost position and the crown plug 100 having been pulled and raised. The total amount of travel 1570 in the direction of arrow 1510 that piston 350 can impart to jacking string 500 and crown plug 100 is equal to total travel 1584 of piston 350 minus the spacing apart 1560 between landing area 610 and shoulder 370.

Figure 18:
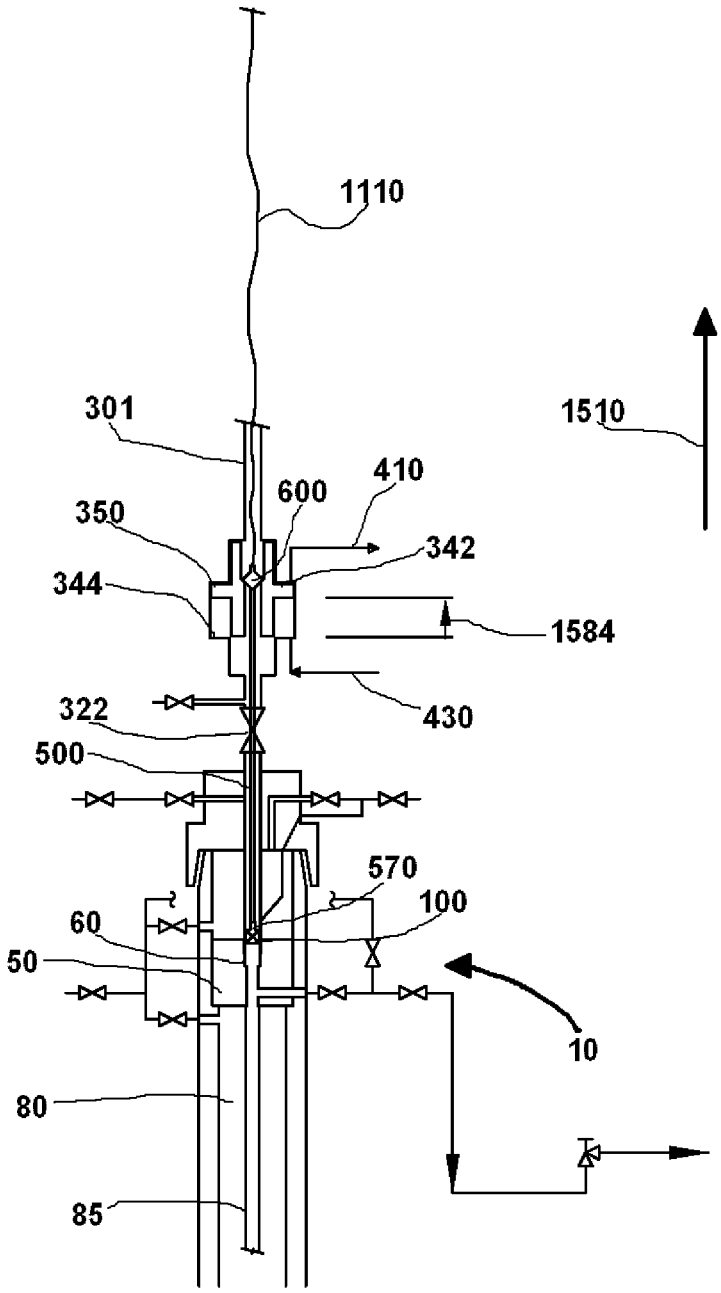
FIG. 18 schematically shows the crown plug after being released by being pulled up by the jacking piston of the jacking section with the jacking string with the jacking piston in its uppermost position and wireline being slack.

FIG. 18 schematically shows crown plug 100 immediately after being released from profile 60 by being pulled up by jacking string 500 being pushed up by jacking piston 350 of jacking system 300. Jacking string 500 now with released crown plug 100 can be raised to the surface 900 using wireline 100.

Figure 19:
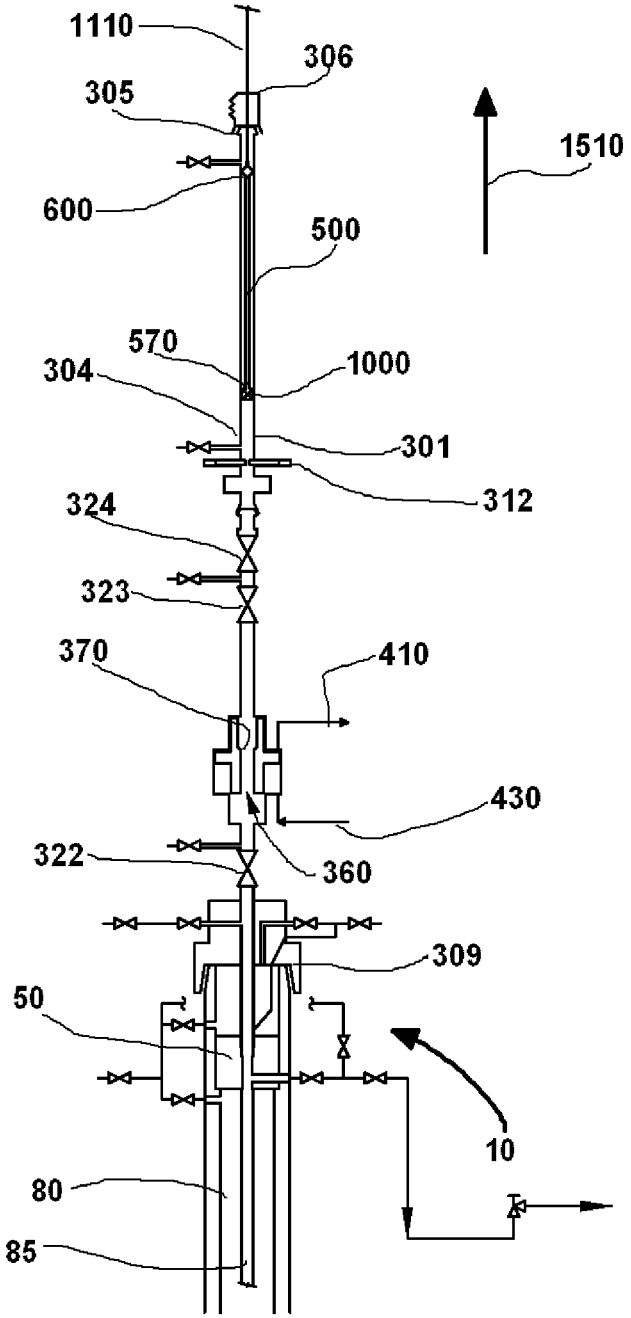
FIG. 19 schematically shows the now released crown plug being pulled up by the wireline string through the lubricator (above the jacking section).
Figure 20:
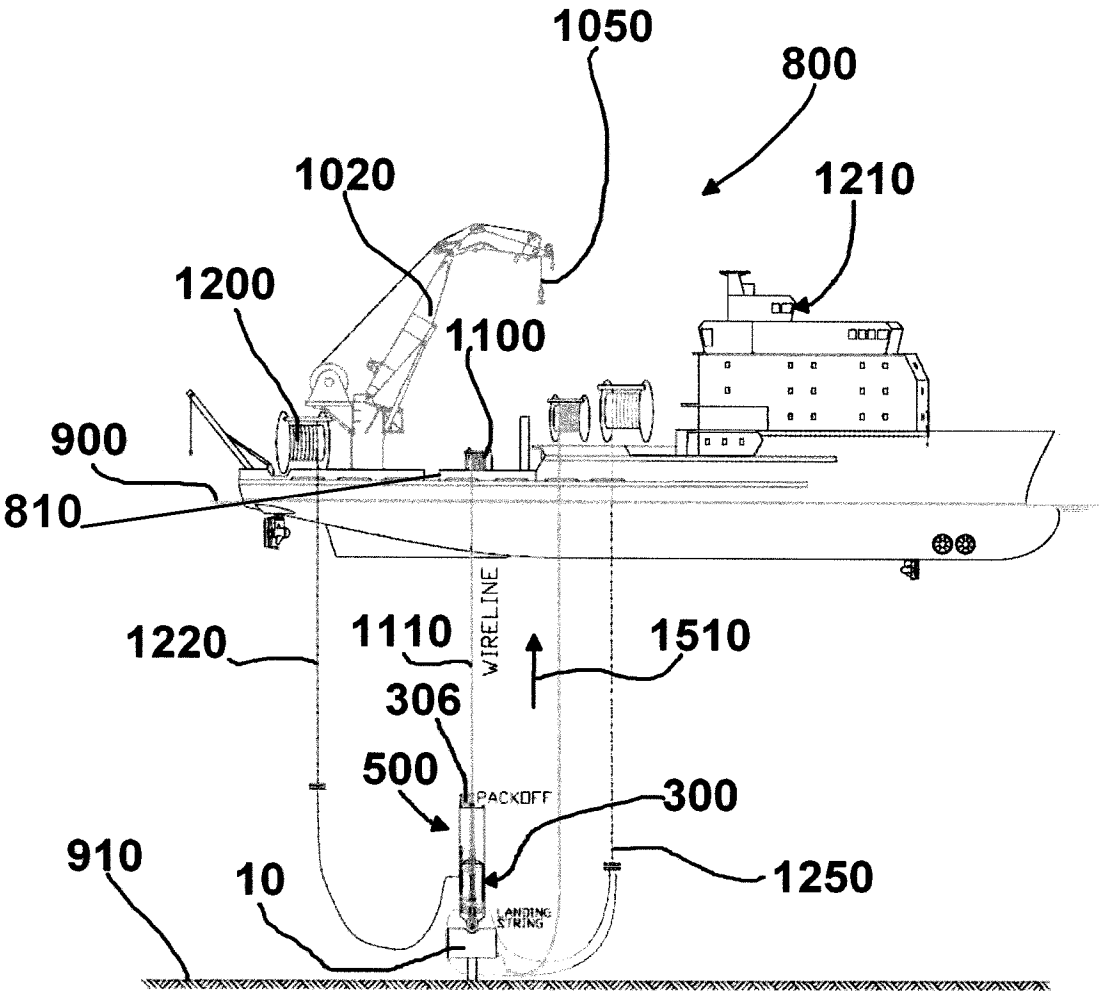
FIG. 20 schematically shows the vessel raising on wireline the jacking string and now released crown plug, while both the jacking string and crown plug are located inside the jacking system.

FIG. 19 schematically shows the now released crown plug 100 being pulled up in the direction of arrow 1510 by jacking string 500 through jacking system 300. FIG. 20 schematically shows vessel 800 raising in the direction of arrow 1510 on wireline 1110 jacking string 500 and now released crown plug 100, while both jacking string 500 and crown plug 100 are located inside jacking system 300. Jacking string 500 with crown plug 100 can now be completely pulled through and out of jacking section 300.

Figure 21:
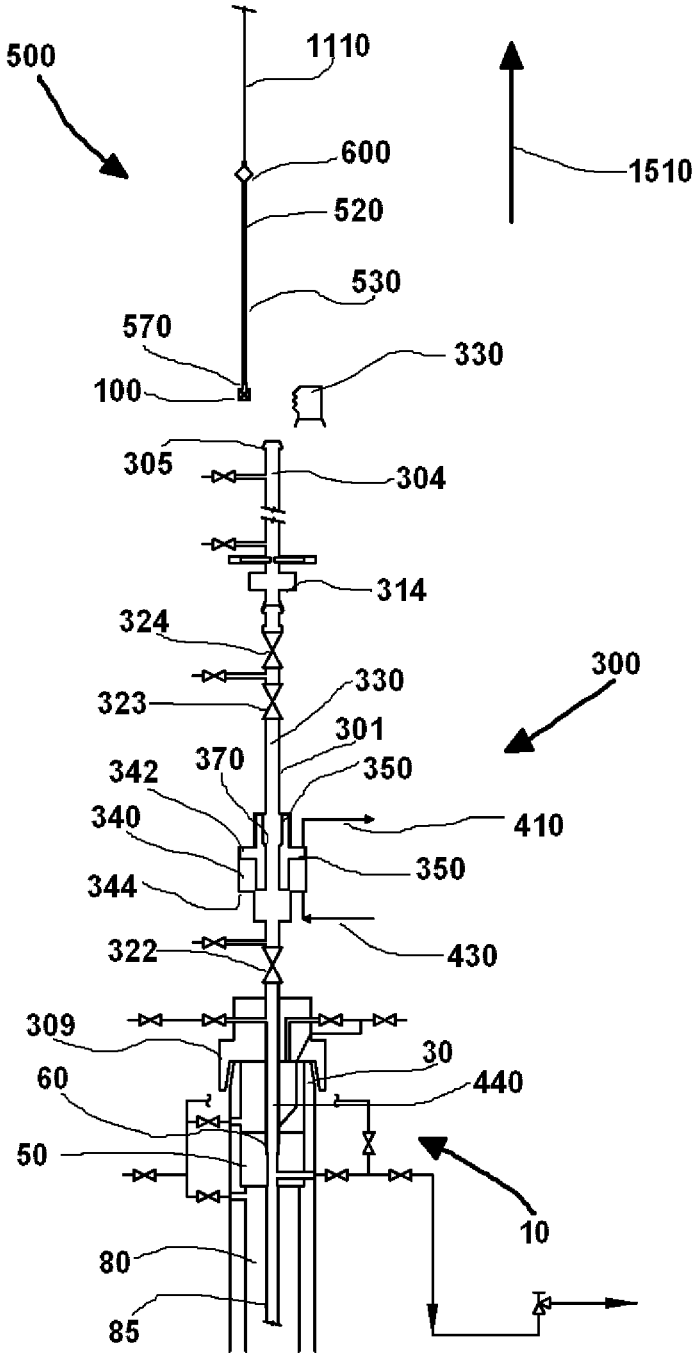
FIG. 21 schematically shows the jacking string and crown plug after being pulled out of the jacking system and being pulled up to the surface.

FIG. 21 schematically shows jacking string 500 and crown plug 100 after being pulled out of jacking system 300 and being pulled up in the direction of arrow 1510 to the surface 900. Jacking string 500 with crown plug 100 can now be up to the surface 900 of the water and to the deck 810 of vessel 800.

Figure 22:
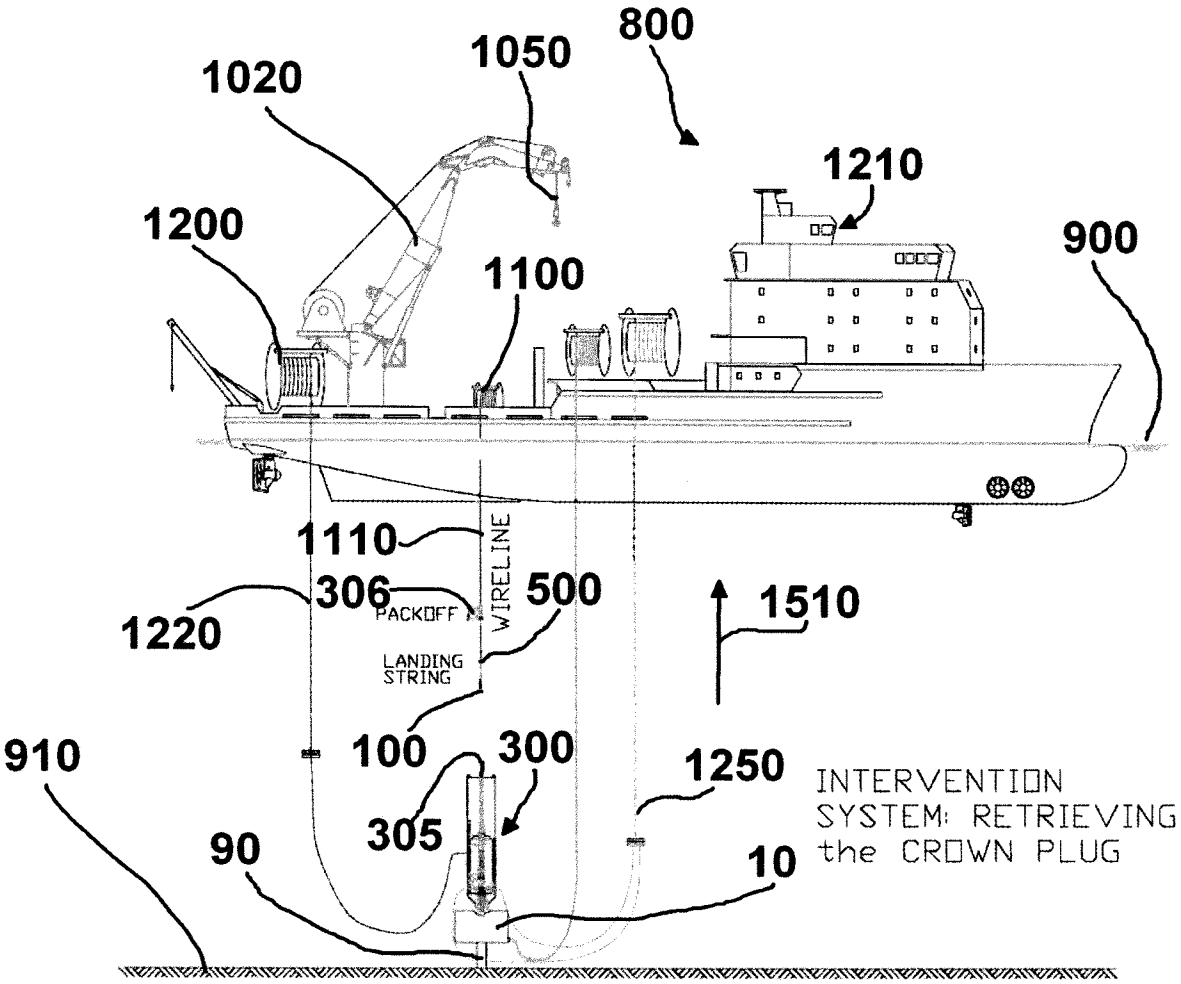
FIG. 22 schematically shows the vessel raising on wireline the jacking string and crown plug up to the surface.

FIG. 22 schematically shows vessel 800 raising on wireline 1110 jacking string 500 and crown plug 100 up to surface 900.

Below is included a more detailed description of one embodiment of the apparatus.

(1) JACKING SECTION 300—Can be mounted into lubricator 304.

(a) Housing or body 301, which contains ports 400 and 410 for pressuring and venting jacking piston 350.

(b) Jacking Piston 350, featuring a landing shoulder 370 onto which the landing shoulder 610 of jacking/landing joint 600 will land out.

(2) JACKING STRING 500—drops into the jacking system 300 at a later time (a) Fishing Neck 510—adapts the jacking string 500 for wireline 1110 use.

(b) Jacking/landing joint 600—"Wide Spot" in the jacking string 500. Lands out on landing shoulder 370 of jacking piston 350. In one embodiment landing joint 600 possesses flow-by holes or milled slots 640 to allow bore fluids to pass by as it is dropped into the bore. In one embodiment the landing joint 600 lands on a shoulder 370 included in the jacking piston 350 of the jacking section 300.

In one embodiment a protruding shoulder or landing shoulder 370 (protruding out from the piston 350 into bore 360) is excluded and replaced with a custom-engineered expanding ring on the landing joint 600 that operatively fits into a special groove or multiple grooves in the piston 350 inner diameter—which would provide the ability to achieve a slightly larger through bore than a "shoulder" design.

(c) Gross Length Adjustment Tool or Joint 520. This fill the space between landing joint 600 and the more important pieces below. This joint can be comprised of several pup joints, possibly of varying lengths.

(d) Fine Length Adjustment Joint 530—A long assembly with a male half 534 and a female 532 half, allows length adjustment for final space-out. In one embodiment is allowed plus/minus 6 inches of length adjustment.

(e) Adapter 560—Fits lower threaded connection of fine length adjustment joint 530 and connects to conventionally available crown plug pulling tool 570. Because there are different manufacturers for different crown plug pulling tools along with different crown plug pulling tools for the same manufacturers, there is envisioned that several adapters will be provided for operable attachment to various sizes and various manufacturers' tools.

(f) Crown Plug Pulling Tool 570, which is conventionally available and can be rented or purchased from OEM manufacturer. Has been previously used to pull crown plugs when crown plug pulling tool is attached to wireline. In one embodiment a specialized crown plug pulling tool will be developed, and conventionally available crown plug pulling tools will not be used.

(3) Crown Plug 100—the plug to be pulled.

In one embodiment the jacking section 300 can be attached to lubricator 304 of a subsea lubricator system.

In one embodiment jacking system 300 is not a permanent fixture of the lubricator 304 of a Subsea Plug and Abandonment System.

In one embodiment jacking system 300 can be run as part of a tubing string or casing string.

In one embodiment the jacking section 300 can be attached to partially closed set of blow out preventer rams.

In one embodiment the method and apparatus can be used as a potential stand-alone product line for jacking crown plugs out of stubborn holes.

Simplified Crown Plug Pulling Procedure

Below will be described a sample crown plug 100 removal procedure for the jacking system and jacking string 500.

(1) Before running jacking system 300 confirm that the jacking piston 350 is in the "Down" position, where radial 356 is in contact with lower level 344 of cylinder 340 (and, if not in the down position, it is brought to such position such as by being pumped down).

(2) Land the jacking system 300 onto horizontal christmas tree 10.

(3) Wash the area above crown plug 100, circulate at a high volume to remove debris from the connection area of the crown plug 100.

(4) Assure correct stackup dimension between crown plug 100 and landing shoulder on jacking piston 350.

(5) Assemble jacking string 500 above the surface of the water 900 (e.g., on deck 810). Set stack-up height of jacking string 500 such that landing shoulder 610 of the jacking sub 600 will not land contact landing shoulder 370 of jacking piston 350 after the connector of the jacking string latches onto crown plug 100. The landing shoulder 610 of jacking sub 600 should sit between ½ and 1 inch "high" (relative to landing shoulder 610 of jacking piston 350) at the time jacking string 500 latches onto crown plug 100. This will allow proper latching onto the crown plug 100.

(6) Lower in the direction of arrow 1500 jacking string 500 into jacking system 300 with wireline 1110.

(7) When jacking string 500 lands out (latches to the crown plug 100), take nominal over-pull to verify proper latching into crown plug 100.

(8) Relax wireline 1110 tension on jacking string 500.

(9) Actuate the jacking piston 350 by pressuring line 430 to port 420 on the bottom side radial portion 356 of jacking piston 350.

(10) Pressure until rising jacking piston 350 landing shoulder 370 contacts the landing shoulder 610 of jacking sub/landing joint 600. At this point the hydraulic pressure should raise because now the jacking string 500 will start pulling on the crown plug 100 and will see increased resistance. In one embodiment conventional jarring tools can be used to attempt to remove the crown plug 100 without assistance of the pulling force of the jacking piston 350. In one embodiment jarring tools can be used in combination with the pulling force of jacking piston 350 to remove the crown plug 100.

(11) Monitor pressure as jacking piston 350 travels upward.

(12) Continue to raise in the direction of arrow 1510 jacking piston 350 until its limit of travel is reached (i.e., radial portion 356 contacts upper level 342 of cylinder 340).

(13) At this point crown plug 100 has been removed from its profile 60.

(14) Using wireline 1110 remove jacking string 500 (now connected to crown plug 100) out of jacking system 300 and to the surface 900 of the water.

In one embodiment conventional wireline methods (e.g., wireline, weight, and jarring tools) will be used to install the crown plug. The jacking section will not participate in the insertion of a crown plug.

Detailed Method of Use

Engineering/Long Term Preparation

1. Obtain drawings of the subsea horizontal christmas tree 10 from either the well owner, operator, or original equipment manufacturer.

2. Engineer and fabricate a stinger to fit between the bottom adapter of the jacking system 300 and the tubing hanger cavity 18 within the tree 10.

With the exception of Item 1 below, the subsea lubricator system can be in place and connected to both surface support equipment (e.g., umbilicals) and existing subsea tree.

Surface Preparation

1. Verify jacking circuit of jacking system 300 is operational from hydraulic power unit 1200, down hydraulic umbilical 1220, to cylinder section 340. Test jacking system 300 on deck of vessel 800 to assure piston 350 travel. Monitor travel by observing fluid passage from pressure side (inlet 410) to return side (outlet 430) of hydraulic circuit. Assure piston 350 return to original position (lower surface 358 of radial portion 356 of piston in contact with lower portion 344 of cylinder 340) upon removal of pressure. This procedure can be done while jacking system 300 is on deck 810 (i.e., prior to lowering to subsea tree 10).

2. Verify total height 19 from crown plug 100 retrieval latch to landing shoulder 370 of piston 350—which includes the height 19 from crown plug 100 retrieval latch to shoulder 17 of tree 10, and then from base 315 of jacking section 300 to landing shoulder 370 of piston 350. This involves checking tree 10 drawings versus specifications of the method and apparatus, and preferably is done prior to mobilization.

3. Verify materials available for the jacking string 500 (listed from top of string to bottom):

(a) Wireline jars. Need at a minimum, the ability to jar upward for eventual unlatch from crown plug 100 if needed. Recommend jars with ability in both directions.

(b) Fishing neck 510;

(c) Lifting sub 600 with shoulder 610;

(d) Gross Length Adjustment Joints 520 (various pup joint lengths)

(e) Fine Adjustment Joint 530 (including upper 532 and lower 534 portions);

(f) Adapter Sub (adapts the manufacturer's Plug Overshot Tool to the bottom of the Fine Adjustment Joint)

(g) Crown plug 100 (duplicate of the plug present in the subsea trea)

(h) Manufacturer's retrieval tool/sub 570.

4. Assemble the jacking string 500.

(a) Adjust gross length (via gross length adjustment tool or joint 520) string 500 by using correct length and number of pup joints.

(b) Adjust final length of string (via fine length adjustment tool or joint 530) by telescoping adjusting in or out upper portion 532 relative to lower portion 534.

(c) Double check the total length of jacking string 500 from landing shoulder 610 of landing sub 600 to crown plug 100 retrieval latch.

(d) Preferably, assemble jacking string 500 so that the length (of jacking string 500 from landing shoulder 610 of landing sub 600 to crown plug 100 retrieval latch) is approximately one half (½) inch longer than distance from step 2 above (total height 19 from crown plug 100 retrieval latch to landing shoulder 370 of piston 350).

5. Attach jacking string 500 onto wireline 1110. NOTE that lubricator 304 packoff 306 should be present in wireline 1110 string just above any pulling string/jars attached to jacking string 300.

Subsea Procedure

1. Assure that well is in condition suitable for removal of crown plug 100 from a safety standpoint. NOTE: Removal of crown plug 100 exposes the condition of the wellbore 80 to the lubricator 304.

2. Line up valves in jacking system 300 (such as by using a remotely operated vehicle—ROV) for washing of the crown plug 100 area (FIG. 6).

(a) Assure cleanliness of Cement System from prior operations. Spot seawater within jacking system 300 and hydraulic control panel 1210.

(b) Close bottom Gate Valve 322.

(c) Line up Cement Return 1250 on surface to accept returns from the wash function.

(d) With ROV, line up Cement Pump-in to divert fluid to the crown plug 100 wash ports (FIG. 6).

(e) Pressure up Cement Pump-in circuit and flow seawater at a high rate through the crown plug 100 wash ports. (Returns come back via the Cement Return circuit.)

(f) Secure from the wash operations.

(g) Line up valving to support well control operations.

3. Open (or assure open condition of) upper two gate valves 323 and 324.

4. Close bottom gate valve 322.

5. Run (in the direction of arrow 1500) on wireline 1110 jacking string 500 from vessel 800 down to just above top of lubricator 304 of jacking system 300.

6. Gently stab bottom of jacking string 500 into open top of lubricator 304 of jacking system 300 (the ROV can be used as a camera during this stabbing operation).

7. Slowly lower (in the direction of arrow 1500) jacking string 500 into lubricator 304 of jacking system 300. As jacking string 500 is completely lowered into lubricator 304, packoff 306 will land out on top of lubricator 304.

8. Continue lowering (in direction of arrow 1500) jacking string 500 and jars down into lubricator 304 a safe distance beyond the observed heave of vessel 800.

9. Latch packoff 306 onto top of lubricator 304 (ROV can be used for this step).

10. Pressure test lubricator 304 between packoff 306 and the lowest gate valve 322 until a successful test is achieved.

11. Open lowest gate valve 322 to full open.

12. Continue lowering (in the direction of arrow 1500) jacking string 500 until connector 572 of crown plug pulling tool 570 (the manufacturer's Plug Overshot) latches into the crown plug 100. Allow a nominal amount of slack in the wireline 1110 by releasing tension on the wireline 1110.

(a) NOTE that the landing shoulder 610 of the jacking sub 600 will be sitting about one half (½) inch "high" relative to the shoulder landing section 370 of jacking piston 350, e.g., it has not landed out and will have a height gap 1560 (e.g., FIG. 15).

(b) The jacking string 500 possesses flowby ports so that circulating within the lubricator 304 can occur if needed.

(c) The bottom two Gate Valves (322 and 323) cannot be closed at this point because they are blocked by the jacking string 500. The pressure retention barriers available to the jacking system 300 in this mode are the topmost Gate Valve 324[which can cut wireline 1110] and the lubricator 304 packoff 306, along with possibly using a wireline valve 312.

(d) Take an overpull on wireline 1110 (in the direction of arrow 1510) to verify latching of jacking string 500 to crown plug 100. Achieve a reliable overpull.

(e) Attempt to pull crown plug 100 using manufacturers' recommended wireline tension on wireline 1110. If crown plug is not released proceed to use jacking piston 350.

Where wireline by itself does not pull out crown plug 100 use jack to pull (f) Release tension on wireline 1110, allowing nominal slack.

(g) Record hydraulic fluid volume jacking cylinder 340/jacking circuit 350 (ports 410 and 430) or reset volume indicator to zero.

(h) Pressure up the jacking cylinder 340 circuit (port 420 through line 430) to a low pressure. The gauge should show no/low pressure for a short time until landing section 370 of piston 350 travels up (about ½ inch) in the direction of arrow 1510 and applies force to the jacking string 500 via contact with landing shoulder 610 of landing joint 600.

(i) At the time the landing shoulder 610 and landing section 370 contact each other, the pressure reading in lines 410 and 430 should start increasing.

(j) Increase pressure in line 430 slowly to apply additional force on cylinder 350 through landing joint 600, jacking string 500, and ultimately to crown plug 100. When crown plug 100 releases from profile 60 of tubing hanger 50 of christmas tree 10, hydraulic pressure in lines 410 and 430 should drop immediately.

First alternative procedure where increase in jack pressure does not pull out crown plug 100

(k) If crown plug 100 does not release, continue increasing pressure until one half of the maximum allowable pressure for hydraulic system 1200 is reached. Hold this pressure for an adequate amount of time. Monitor gauge for release (pressure drop will be seen if this happens.)

(l) If no release of crown plug 100 is obtained and if jars have been run, jar the jacking string 500 (and connected crown plug 100). Monitor gauge for pressure drop.

(m) Repeat Steps i, j, k at three quarters of the maximum allowable pressure for hydraulic system 1200. If no release of crown plug 100 is achieved repeat steps i, j, k for 100% of maximum.

(n) To determine when crown plug 100 mechanism "pulls," note the following indications:

(i) Pressure will drop in hydraulic lines 410 and 430.

(ii) Flow will continue until a calculated amount of gallons have been pumped through hydraulic lines 410 and 430 to give enough movement of piston 350.

(iii) At the end of jacking piston 350 travel, radial section 356 contacts upper level 342 of jacking cylinder 340, hydraulic pressure in lines 410 and 430 will spike upward.

Second alternative procedure where increase in jack pressure does not pull out crown plug 100

($l_1$') If the crown plug 100 does not release, continue increasing pressure until a jack piston 350 pressure suitable to impart 5,000 lbs of upward tension on the crown plug 100 is reached. Hold for a nominal amount of time (e.g., 5, 10, 15, 20, 30 seconds, 1, 2, 3, 4, 5, and/or 10 minutes or a range between any two of these times). Monitor gauge for release (pressure drop will be seen if this happens.)

($l_2$') If no release, activate jars to jar the system at this point. Jar upwards (the direction to apply tension to crown plug 100) while keeping constant pressure on jack piston 350. Monitor gauge for pressure drop.

($m_1$') Repeat Steps k, $l_1$, and $l_2$ for a jack piston 350 pressure suitable for 10,000 lbs of upward force on jack. After jarring, if no release, ($m_2$') Repeat steps k, $l_1$, $l_2$, and $m_1$ for a jack piston 350 pressure suitable for 15,000 lbs of upward force. After jarring, if no release, ($m_3$') If crown plug does not pull free, repeat steps k, $l_1$, $l_2$, $m_1$, and $m_2$ using piston 350 pressures suitable for increasing increments of upward tension on crown plug 1000, in 5000 lb increments.

($m_4$') For the maximum force that can be applied to the crown plug 100, this will be the crown plug 100 manufacturers' recommended maximum load on plug 100.

(n') To determine when crown plug 100 mechanism "pulls," note the following indications:

(i) Pressure will drop in hydraulic lines 410 and 430.

(ii) Flow will continue until a calculated amount of gallons have been pumped through hydraulic lines 410 and 430 to give enough movement of piston 350.

(iii) At the end of jacking piston 350 travel, and radial section 356 contacts upper level 342 of jacking cylinder 340, hydraulic pressure in lines 410 and 430 will spike upward.

All steps fail to pull crown plug (o) If the above steps all fail and crown plug 100 will not become released; and unlatching of crown plug 100 is needed, unlatch from crown plug 100 via manufacturers' recommendation. This will likely be a "shearing downward" function.

Retrieving the Crown Plug

For the remainder of this procedure, assume that crown plug 100 has been removed from profile 60 of tree 10 and is now latched to the bottom of jacking string 500.

1. Pull jacking string 500 with attached crown plug 100 up (in the direction of arrow 1510) jacking section 300 and into lubricator 304, leaving room for heave of vessel 800.
2. Shut bottom gate valve 322.
3. Pressure test below bottom gate valve 322 to assure system integrity and well control.
4. Vent lubricator 304 to ambient (sea) pressure.
5. Pull packoff 306 and jacking string 500 with attached crown plug 100 up (in the direction of arrow 1510) out of lubricator 304.
6. Retrieve jacking string 500 with attached crown plug 100 up (in the direction of arrow 1510) to deck 810 of vessel 800. Manually remove crown plug 100 from bottom of jacking string 500 and inspect.

Alternative Embodiment for a Single or Double Collet Jacking System

FIGS. 23-26 and 31 show an alternative pulling embodiment where jacking piston 350 includes a lower collet 2000 which can be placed in collapsed 2040 and non-collapsed 2030 states by vertical movement of jacking piston 350.

Figure 23:
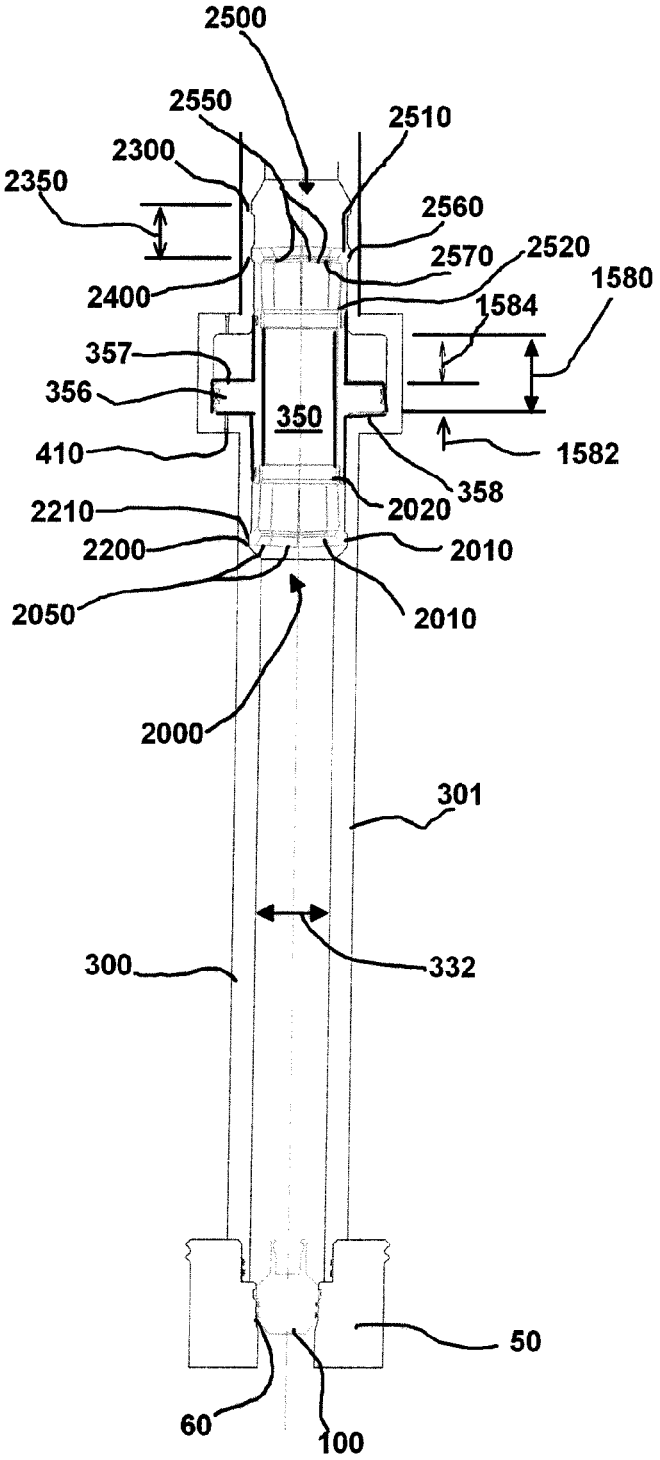
FIG. 23 is an enlarged schematic view of an alternative embodiment of a jacking system of the method and apparatus with the jacking string omitted for clarity, and with the crown plug being in a profile, wherein the crown plug is to be pulled.

FIG. 23 is an enlarged schematic view of an alternative embodiment of a jacking system of the method and apparatus with the jacking string omitted for clarity, and with the crown plug being in a profile, wherein the crown plug is to be pulled. In this embodiment the jacking system 300 can omit the static landing section 370 of the piston section 350, and include a lower collet 2000 attached to the piston section having both collapsed 2040 and non-collapsed 2030 states. Piston 350 can move vertically in the same manner as described in other embodiments.

In the non collapsed state 2030, preferably collet 2000 does not restrict the size of diameter of internal opening 332. However, in the collapsed state 2040, collet 2000 provides a landing shoulder which is of a smaller size than the diameter of internal opening 332.

In one embodiment vertical movement of piston section 350 relative to cylinder section 340 can cause collet to move from a collapsed 2040 to non-collapsed 2030, and/or from a non-collapsed 2030 to a collapsed 2040 state.

In one embodiment collet 2000 can have first end 2010 and second end 2020, along with a plurality of fingers 2050 which can move from collapsed 2040 to non-collapsed 2030, and/or from non-collapsed 2030 to collapsed 2040 states. Plurality of fingers 2050 can be comprised of materials having sufficient strength and biasing characteristics.

Figure 31:
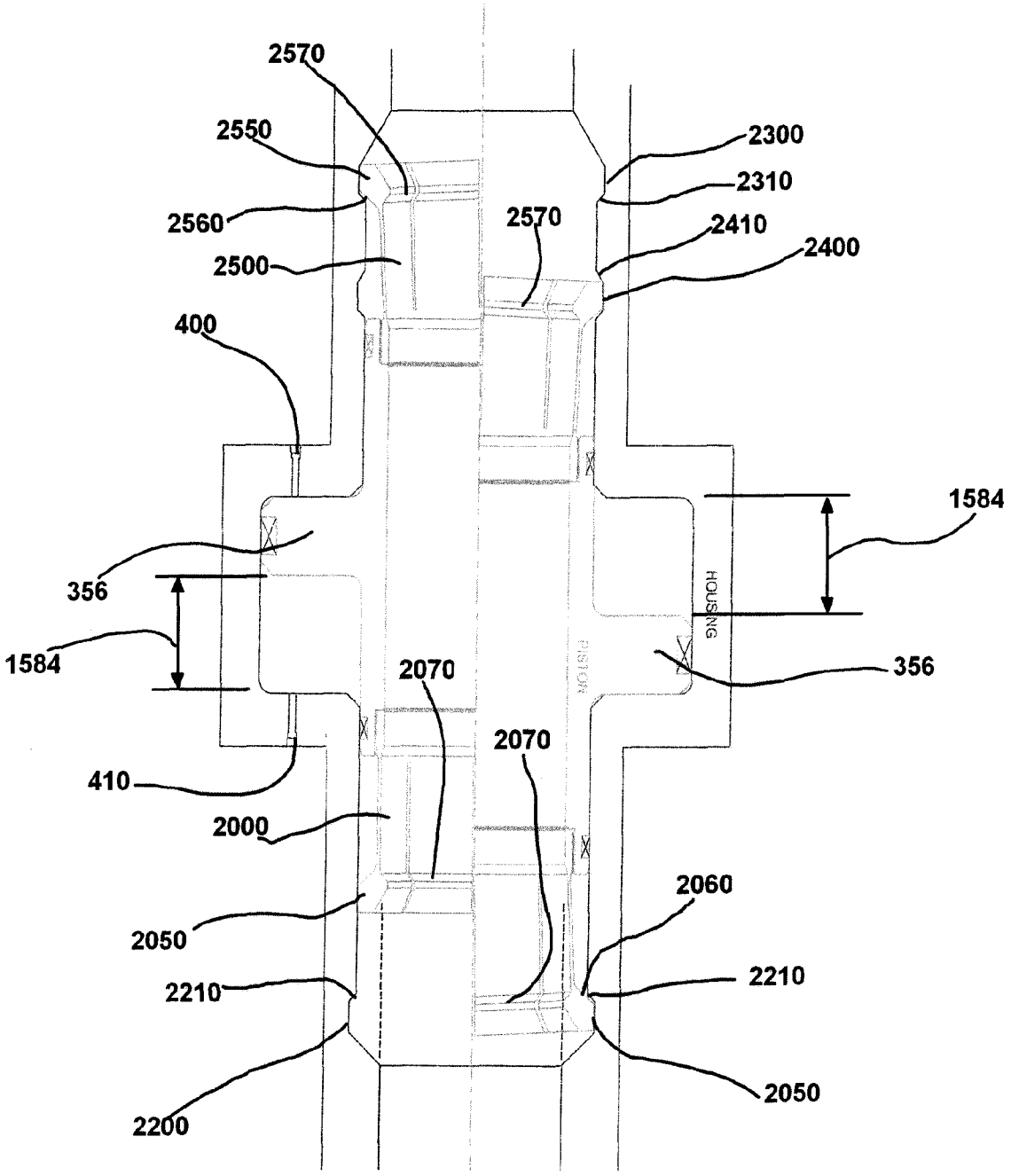
FIG. 31 is an enlarged schematic diagram showing the jacking section of the alternative embodiment of FIG. 23 wherein half of the jack is shown in its lowermost position (ready assist in pulling out a crown plug), and the other half of the jack is shown in its uppermost position ready to assist in pushing in a crown plug.

In FIGS. 23 and 31, collet 2000 is shown in the non-collapsed state 2030 with exterior portions 2060 of plurality of fingers 2050 having expanded into recessed area 2200 so that interior portion 2070 of plurality of fingers 2050 do not restrict central opening relative to diameter of central opening 332. The non-collapsed state 2030 can be obtained when piston 350 is in its lowermost position so that exterior portions 2060 do enter recessed area 2200.

Vertical movement of piston 350 can cause collet 2000 to enter a collapsed 2040 state. Vertical movement of piston 350 causes vertical movement of collet 2000 causing exterior portions 2060 of plurality of fingers to contact angled surface 2210 of recessed area 2200 and causing collet to enter a collapsed 2040 state. In a collapsed 2040 state interior portions 2070 of plurality of fingers 2050 form a landing surface 2080 for landing shoulder 610 of landing sub 600.

Figure 24:
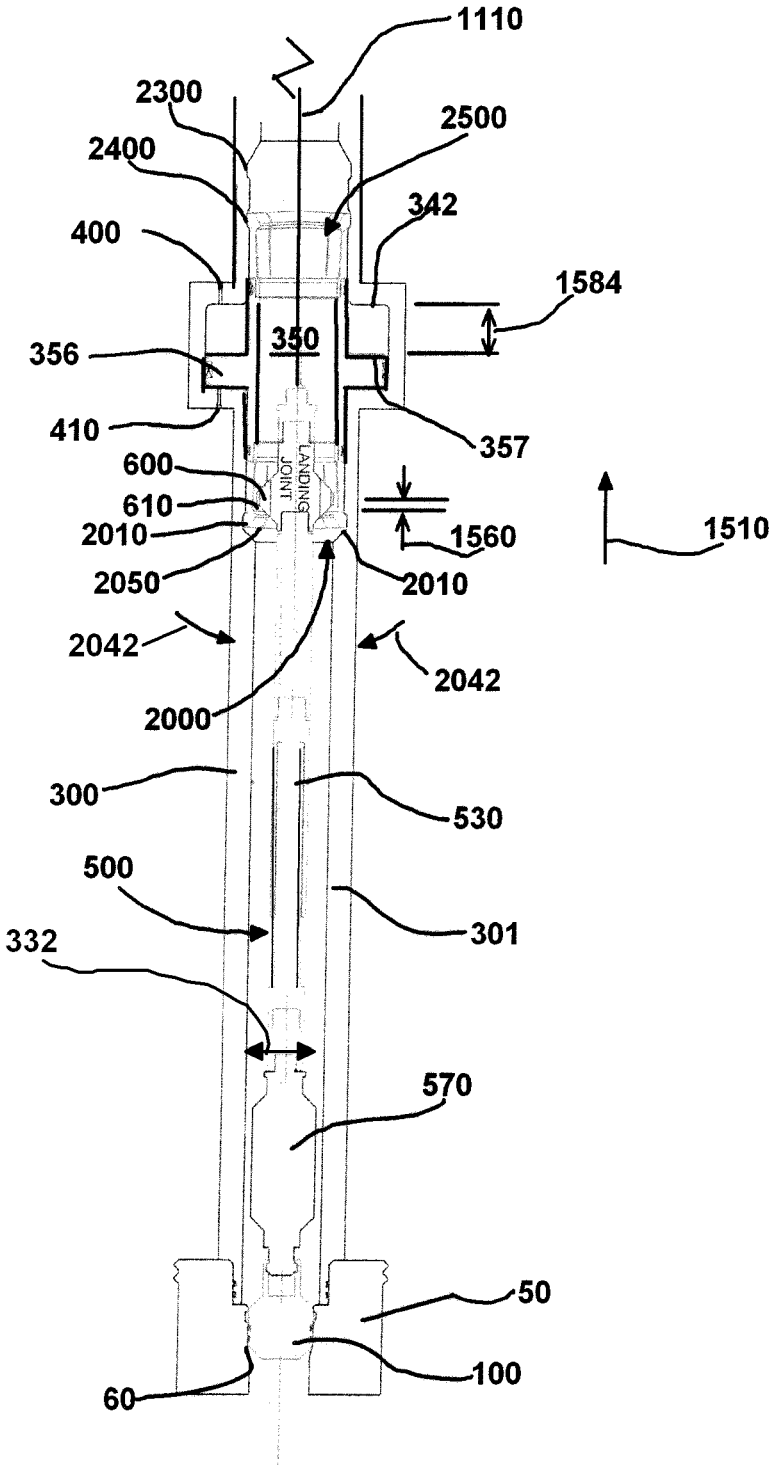
FIG. 24 is an enlarged schematic view of the jacking system of the method and apparatus of FIG. 23 now with the jacking string in its lowermost position attached to the crown plug, wherein the crown plug is to be pulled.

FIG. 24 is an enlarged schematic view of the jacking system of the method and apparatus of FIG. 23 now with the jacking string 500 having been lowered to where it is attached to crown plug 100, wherein the crown plug 100 is to be pulled. Jacking string 500 can be put together above the surface of the water and lowered by wireline 1110 as described in other embodiments. When crown plug pulling tool 570 first contacts crown plug 100, landing shoulder 610 of landing sub 600 of jacking string 500 can be spaced above the interior 2070 portions of plurality of fingers 2050 of collet 2000.

Piston 350 can be caused to be moved vertically upward in the direction of arrow 1510 as described in other embodiments. As piston 350 moves in the direction of arrow 1510, collet 2000 also moves in this direction causing exterior portions 2060 of plurality of fingers to contact angled surface 2210 of recessed area 2200 and causing collet to enter a collapsed 2040 state. In a collapsed 2040 state interior portions 2070 of plurality of fingers 2050 form a landing surface for landing shoulder 610 of landing sub 600. Collapsing arrows 2042 schematically indicate that collet 2000 is entering a collapsed 2040 state.

Figure 25:
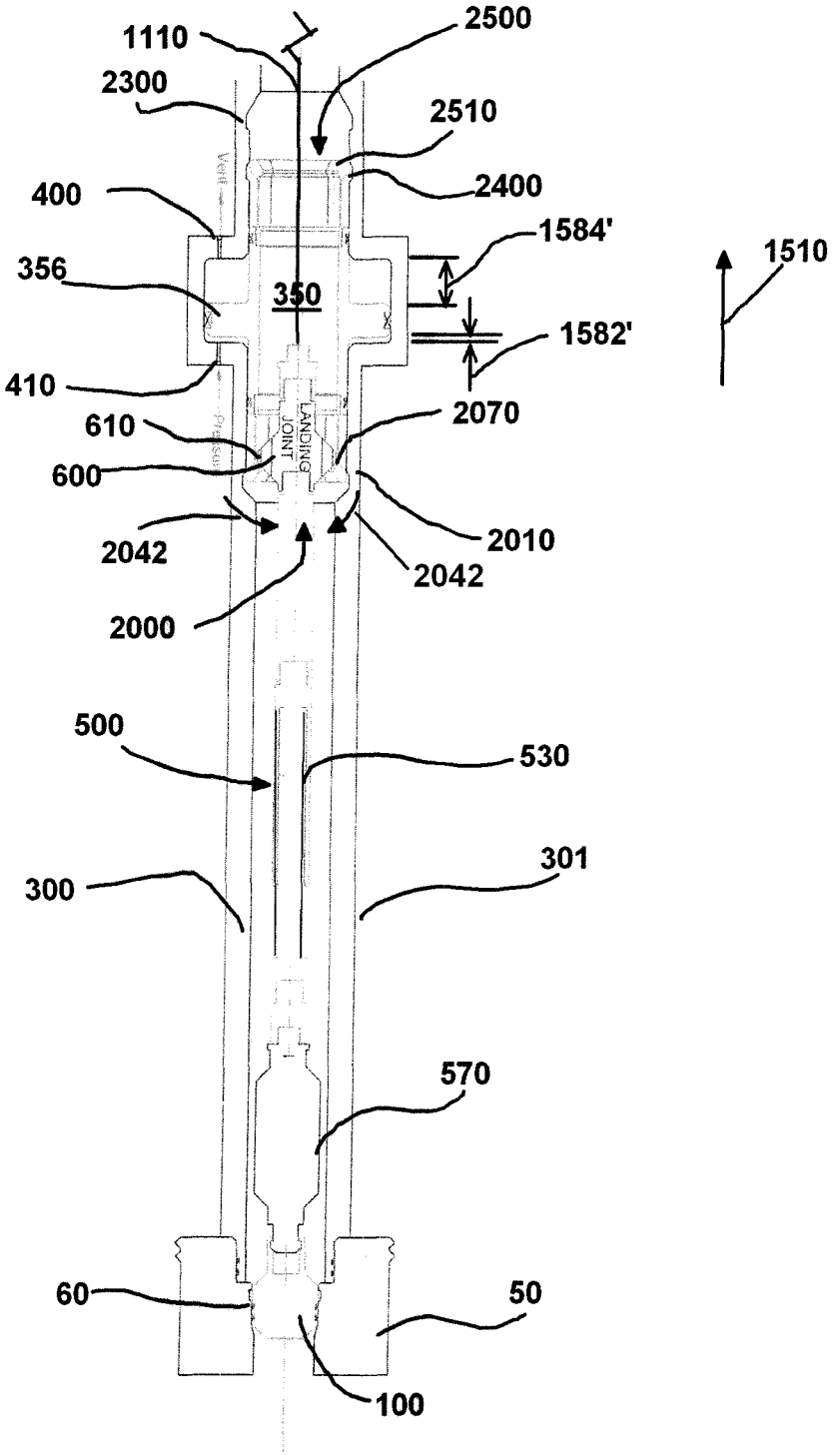
FIG. 25 is an enlarged schematic view of the jacking system of the method and apparatus of FIG. 23, wherein the jack has partially moved up causing the lower collet to start to collapse and form a landing surface for the landing joint of the jacking string.

FIG. 25 is an enlarged schematic view of the jacking system 300, wherein the piston 350 has partially moved up (arrow 1510) causing the lower collet 2000 to start to collapse and form a landing surface for the landing joint 600 of jacking string 500.

When the landing surface formed by collet 2000 being in a collapsed 2040 state contact the landing shoulder 610 of landing sub an upward force (in the direction of arrow 1510) from piston will be placed on landing sub which is transmitted to the crown plug 100.

Figure 26:
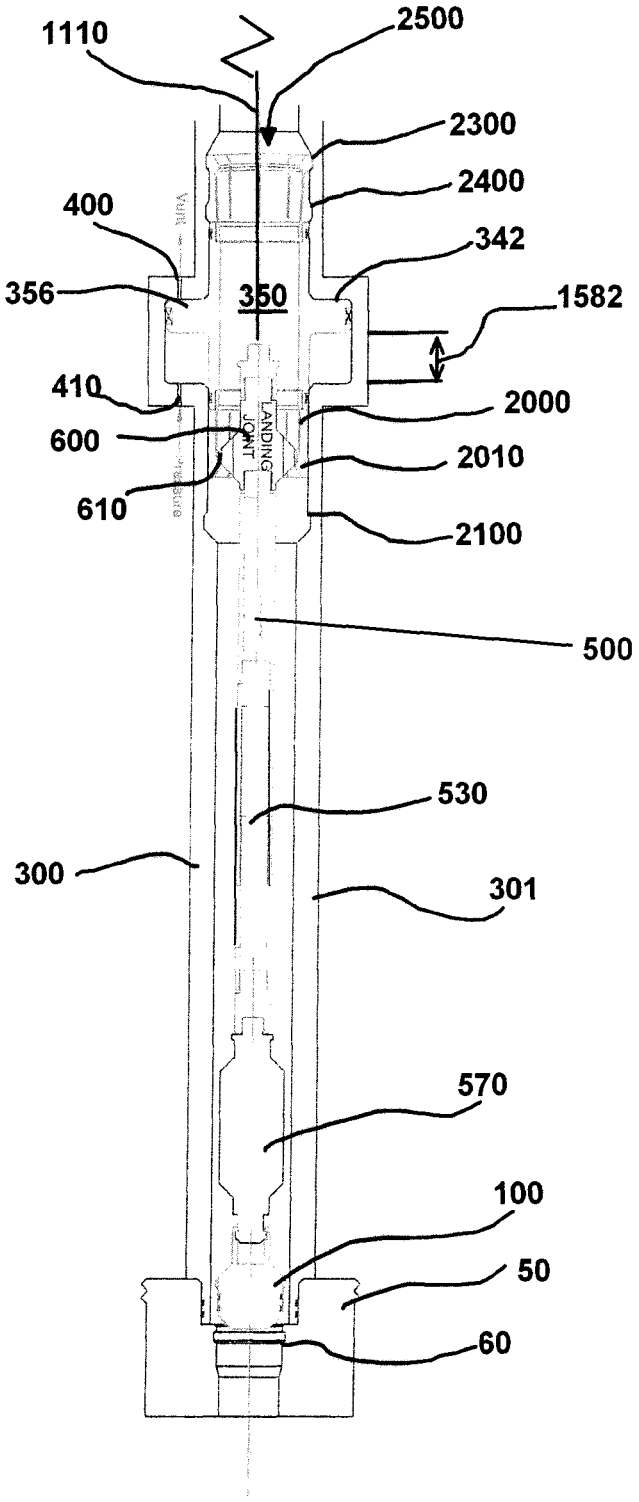
FIG. 26 is an enlarged schematic view of the jacking system of the method and apparatus of FIG. 23, showing the jacking string attached to the crown plug with the jacking piston in its uppermost position and having pulled the crown plug out of the profile.

FIG. 26 is an enlarged schematic view of jacking system 300, showing jacking string 500 with piston 350 and attached collet 2000 which has now lifted jacking string 500 (and attached crown plug 100) such that piston 350 is in its uppermost position (moving up a height 1582) and having pulled the crown plug 100 out of the profile 60. Now, as described with other embodiments wireline 1110 can be used to lift jacking string 500 and attached crown plug 100 up to the surface.

If desired, lower collet 2000 can be placed again in a non-collapsed 2030 stated by lowering piston 350 and attached collet 2000 to its lower position (shown in FIG. 23). In this manner collet 2000, after being put in a non-collapsed 2030 state, will not place any restrictions compared to diameter 332.

Figure 27:
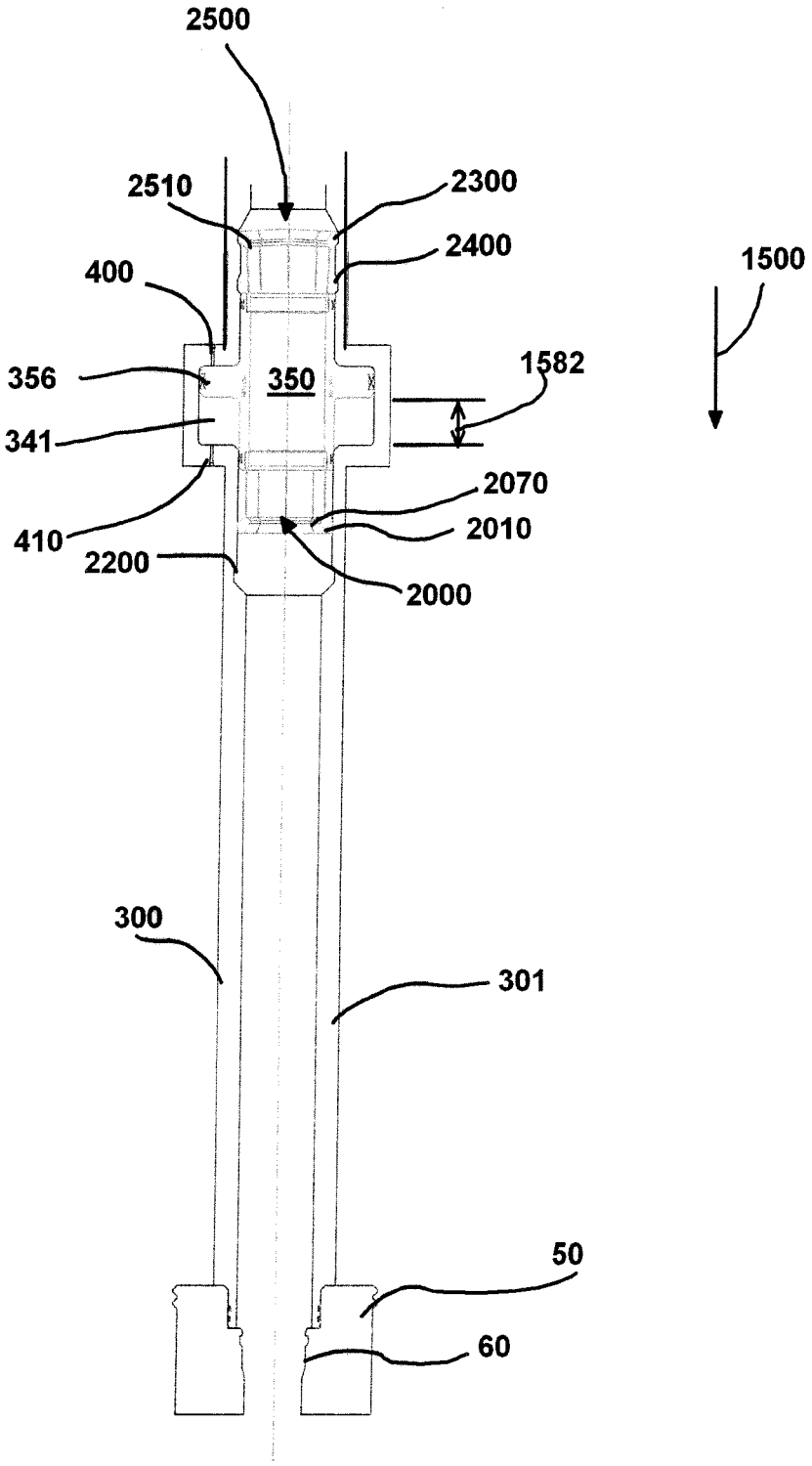
FIG. 27 is an enlarged schematic view of an alternative embodiment of a jacking system of the method and apparatus with the jacking string omitted for clarity, and with the method and apparatus in a state for jacking down a crown plug into a profile.

FIG. 27 is an enlarged schematic view of an alternative embodiment of a jacking system of the method and apparatus with the jacking string omitted for clarity, and with the method and apparatus in a state for jacking down a crown plug into a profile.

Figure 28:
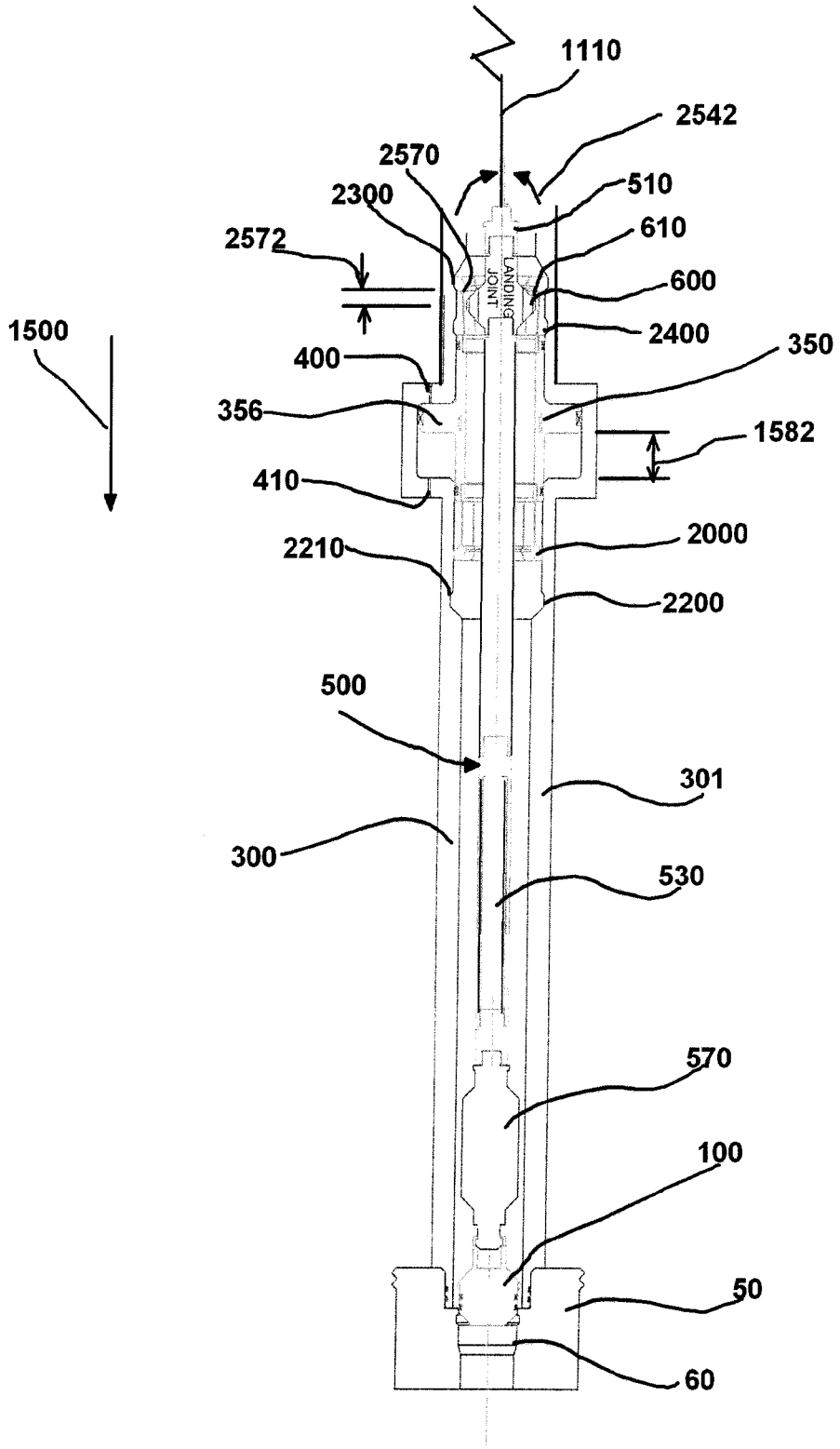
FIG. 28 is an enlarged schematic view of the jacking system of the method and apparatus of FIG. 27 now with the jacking string and crown plug which is to be inserted into a profile.

FIG. 28 is an enlarged schematic view of the jacking system of the method and apparatus of FIG. 27 now with the jacking string and crown plug which is to be inserted into a profile.

Figure 29:
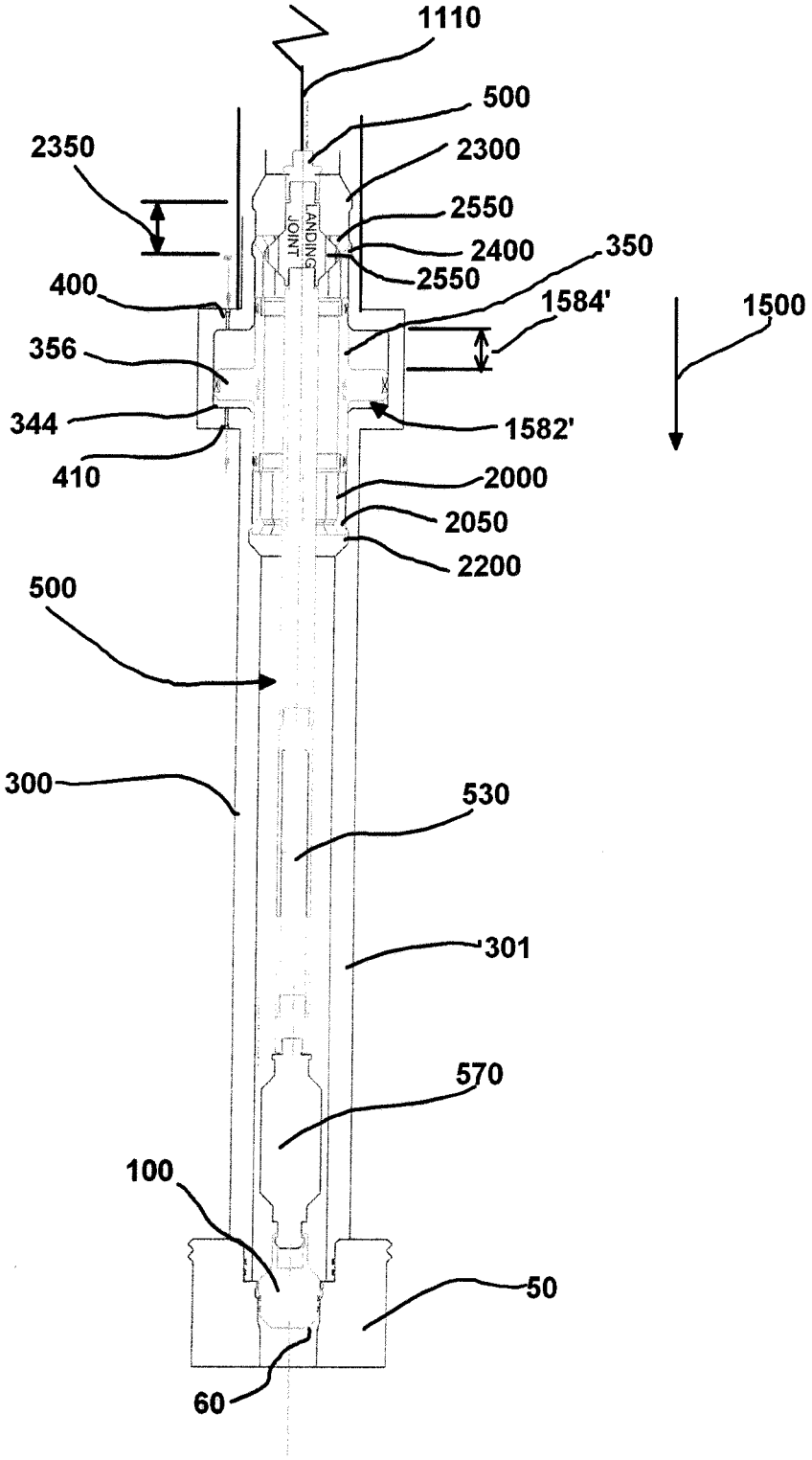
FIG. 29 is an enlarged schematic view of the jacking system of the method and apparatus of FIG. 27, wherein the jack has partially moved down causing the upper collet to collapse and form a landing surface for the landing joint of the jacking string, and then causing the jack to push down on the jacking string and crown plug.

FIG. 29 is an enlarged schematic view of the jacking system of the method and apparatus of FIG. 27, wherein the jack has partially moved down causing the upper collet to collapse and form a landing surface for the landing joint of the jacking string, and then causing the jack to push down on the jacking string and crown plug.

Figure 30:
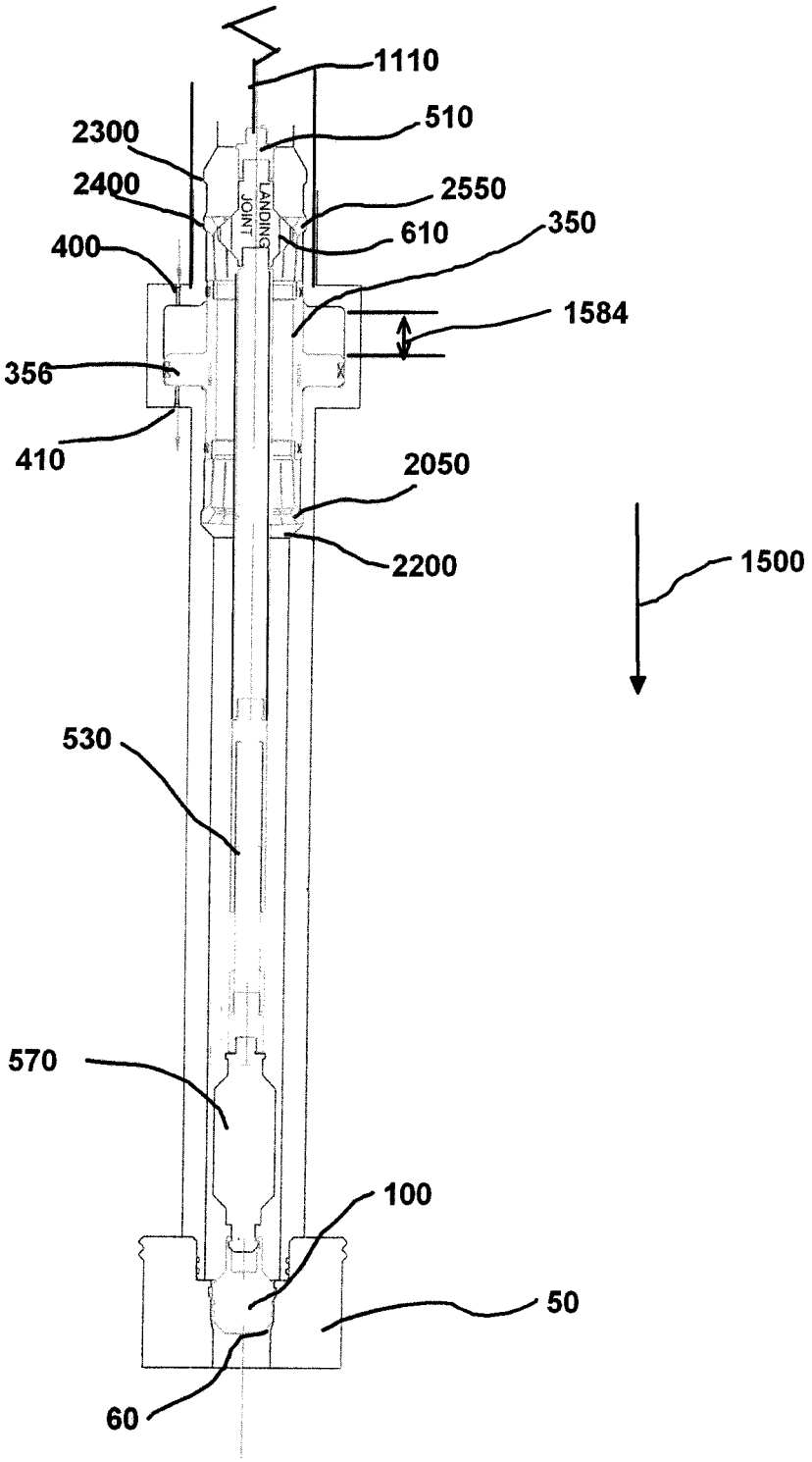
FIG. 30 is an enlarged schematic view of the jacking system of the method and apparatus of FIG. 23, showing the jacking string attached to the crown plug with the jacking piston in its lowermost position and having pushed in the crown plug into of the profile.

FIG. 30 is an enlarged schematic view of the jacking system of the method and apparatus of FIG. 23, showing the jacking string attached to the crown plug with the jacking piston in its lowermost position and having pushed in the crown plug into the profile.

Alternative Embodiment for a Jacking System Having an Expandable Landing Area with Locked and Unlocked States FIGS. 32-52 show another alternative pulling embodiment where jacking piston 350 includes a lower collet 2000 having a landing area 2080 having two states: (1) one state wherein the landing area is locked statically and cannot be expanded, and (2) a second state where the landing area can be placed in a non-locked state where the landing area can expand when a large sized object 3000 passes through. The landing area can be switched between locked and unlocked states using vertical movement of jacking piston 350 relative to a recessed area. Locked and expandable states can be controlled by vertical movement of collet 2000 relative to one or more recesses (e.g., 2200 or 2250) in apparatus 3000. Jacking piston 350 can move vertically in the same manner as described in other embodiments In the expandable or non-locked state, landing area 2080 of collet 2000 can expand to allow the passing through of a large diameter object 3000. The expandable or non-locked state can be obtained when piston 350 is in its lowermost position so that exterior portions 2060 are generally aligned with recessed area 2200. A second upper recessed area 2250 can be provided so that collet 2000 can be in an expandable or non-locked state when piston 350 is in its uppermost position (so that collet 2000 can expand to remove a restriction compared to diameter 332 when pulling crown plugs using the method described in FIGS. 23-26). In the non-locked state, preferably landing area 2080 can expand to such an extent that it no longer provides a restriction to an object moving through jacking system 300 (e.g., to the size of internal opening 332).

As shown in FIGS. 46-52, however, in the locked state, preferably collet 2000 provides a static landing shoulder 2080 (e.g., not expandable even when moving vertically) which is of a smaller size than the diameter of internal opening 332 of piston 350.

Figure 32:
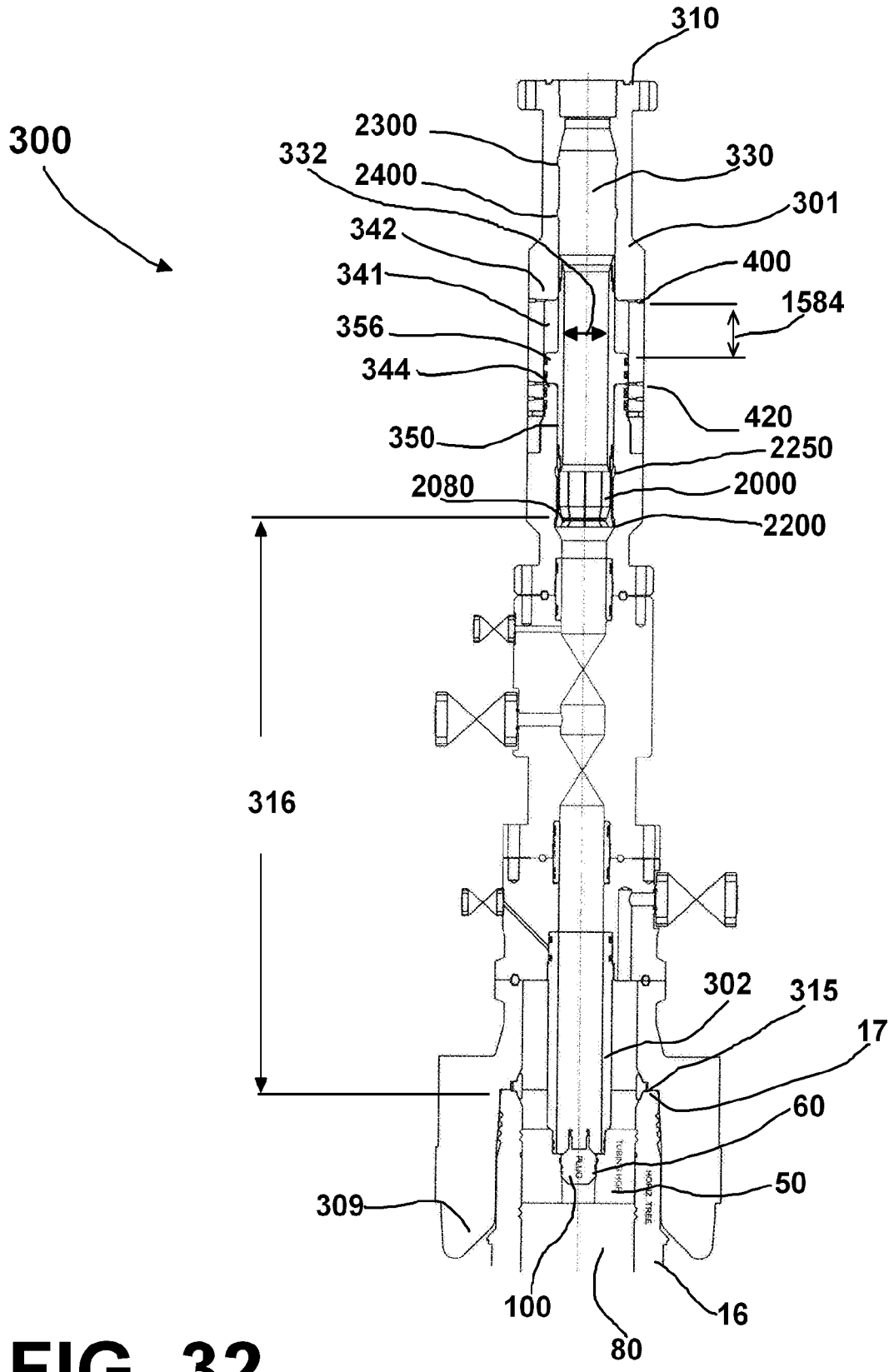
FIG. 32 is a sectional view of another alternative embodiment of a jacking system of the method and apparatus with the jacking string omitted for clarity, and with the crown plug being in a profile, wherein the crown plug is to be pulled.

FIG. 32 is a sectional view of another alternative embodiment of a jacking system 2000 of the method and apparatus 10 with the jacking string 500 omitted for clarity, and with the crown plug 100 being in a profile, wherein the crown plug 100 is to be pulled.

In this embodiment collet 2000 can have first end 2010 and second end 2020, along with a plurality of fingers 2050 with a landing area 2080 which, when in an unlocked state, can move from a neutral to an expanded state, and/or from an expanded to a neutral state. Plurality of fingers 2050 can be comprised of materials having sufficient strength and biasing characteristics.

In this embodiment the jacking system 300 can omit the static landing section 370 of the piston section 350, and include a lower collet 2000 with an expandable landing area 2080 attached to the piston section which can be expanded by a large diameter object 3000 when the enlarged section 2022 of collet 2000 is generally level with a peripheral recess area 2200. In one embodiment, when the enlarged section 2022 of collet 2000 is generally level with a peripheral recess area 2200, landing area 2080 of collet 2000 can be expanded such that the diameter of landing area 2080 can enlarge to the diameter 3050 of internal opening 332 of piston 350, and thereby avoid being a restriction to objects being passed through jacking system 300. Recessed area 2200 can include angled area 2210.

In one embodiment vertical movement of piston section 350 relative to cylinder section 340 can cause landing area 2080 of collet 2000 to move from a state of being expandable to a state of being locked from expansion, and/or from a state of being locked from expansion to a state of being expandable. Vertical movement of piston 350 (upward in the direction of arrow 1510) can cause collet 2000 to enter a locked state relative to expansion. Vertical movement of piston 350 causes vertical movement of collet 2000 causing exterior portions 2060 of plurality of fingers to contact wall 2220 and causing collet 2000 to enter a locked state. When landing area 2080 is in the locked state interior portions 2070 of plurality of fingers 2050 form a landing/pulling surface 2080 for landing shoulder 610 of landing sub 600.

Figure 33:
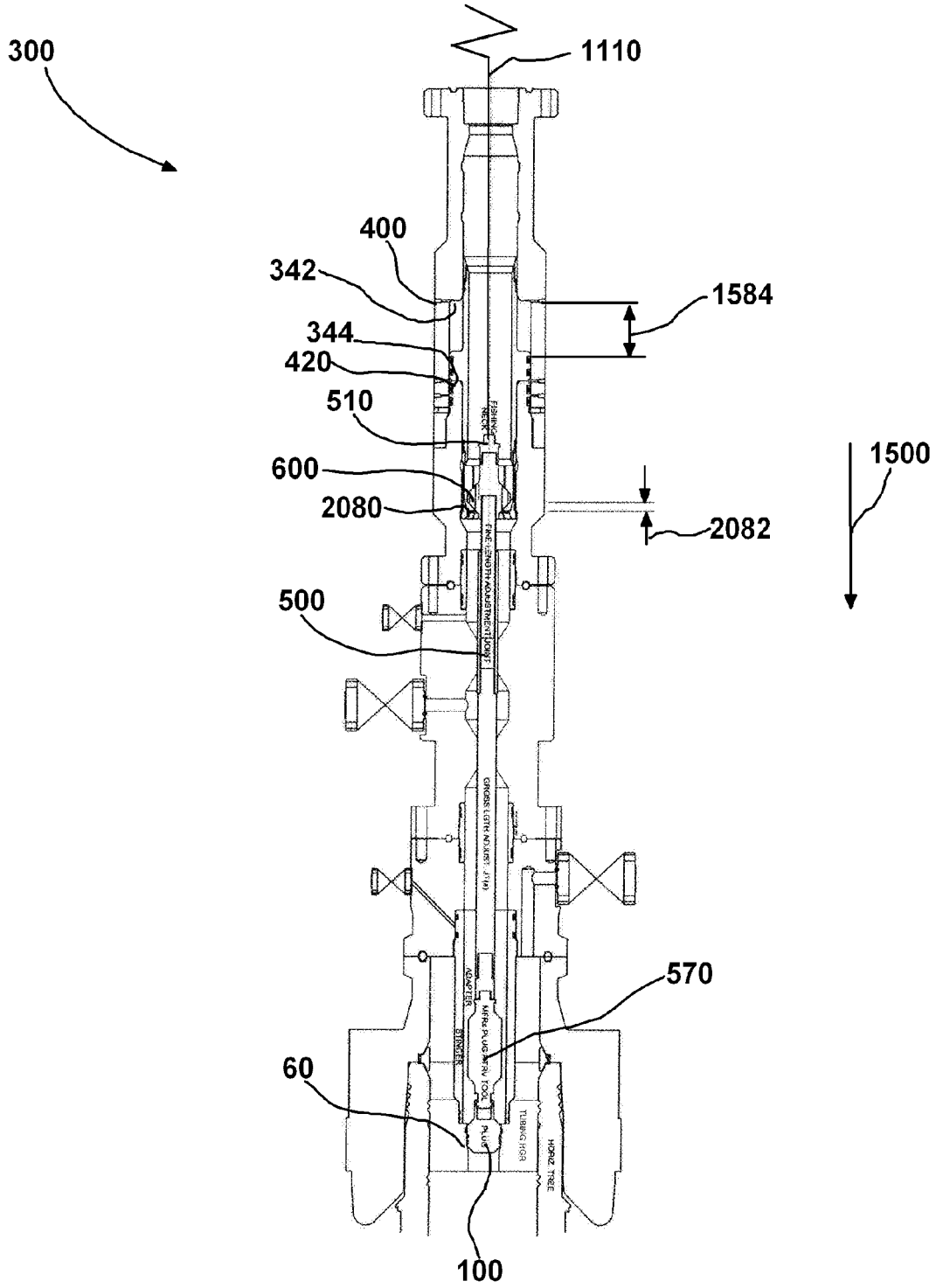
FIG. 33 is a sectional view of the jacking system of the method and apparatus of FIG. 32 now with the jacking string in its lowermost position attached to the crown plug, wherein the crown plug is to be pulled.
Figure 34:
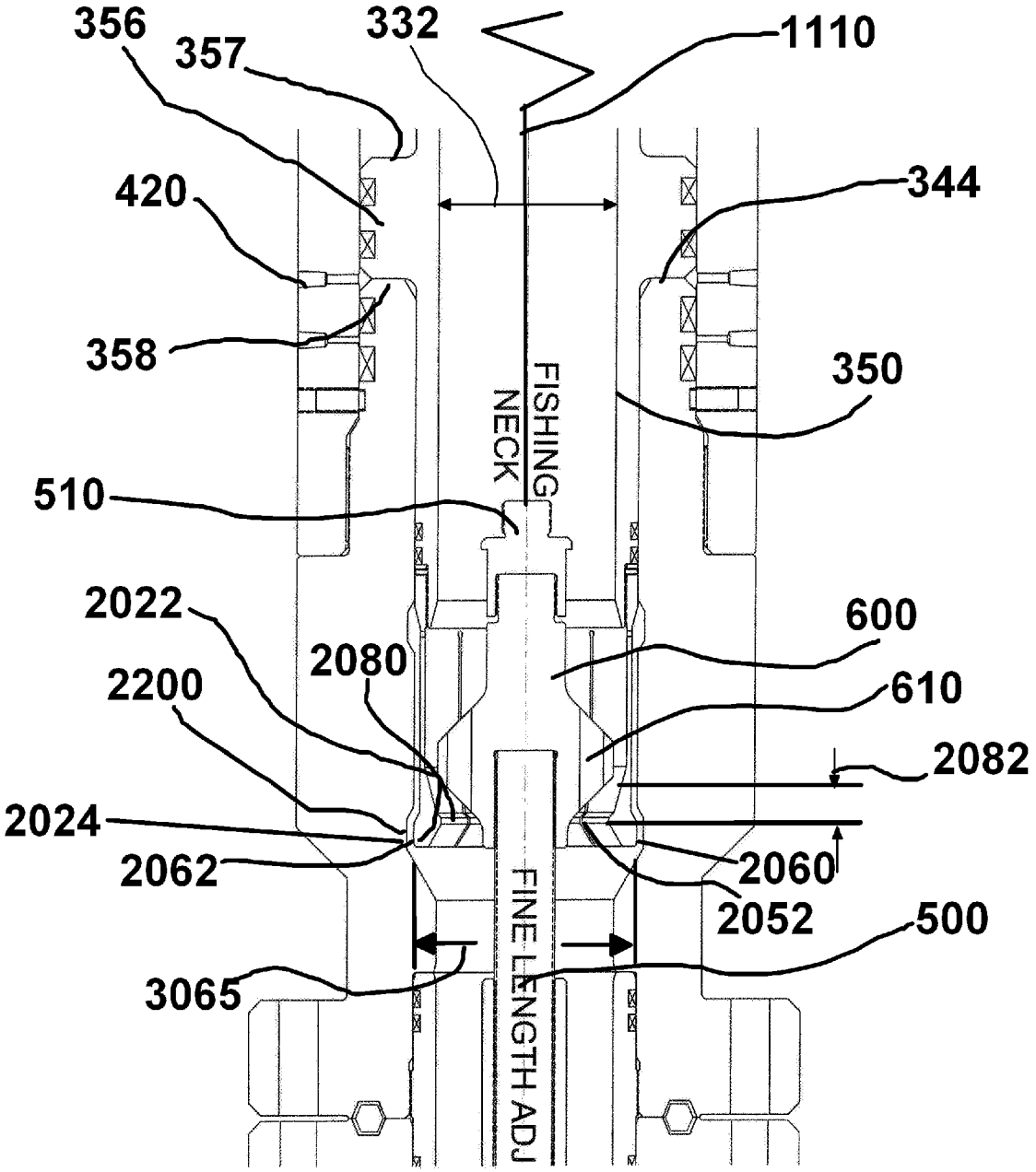
FIG. 34 is an enlarged sectional view of FIG. 33.

If desired, landing area 2080 of collet 2000 can be placed again in an expandable or non-locked state by lowering piston 350 and attached collet 2000 to its lower position (shown in FIGS. 33 and 34). In this manner landing area 2080 of collet 2000, after being put in an expandable or non-locked, allows landing area 2080 to expand to accommodate large diameter items 3000 (compared to diameter 332) being passed through jacking system 300.

However, when the enlarged section 2022 of collet 2000 is not generally level with peripheral recess area 2200, landing area 2080 is in a locked or non-expandable state, and landing area 2080 of collet 2000 is prevented from enlarging (by wall 2024 of enlarged area 2022 contacting the wall 2230 and now static landing area 2080 of piston 350 can serve as a landing shoulder for landing shoulder 610 of landing sub 600).

In an alternative embodiment jacking system 300 can include a pair of recesses 2200 and 2250. In this manner landing area 2080 of collet 2000 can enter an expanded state when enlarged area 2022 of collet 2000 is generally level with either recess 2200 or 2250. In this manner landing area 2080 of collet 2000 will be expandable when piston 350 is at its uppermost and lowermost positions so that in these extreme positions landing area 2080 of collet 2000 can expand where no restrictions are placed in the throughbore 330 with diameter 332.

FIG. 33 is a sectional view of the jacking system 300 of the method and apparatus with the jacking string 500 in its lowermost position attached to the crown plug 100, wherein the crown plug 100 is to be pulled out of profile 60. FIG. 34 is an enlarged sectional view of FIG. 33. When crown plug pulling tool 570 connects to crown plug 100, landing shoulder 610 of landing sub 600 of jacking string 500 can be spaced above (gap 1560,2082) landing area 2080, which is formed by the interior 2070 portions of plurality of fingers 2050 of collet 2000. In FIGS. 33 and 34 landing area 2080 collet 2000 is shown in the expandable state with exterior portions 2060 of enlarged area 2022 of plurality of fingers 2050 being generally level with recess 2200, In FIG. 34 exterior portions 2060 are shown as being equal to slightly smaller than the diameter of central opening 332 (indicated by dimension 3065) providing room to expand into recess 2200. In this expandable condition landing area 2080, comprising the interior portions 2070 of plurality of fingers 2050, has the ability to expand to allow items having large diameters (relative to diameter of central opening 332) to pass through central opening—exterior portions 2060 will enter recess 2200 during an expansion.

Jacking string 500 can be put together above the surface of the water and lowered by wireline 1110 as described in other embodiments. In FIG. 34 jacking string is shown when crown plug pulling tool 570 first contacts crown plug 100. At this point of first contact between tool 570 and crown plug 100, landing shoulder 610 of landing sub 600 of jacking string 500 can be spaced above the landing area 2080 formed by interior 2070 portions of plurality of fingers 2050 of collet 2000 (forming gap 1560 or 2082).

After first contact between crown plug pulling tool 570 first and crown plug 100, piston 350 can be caused to be moved vertically upward in the direction of arrow 1510 as described in other embodiments. As piston 350 moves in the direction of arrow 1510, landing area 2080 of collet 2000 also moves in this direction causing exterior portions 2060 of plurality of fingers move above recessed area 2200, causing landing area 2080 to enter a locked or non-expandable state, and causing landing area 2080 to move towards landing shoulder 610 thereby shrinking the gap 1560 or 2082. In a locked or non-expandable landing area 2080 is formed by interior portions 2070 of plurality of fingers 2050, which will act as a static receiving surface for landing shoulder 610 of landing sub 600. In the locked state walls 2062 of exterior portions 2060 of plurality of fingers 2050 are blocked from expanding by wall 2100 of jacking string 300.

Figure 35:
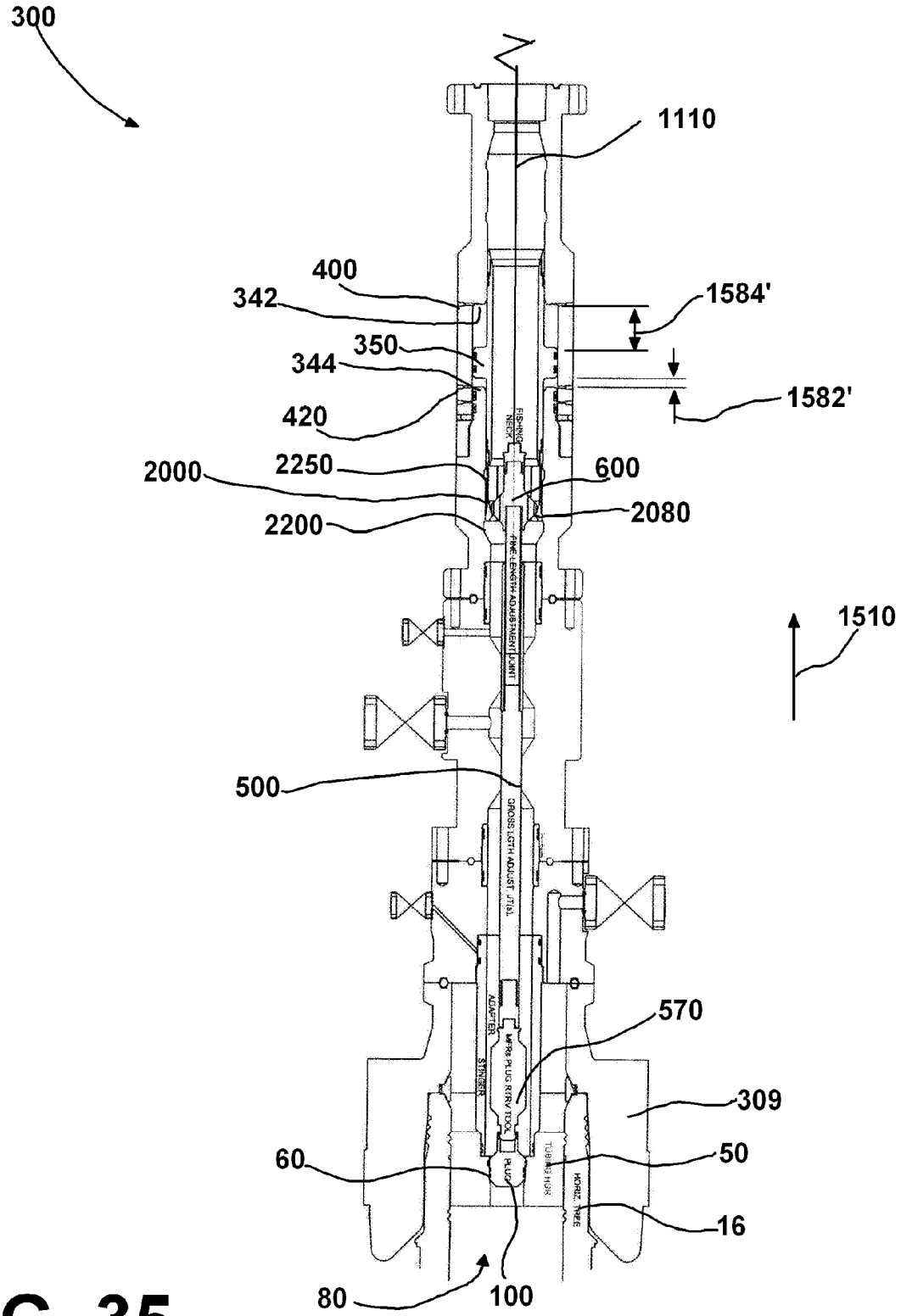
FIG. 35 is a sectional view of the jacking system of the method and apparatus of FIG. 32, wherein the jack has partially moved up causing the landing surface of the collet to first contact the landing joint of the jacking string.
Figure 36:
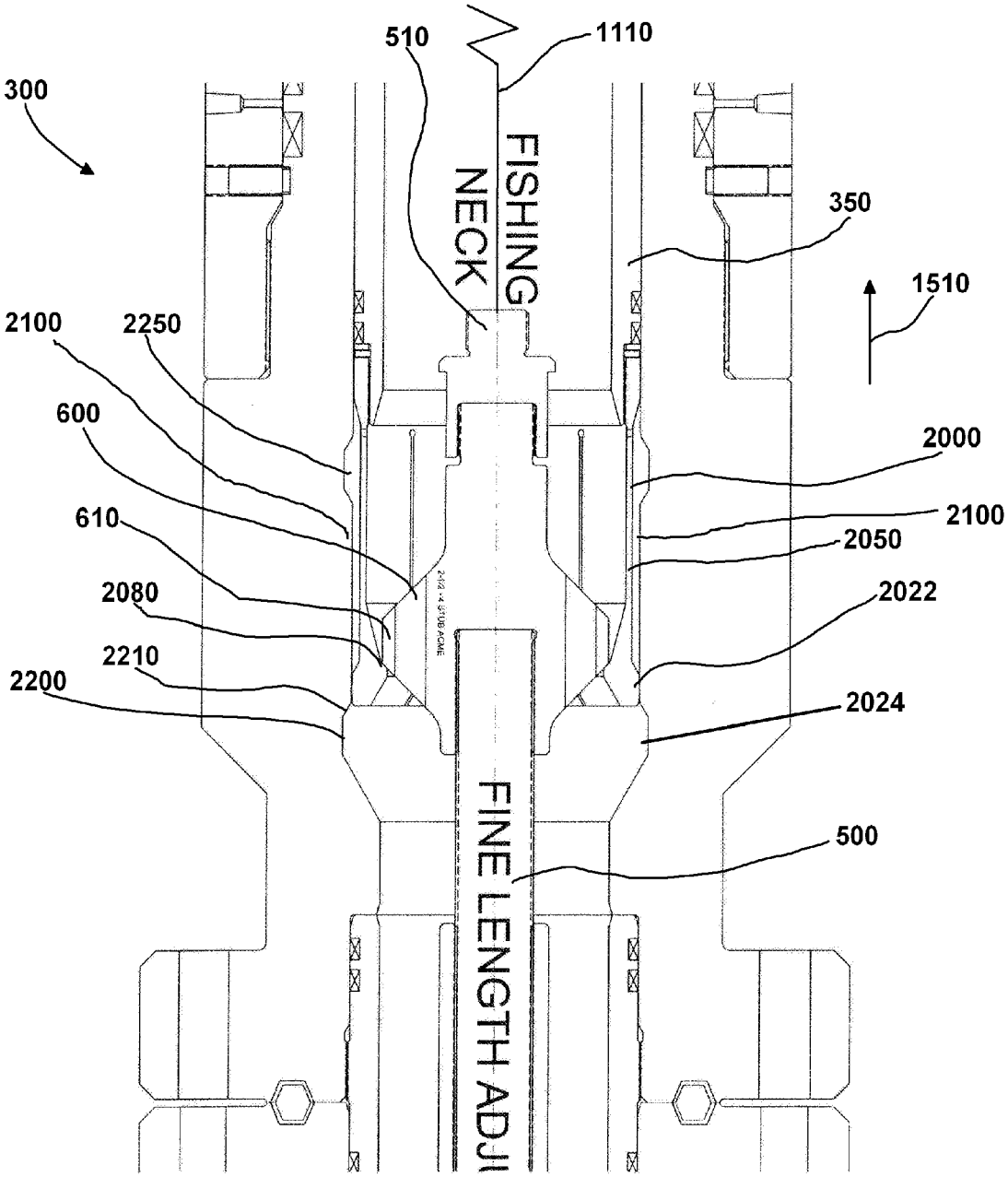
FIG. 36 is an enlarged sectional view of FIG. 35.

FIG. 35 is a sectional view of the jacking system 300 of the method and apparatus of FIG. 32, wherein the jack 300 has partially moved up (arrow 1510) causing area 2080 of collet 2000 to enter a locked or non-expandable state, forming a landing/pulling surface 2080 for the landing joint 600 of jacking string 500, and causing the landing surface 2080 of the collet 2000 to first contact the landing joint 600 of the jacking string 500. FIG. 36 is an enlarged schematic view of the jacking system 300, wherein the piston 350 has partially moved up (arrow 1510) causing collet 2000 to enter a locked or non-expandable state (by walls 2062 touching wall 2100) and forming a landing surface 2080 for the landing joint 600 of jacking string 500. When the landing surface formed by collet 2000 is in a locked state, landing surface 2080 contacts the landing shoulder 610 of landing sub and imports an upward force (in the direction of arrow 1510) from piston 350 to landing sub 600 which is transmitted to the crown plug 100.

Figure 37:
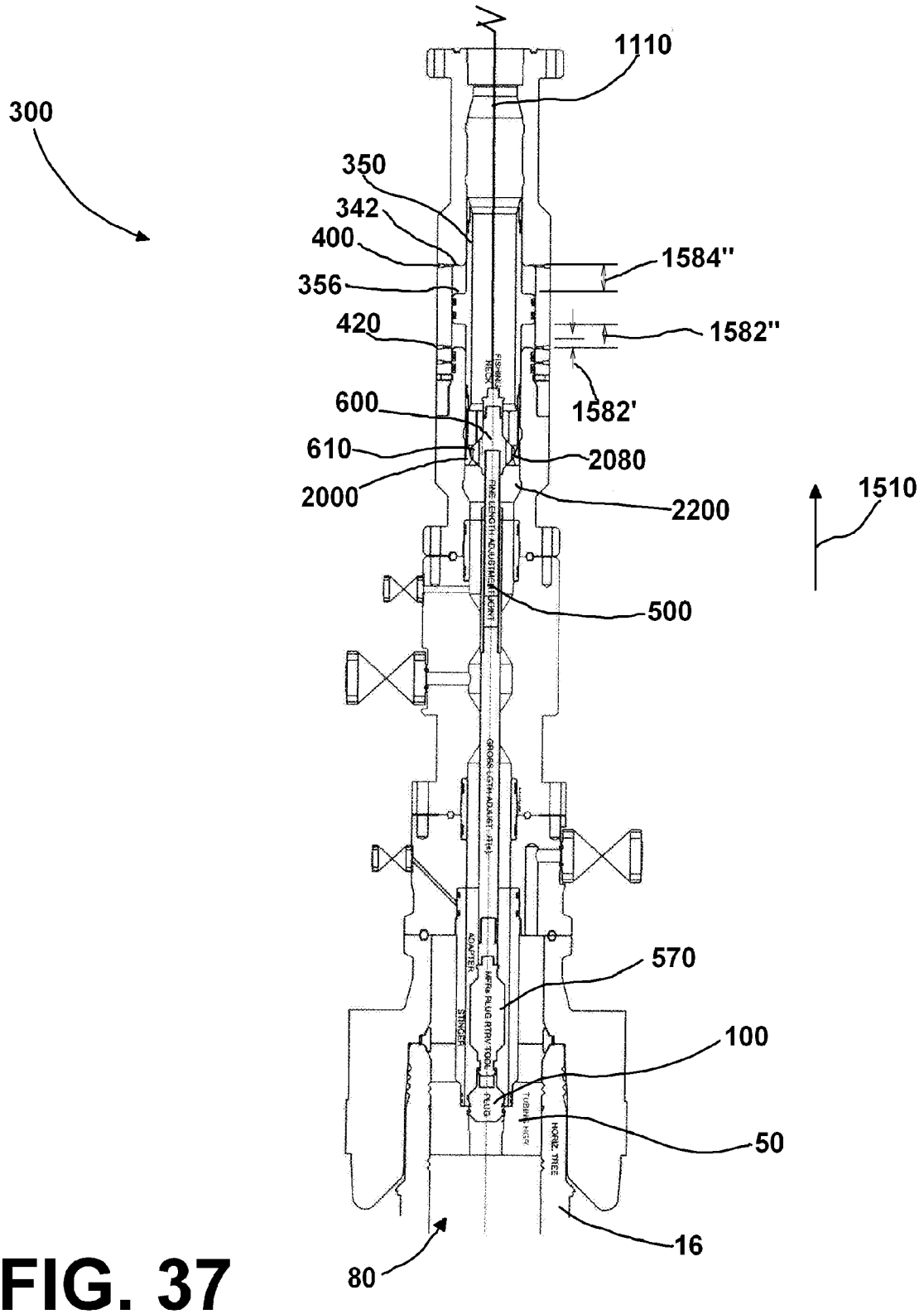
FIG. 37 is a sectional view of the jacking system of the method and apparatus of FIG. 32, showing the jacking string attached to the crown plug with the jacking piston midway in an upper stroke and having dislodged the crown plug out of the profile.
Figure 38:
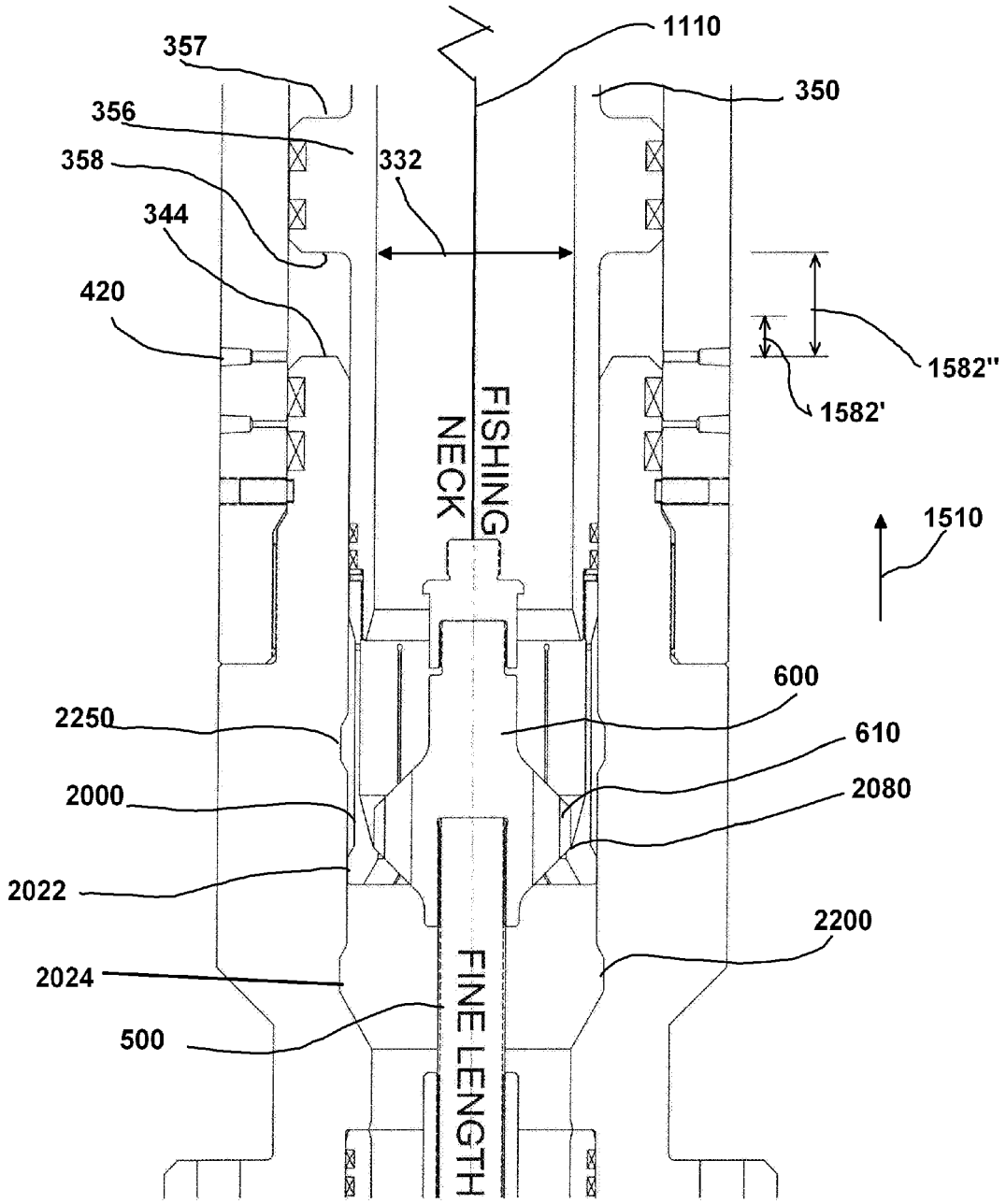
FIG. 38 is an enlarged sectional view of FIG. 37.

In FIG. 35 dimension 1582' schematically indicates the amount of upward movement of piston 350 and landing area 2080 before contact of landing area 2080 with landing area 610. Dimension 1584' schematically indicates the remaining available amount of upward movement of piston 350 (and upward movement of landing area 2080). FIG. 37 is a sectional view of the jacking system 300 of the method and apparatus of FIG. 32, showing the jacking string 500 attached to the crown plug 100 with the jacking piston 350 midway in an upper stroke (arrow 1510) and having dislodged the crown plug 100 out of the profile 60. FIG. 38 is an enlarged sectional view of FIG. 37. These figures show jacking string 500 with piston 350 and attached collet 2000 which has now lifted jacking string 500 (and attached crown plug 100) such that piston 350 is in its midpoint position (moving up a height 1582") and having pulled the crown plug 100 out of the profile 60. Now, as described with other embodiments wireline 1110 can be used to lift jacking string 500 and attached crown plug 100 up to the surface (or alternatively piston can continue to be moved upwardly in the direction of arrow 1510).

In FIGS. 37 and 38 dimension 1582" schematically indicates the total amount of upward movement of piston 350 and landing area 2080 (compared to the position shown in FIG. 34). Because landing area 2080 is locked at contact, dimension 1582" minus dimension 1582' provides the amount of lift of landing sub 600 (since first contact between landing area 2080 and landing area 610 shown in FIGS. 35 and 36). Dimension 1584" schematically indicates the remaining available amount of upward movement of piston 350 (and upward movement of landing area 2080). Now the crown plug 100 has been lifted completely out of the profile 60.

Figure 39:
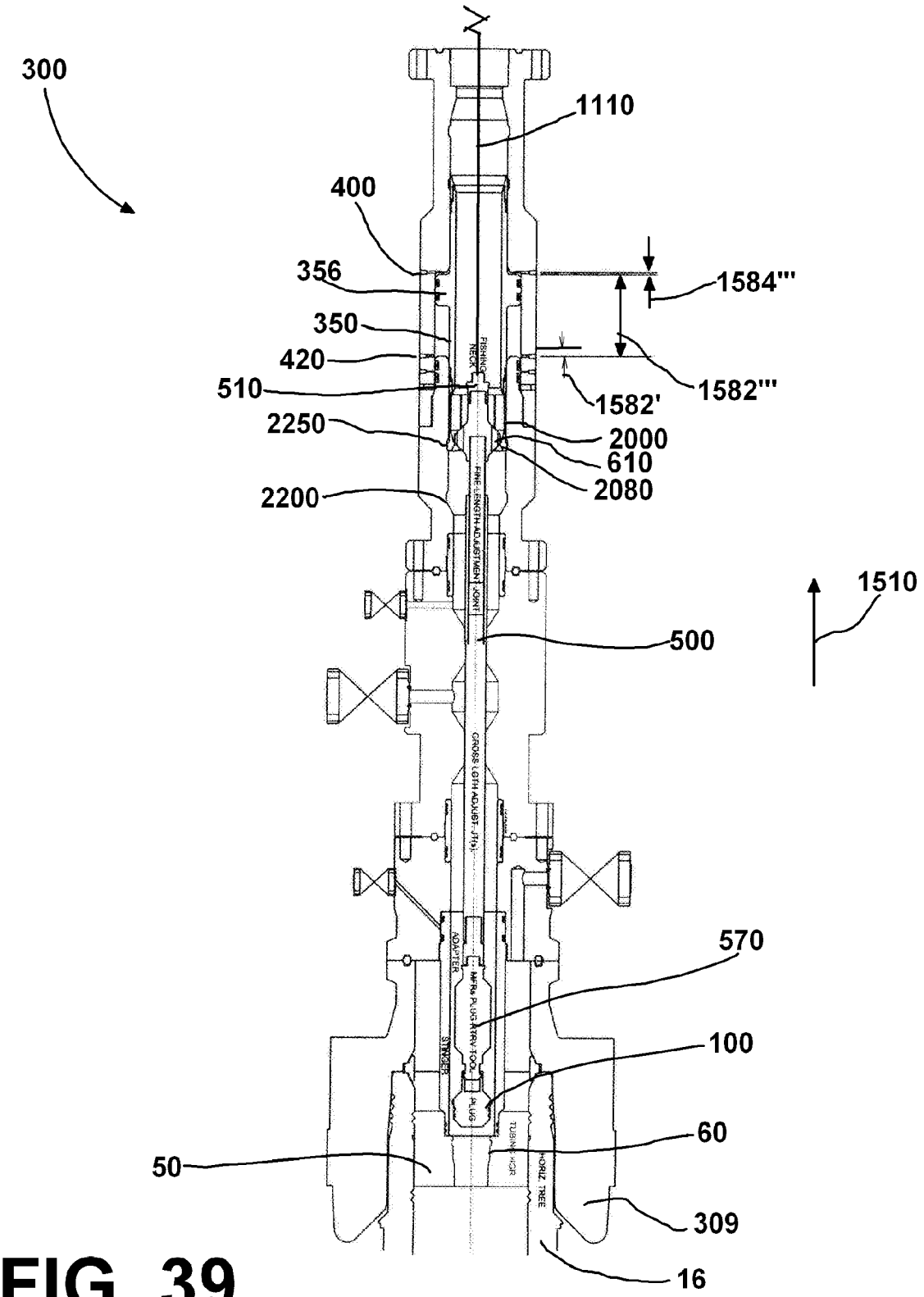
FIG. 39 is a sectional view of the jacking system of the method and apparatus of FIG. 32, showing the jacking string attached to the crown plug with the jacking piston high enough in its upper stroke causing the enlarged area of the collet to be at a vertical level with the upper peripheral groove of the jack thereby allowing the collet to expand based on a force pushing outward on the plurality of fingers of the collet, and having moved the crown plug above the profile.
Figure 40:
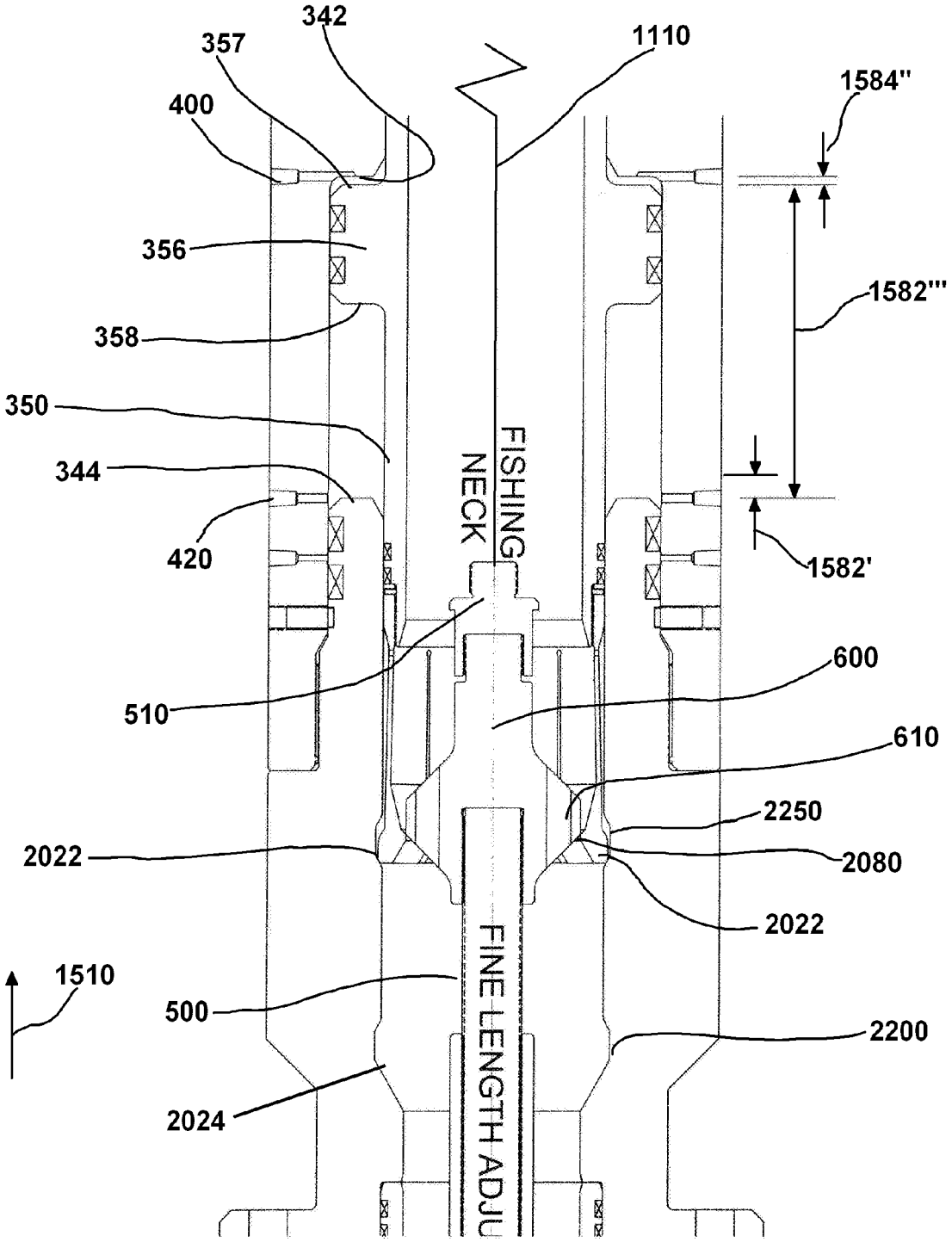
FIG. 40 is an enlarged sectional view of FIG. 39.

FIG. 39 is a sectional view of the jacking system 300 of the method and apparatus of FIG. 32, showing the jacking string 500 attached to the crown plug 100 with the jacking piston 350 having moved high enough in its upper stroke that landing shoulder 2080 has entered an unlocked or expandable state—where enlarged area 2022 of collet 2000 becomes generally level with upper peripheral groove 2250 of the jack 300 (thereby again allowing landing area 2080 of collet 2000 to expand based on a force pushing outward on the plurality of fingers 2050 of the collet 2000). FIG. 40 is an enlarged sectional view of FIG. 39.

In FIGS. 39 and 40 dimension 1582'" schematically indicates the total amount of upward movement of piston 350 and landing area 2080 (compared to the position shown in FIG. 34). Because landing area 2080 is locked at contact, dimension 1582'" minus dimension 1582' provides the total amount of lift of landing sub 600 (since first contact between landing area 2080 and landing area 610 shown in FIGS. 35 and 36). Dimension 1584'" schematically indicates the remaining available amount of upward movement of piston 350 (and upward movement of landing area 2080). Now, as described with other embodiments wireline 1110 can be used to lift jacking string 500 and attached crown plug 100 up to the surface.

In FIGS. 39 and 40, landing shoulder 2080 is transitioning from a locked to an unlocked state and enlarged area 2022 becomes generally level with upper recess 2250 (e.g., landing shoulder 2080 might be partially expandable into recess 2250). In various embodiments upper recess 2250 can be omitted to keep landing shoulder 2080 in a locked state at the end of upward vertical movement of piston 350 (requiring piston 350 to be moved down in the direction opposite of arrow 1510 until enlarged area 2022 becomes generally level with recess 2200 before landing shoulder 2080 of collet 2000 again enters an unlocked or expandable state).

Figure 41:
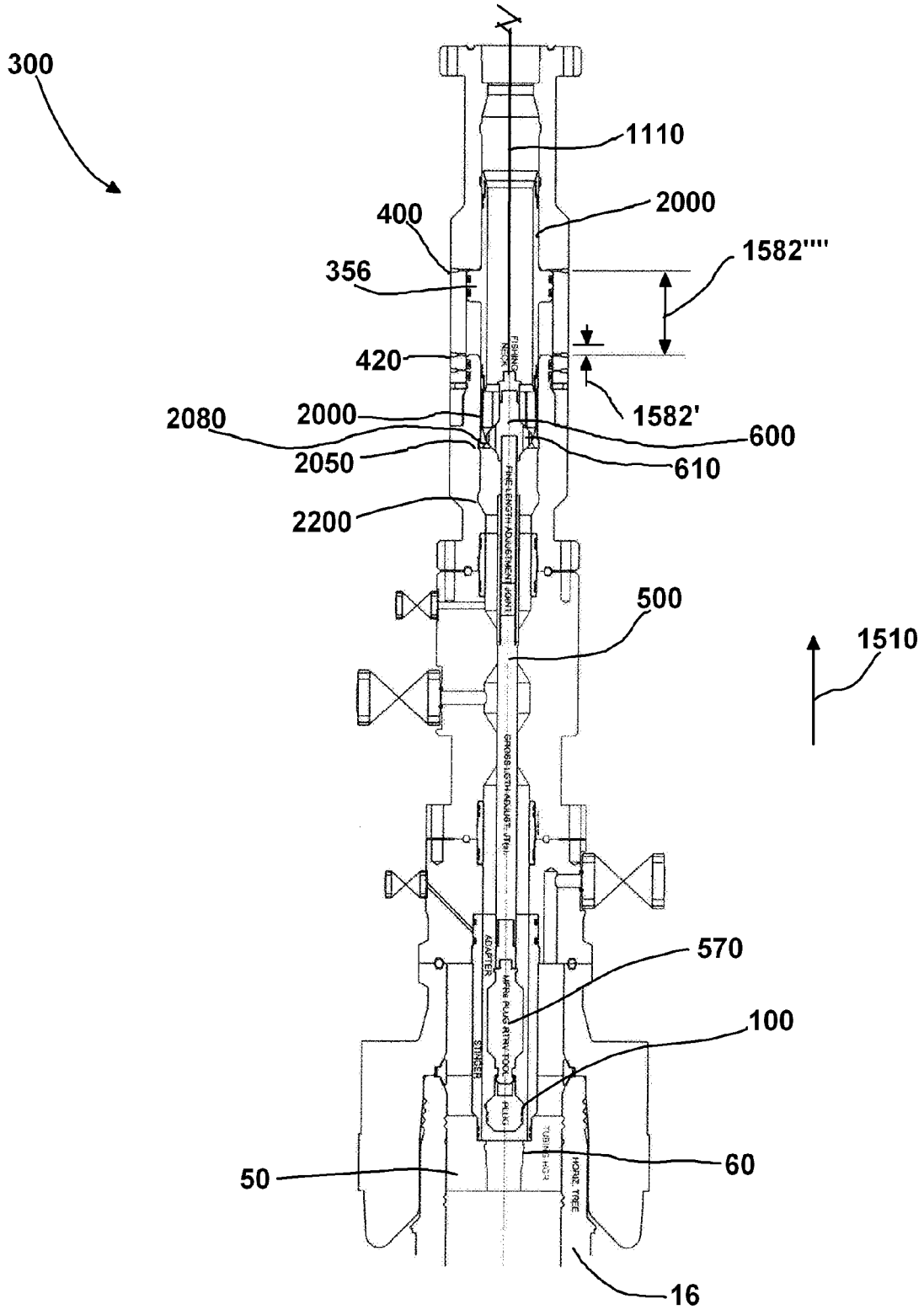
FIG. 41 is a sectional view of the jacking system of the method and apparatus of FIG. 32, showing the jacking string attached to the crown plug with the jacking piston in its highest its upper stroke causing the enlarged area of the collet to be at a vertical level with the upper peripheral groove of the jack thereby allowing the collet to expand based on a force pushing outward on the plurality of fingers of the collet, and having moved the crown plug above the profile.
Figure 42:
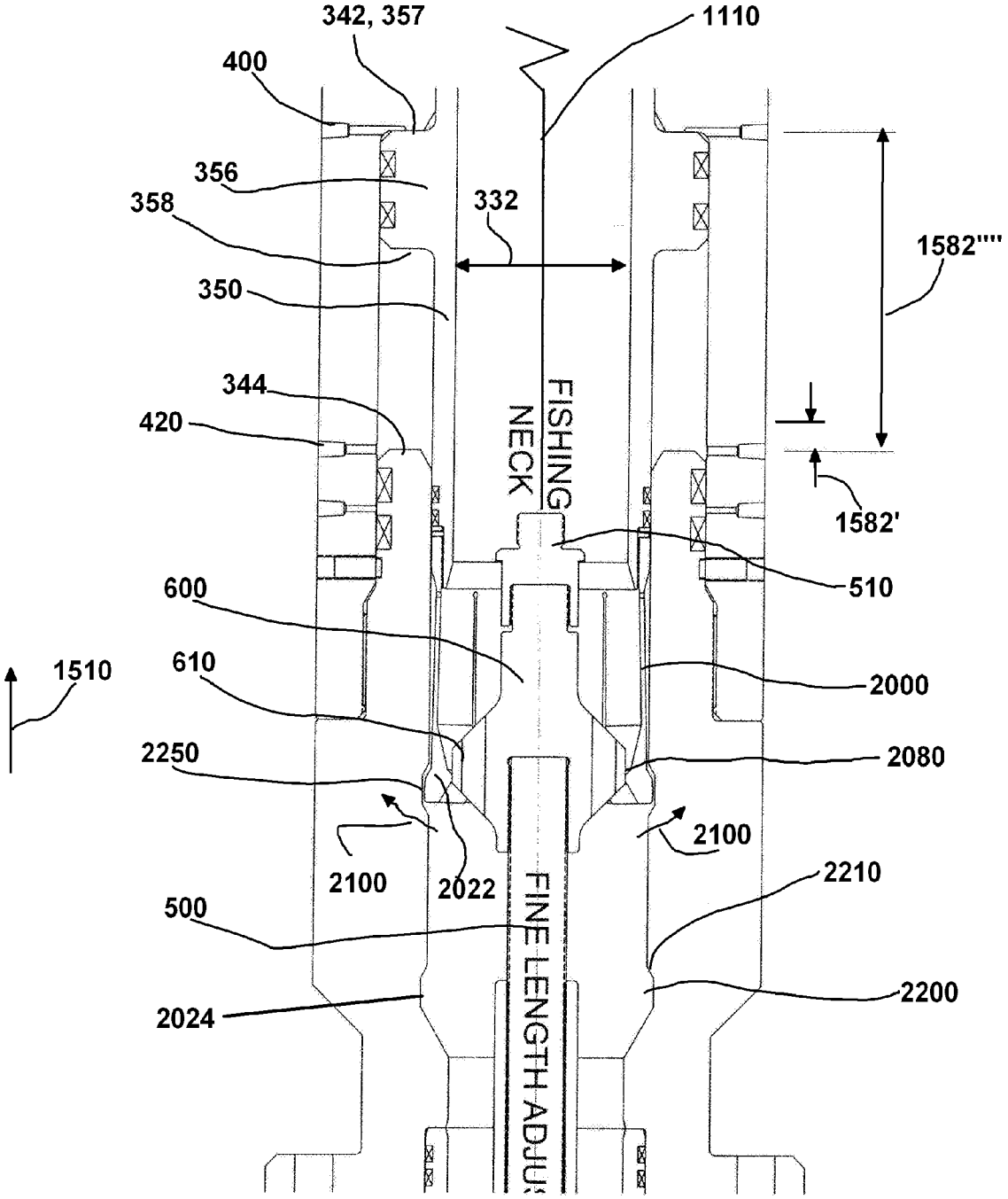
FIG. 42 is an enlarged sectional view of FIG. 41.

FIG. 41 is a sectional view of the jacking system 300 of the method and apparatus of FIG. 32, now showing jacking string 500 attached to the crown plug 100 with the jacking piston 350 in its highest position—at its upper stroke causing the enlarged area 2022 of the collet 2000 to be generally at a vertical level with the upper peripheral groove 2250 of the jack 300, and thereby allowing landing area 2080 of collet 2000 to fully expand based on a force pushing outward on the plurality of fingers 2050 of the collet 2000. FIG. 42 is an enlarged sectional view of FIG. 40. It is noted that the complete upward movement (in the direction of arrow 1510) of piston 350 placed landing area 2080 of collet 2000 in an expandable state when plurality of fingers 2050 are generally level with recessed area 2250, and collet 2000, after being put in an expandable state, will be able to expand to remove restrictions compared to diameter 332. In FIG. 42, the weight of jacking string 500 is shown as tending to expand somewhat landing area 2080 of collet 2000 (schematically shown by arrows 2100).

It is also noted that when piston 350 is in its lowermost piston landing area 2080 of collet 2000 (via recess 2200) is in an unlocked or expandable state so that it will be able to expand to remove restrictions compared to diameter 332. Because it is desired to avoid restrictions, when not pulling a plug 100, it is preferred that the default position of piston 350 be its lowermost (or upper most position when an upper recess 2250 is used in addition to lower recess 2200) to allow landing area 2080 of collet 2000 to be in an unlocked or expandable state to allow large diameter objects to pass through by expanding this unlocked/expandable landing area 2080 of collet 2000.

Figure 43:
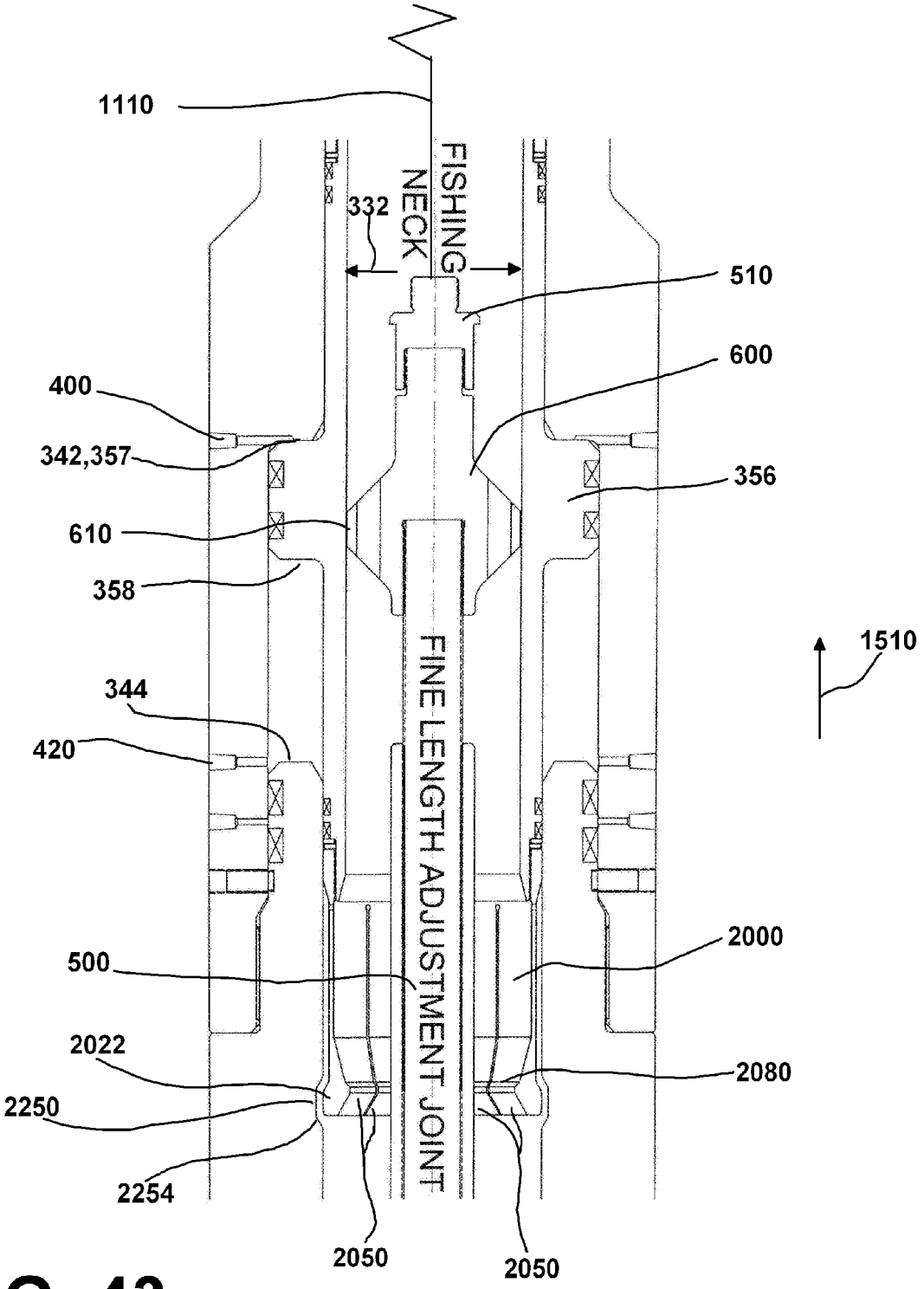
FIG. 43 is an enlarged sectional view of the jacking system of the method and apparatus of FIG. 32, showing the jacking string being raised above the landing surface of the collet after having pulled the crown plug out of the profile.

The jacking string 500 with connected crown plug 100 can now be removed to the surface. FIG. 43 is an enlarged sectional view of the jacking system 300 of the method and apparatus, showing the jacking string 500 being raised above the landing surface 2080 of collet 2000 after having pulled the crown plug 100 out of the profile 60.

Figure 44:
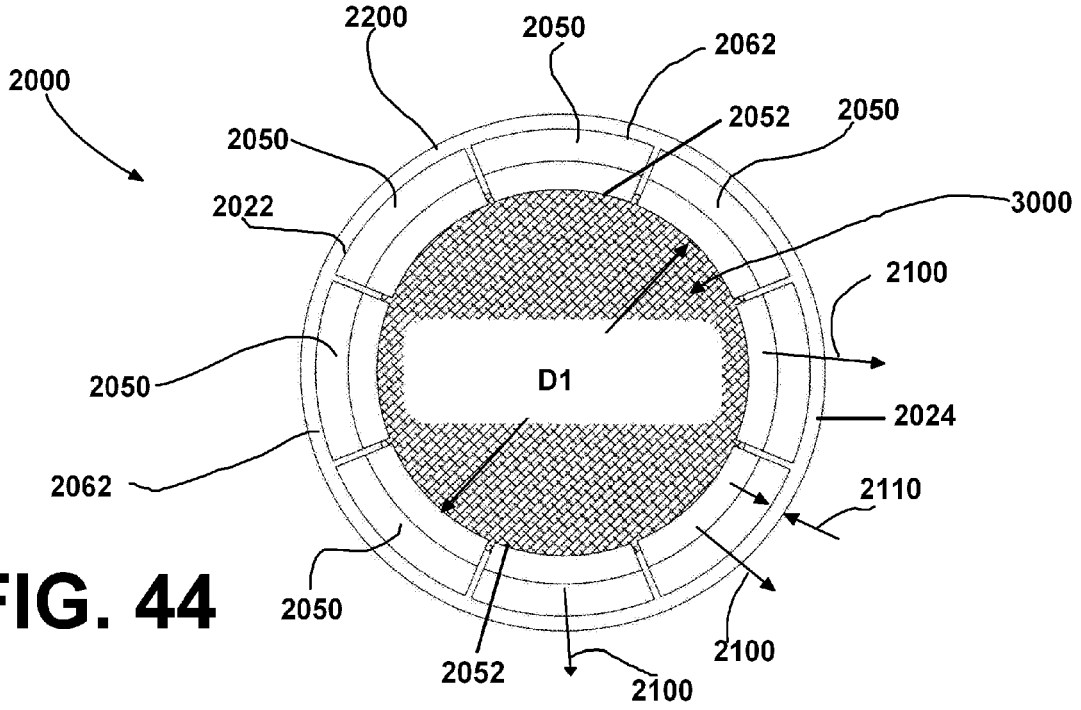
FIGS. 44 and 45 respectively show the normal and expanded conditions of the collet.
Figure 45:
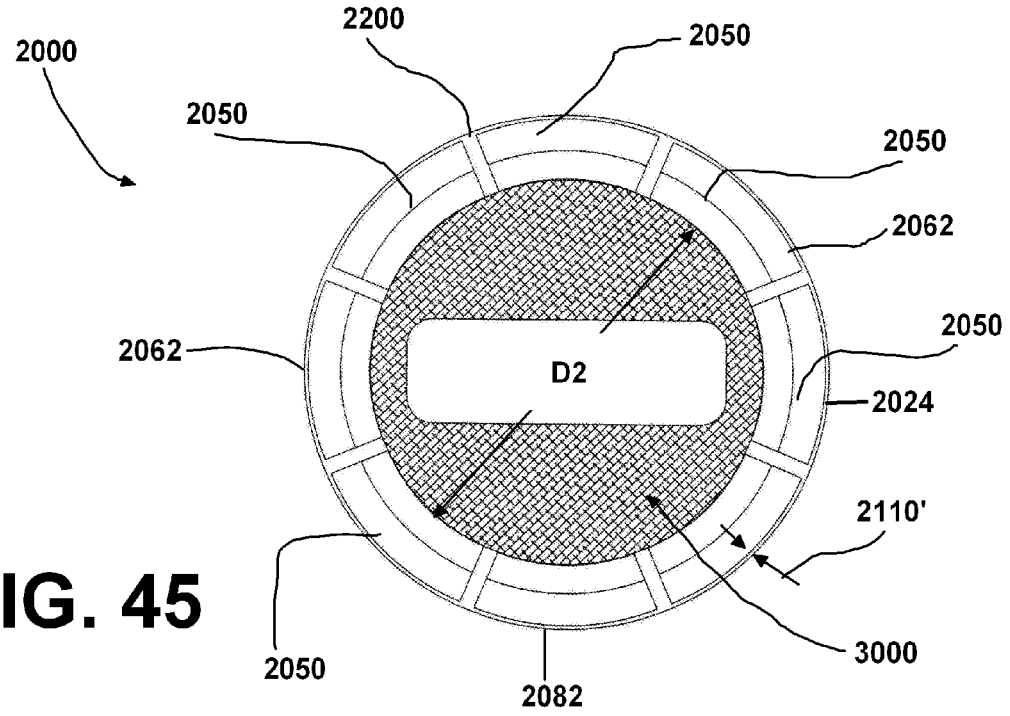

Collet being Generally Level with Recess Allows Large Sized Object to Pass Thru Via Expansion FIGS. 44 and 45 respectively show the non-expanded and expanded conditions of the collet 2000 when the enlarged area 2022 of collet 2000 is generally level with a recess (e.g., 2200, 2250).

In FIG. 44 collet 2000 includes a plurality of fingers 2050 each finger having an interior face 2052, and interior portion 2070. In FIG. 44 the interior face 2052 of each of the plurality of fingers 2050 together form a circle of diameter D1; and the exterior wall 2062 portion of each of the plurality of fingers 2050 together form a gap 2110 with the outer wall of recess 2200.

As a large size object passes through collet 2000 the plurality of fingers 2050 will expand outwards (schematically indicated by arrow 2100) in recess 2200 so that a circle of larger diameter D2 (where D2 is larger than D1) to allow the landing area 2080 of collet 2000 to expand and accommodate this object 3000 passing thru the plurality of fingers 2050.

FIG. 45 shows that the plurality of fingers 2050 have expanded into recess 2200 to form a circle of larger diameter D2, with gap 2100 between enlarged area 2082 and recess 2200 becoming smaller (to gap 2110'). In this manner the plurality of fingers 2050 act as an elastic spring, elastically expanding to allow a large diameter object 3000 to pass through, and after passing through elastically retracting to their original position (with diameter D1).

FIGS. 46 through 49 schematically illustrate the steps where landing area 2080 of collet 2000 elastically expands to allow a large sized object 3000 traveling downwardly through collet 2000 to pass through and then landing area 2080 elastically contracts to its original position after the object 3000 passes through.

Figure 46:
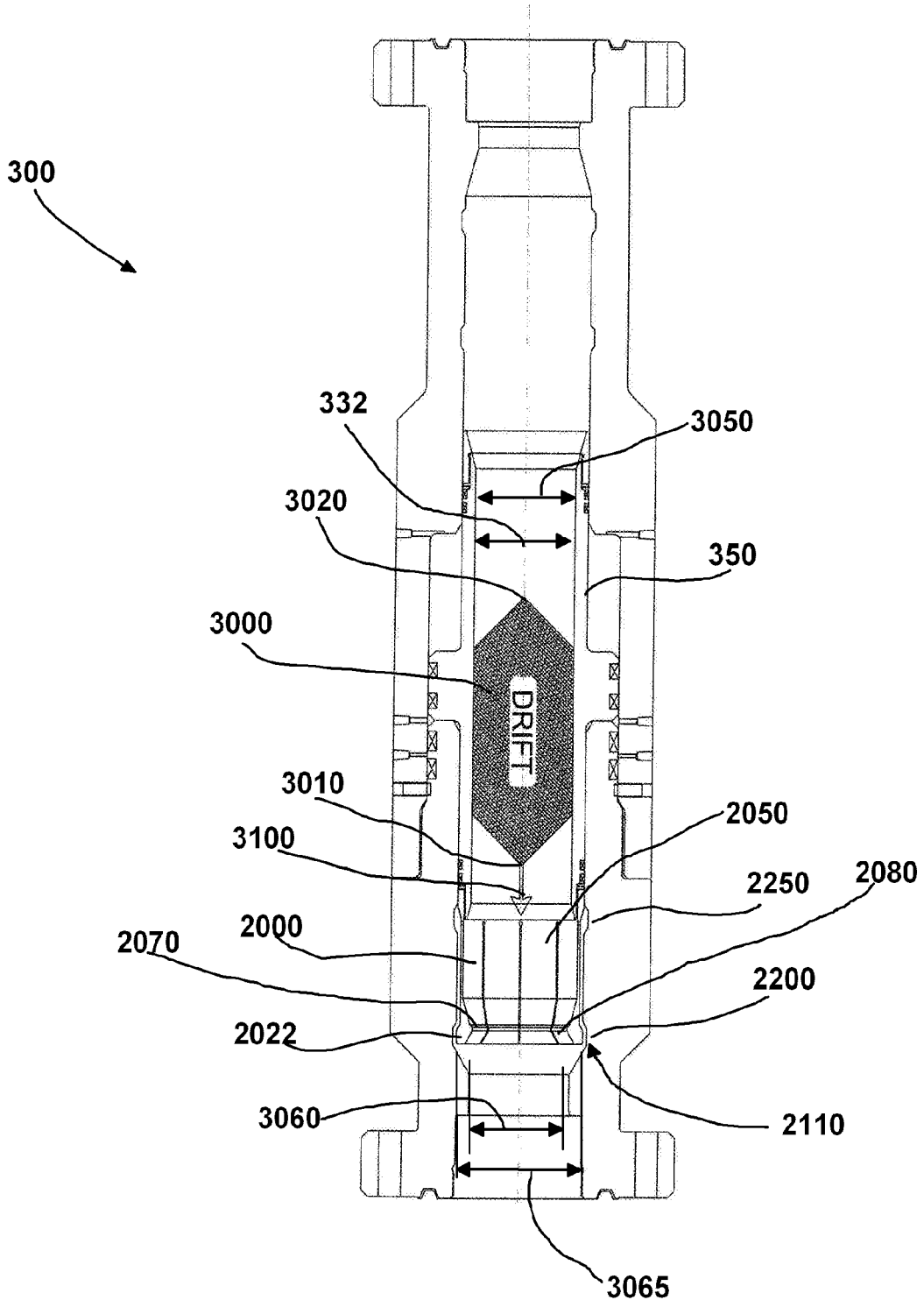
FIG. 46 shows a large diameter tool approaching from above the bottom portion of the collet by the landing area.

FIG. 46 shows a large diameter tool 3000 approaching from above the bottom portion of the collet 2000 and located near landing area 2080 (arrow 3100 schematically indicates downward movement of tool 3000). The non-expanded state of landing area 2080 is shown by dimension 3060 (which is schematically shown in FIG. 44 as D1). Dimension 3065 schematically indicates the diameter to the outside walls 2024 of the enlarged area 2022 of the plurality of fingers 2050.

Figure 47:
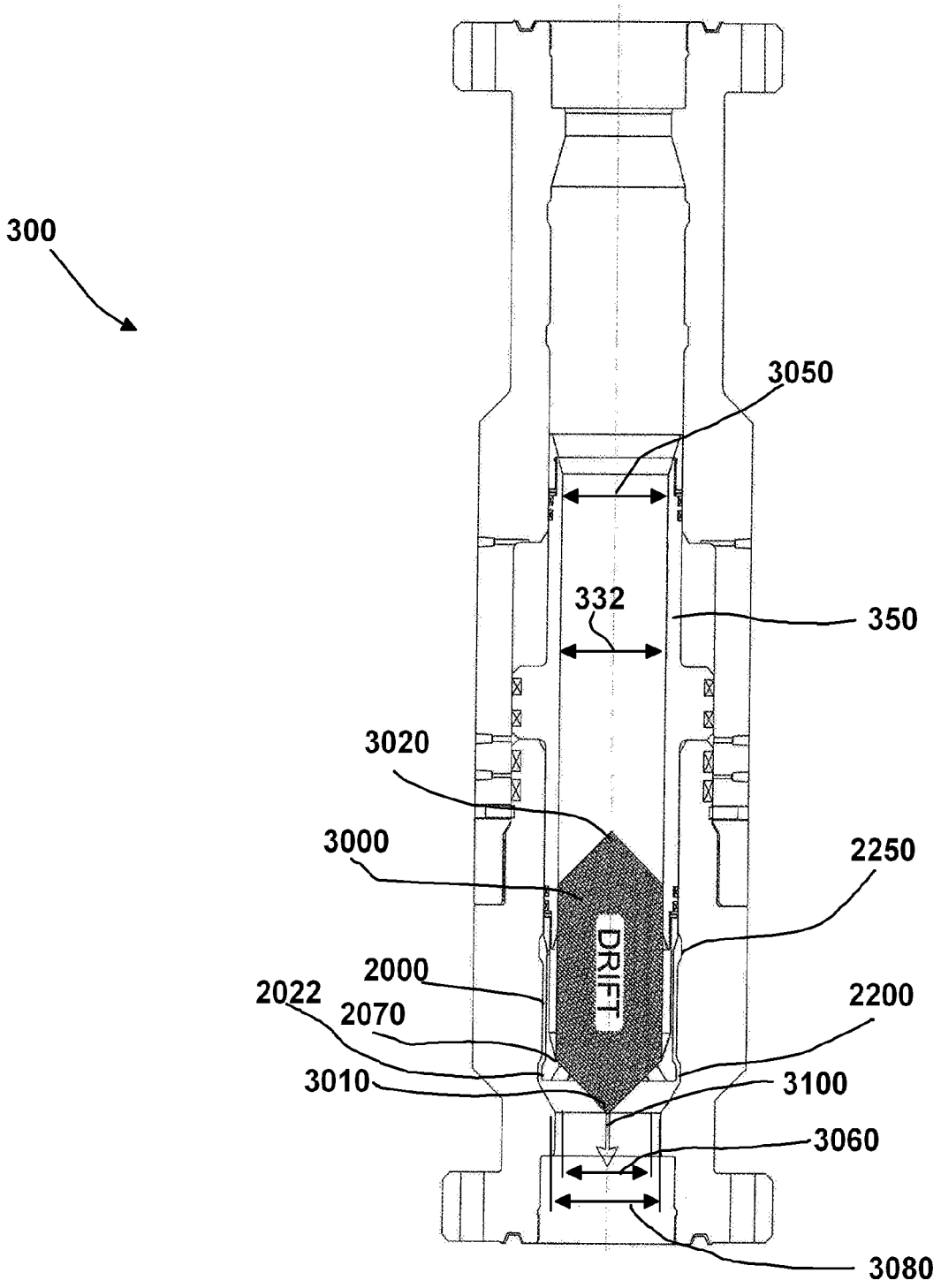
FIG. 47 shows the large diameter tool of FIG. 46 first touching the angled area of the collet.

FIG. 47 shows the large diameter tool 3000 first touching the angled area 2070 of the collet 2000. Because this figure shows first touch, landing area 2082 of collet 2000 will be in the non-expanded diameter (dimension 3060 which is schematically shown in FIG. 44 as D1). The maximum expansion of collet 2000 is shown by dimension 3080 and is where the base 2024 of the plurality of fingers 2050 contact the recessed area 2200 (which contact prevents further expansion of the plurality of fingers 2050).

Figure 48:
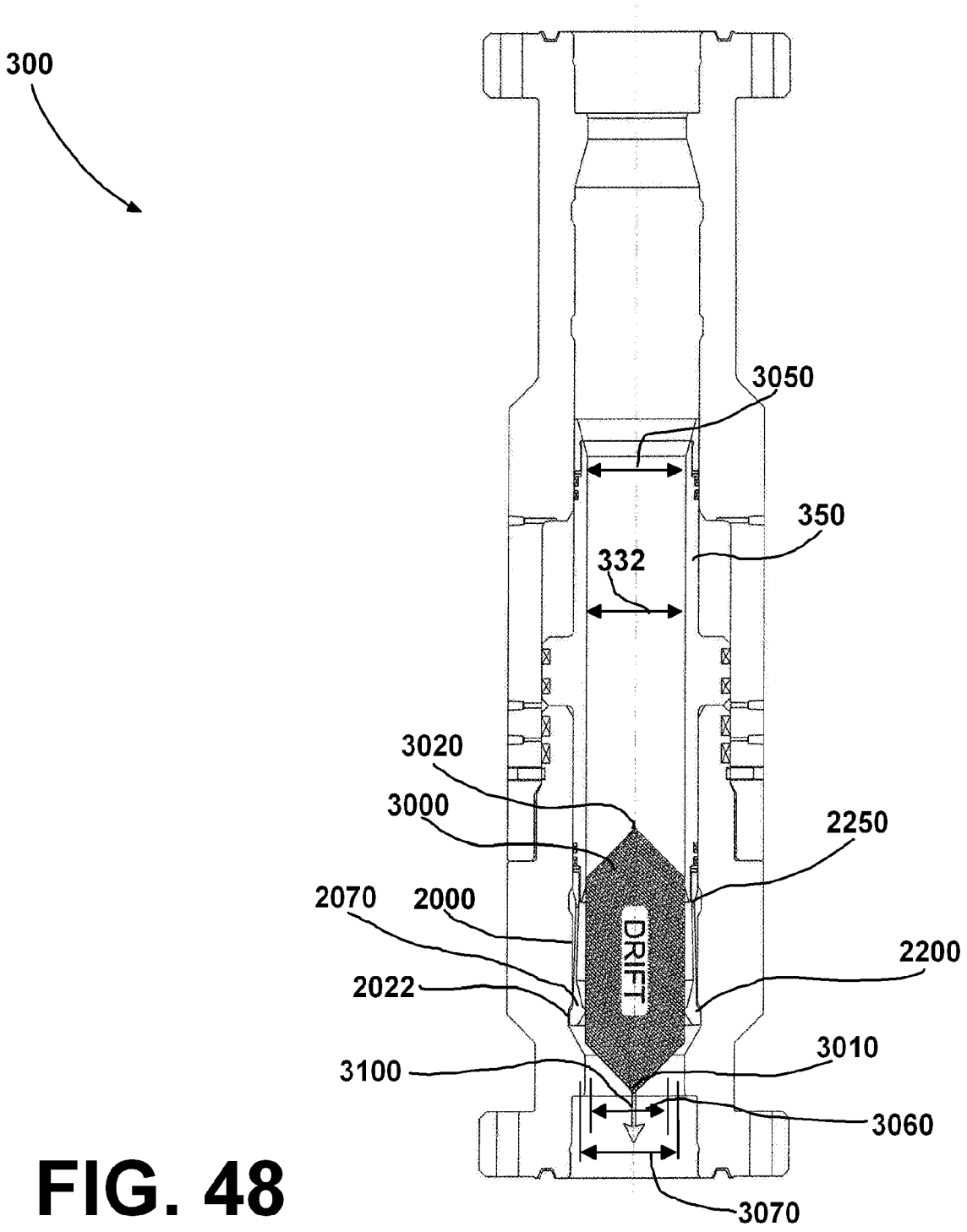
FIG. 48 shows the large diameter tool now having placed the collet in an expanded state which can accommodate the passing of the tool through the landing area of the collet.

FIG. 48 shows the large diameter tool 3000 now having placed the collet 2000 in an expanded state which can accommodate the passing of the tool 3000 through the landing area 2080 of the collet 2000. This now expanded diameter of the landing area 2080 is shown by dimension 3070 (which is schematically shown in FIG. 45 as D2) and which is equal to diameter 3090 of tool 3000.

Figure 49:
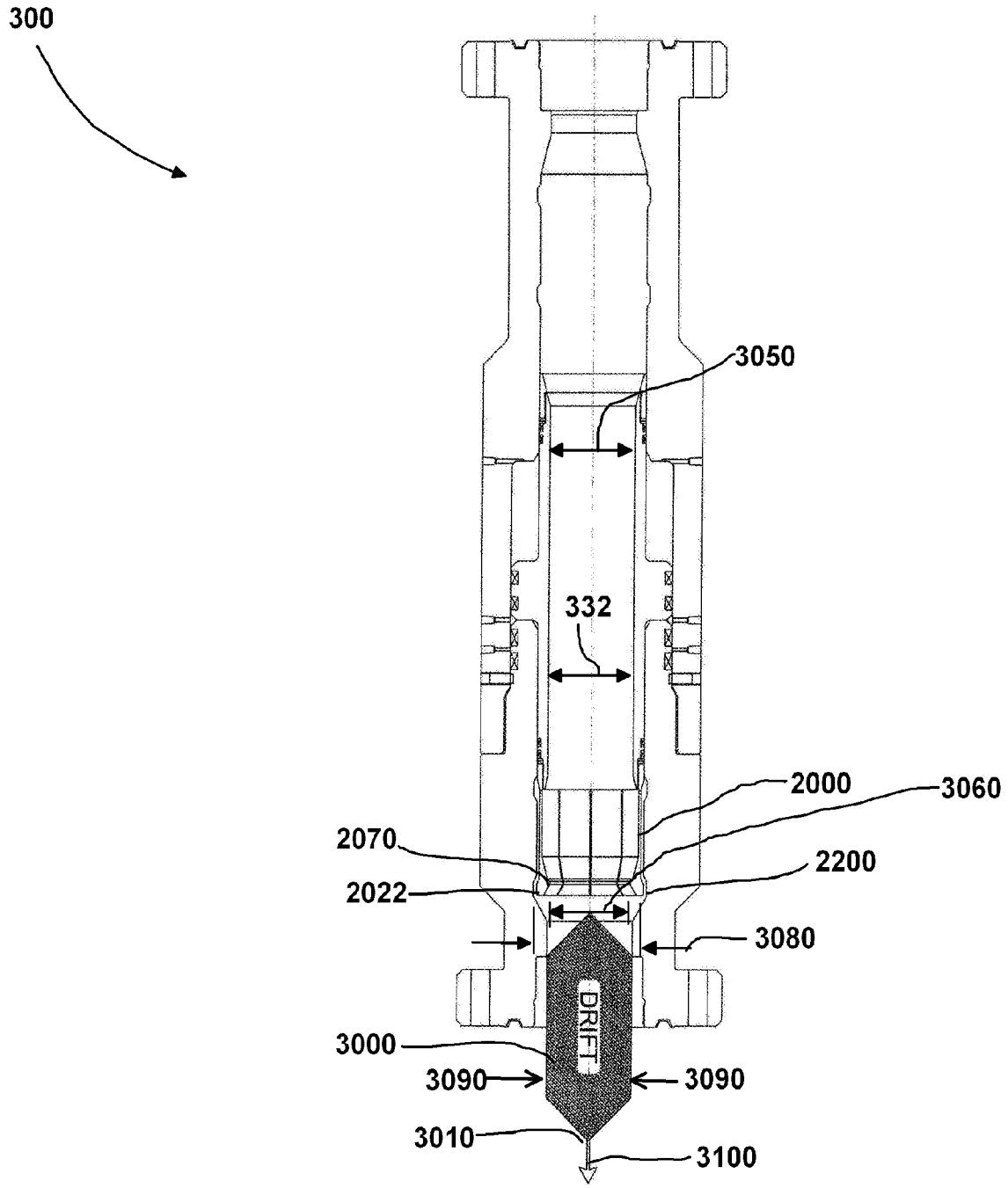
FIG. 49 shows the large diameter tool having passed through the collet, allowing the collet to again revert to its non-expanded state.

FIG. 49 shows the large diameter tool 3000 having passed through the collet 2000, allowing landing area 2080 of collet 2000 to again revert to its non-expanded state. The non-expanded diameter is shown by dimension 3060 (which is schematically shown in FIG. 44 as D1).

Figure 50:
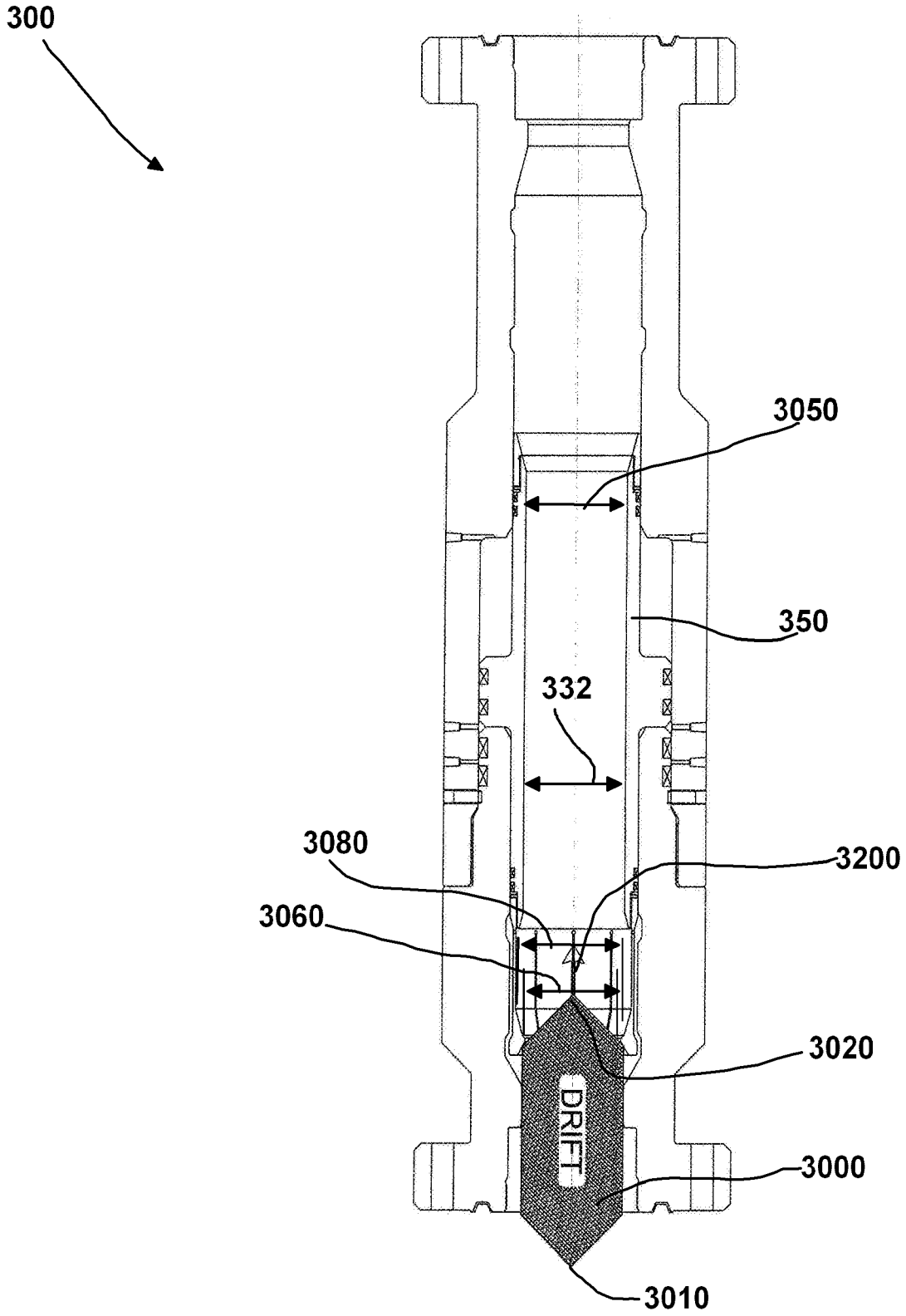
FIG. 50 shows a large diameter tool approaching from below the bottom portion of the collet by the landing area, and first touching an angled area of the collet.
Figure 51:
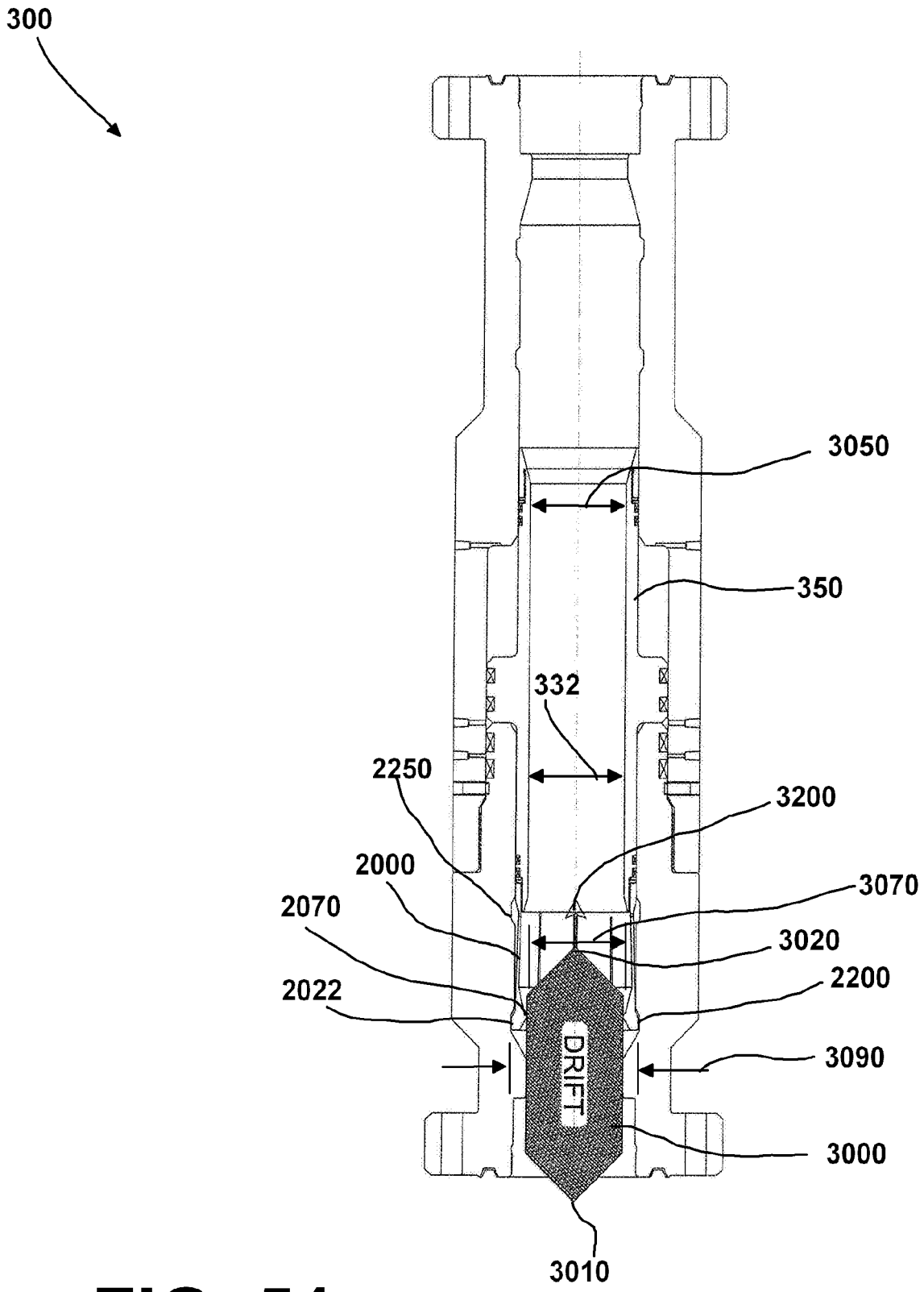
FIG. 51 shows the large diameter tool now having placed the collet in an expanded state which can accommodate the passing of the tool through the landing area of the collet.
Figure 52:
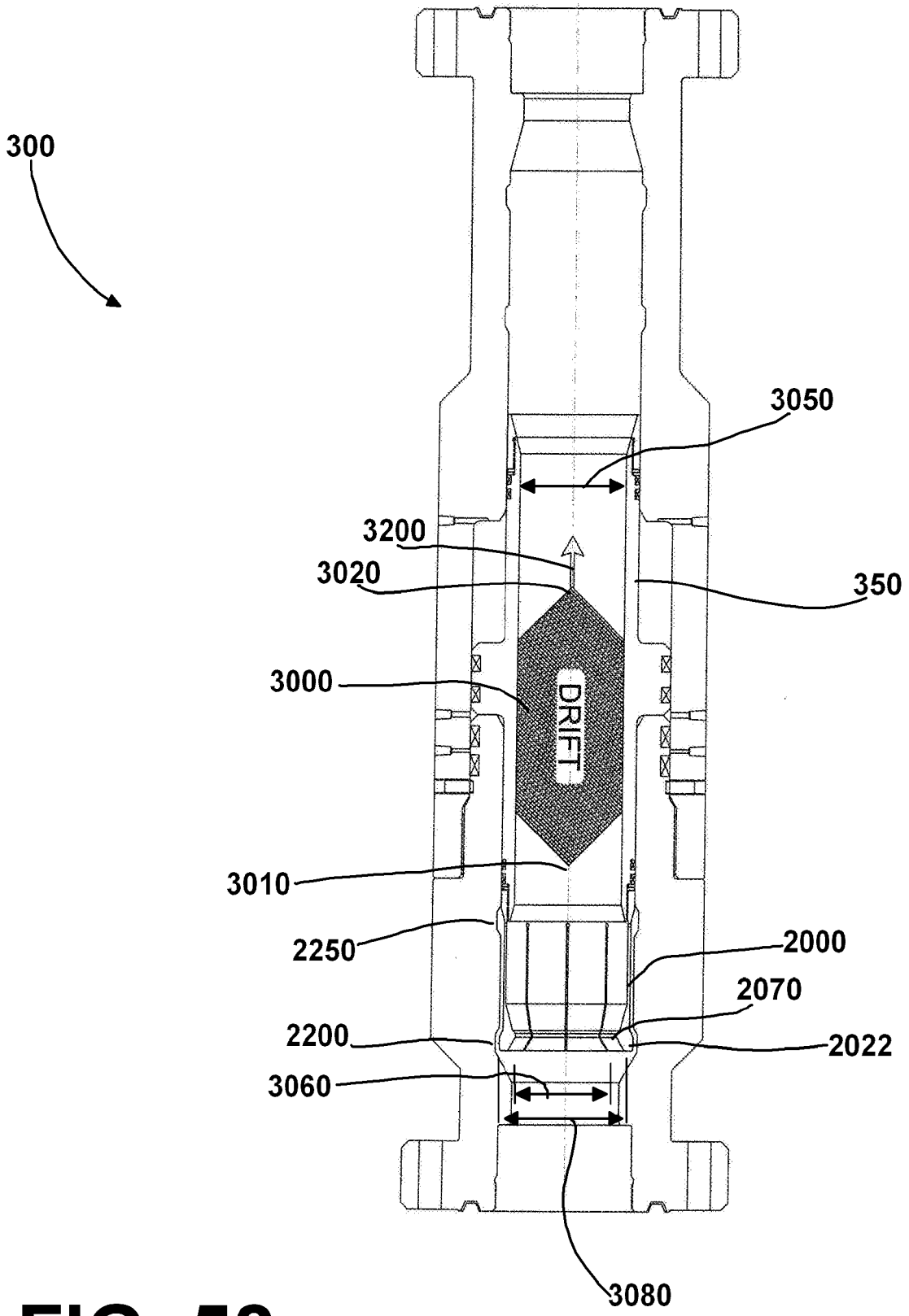
FIG. 52 shows the large diameter tool having passed through the collet, allowing the collet to again revert to its non-expanded state.

FIGS. 50 through 52 schematically illustrate the steps where collet 2000 expands to allow a large sized object 3000 traveling upwardly (schematically indicated by arrow 3200) to pass through and then contract to its original position after the object passes through.

FIG. 50 shows a large diameter tool 3000 approaching from below the bottom portion of the collet 2000 by the landing area 2080 (arrow 3200 schematically indicates upward movement of tool 3000). The non-expanded diameter of landing area 2080 is shown by dimension 3060 (which is schematically shown in FIG. 44 as D1). Dimension 3090 schematically indicates the diameter to object 3000. FIG. 50 shows the point where large diameter tool 3000 has first touched collet 2000. Because this shows first touch, landing area 2080 of collet 2000 will be in the non-expanded state (shown by dimension 3060 which is schematically shown in FIG. 44 as D1).

FIG. 51 shows large diameter tool 3000 now having placed landing area 2080 of collet 2000 in an expanded state which can accommodate the passing of the tool 3000 through the landing area 2080 of the collet 2000. This now expanded diameter of landing area 2080 is shown by dimension 3070 (which is schematically shown in FIG. 45 as D2), and which is equal to the size 3090 of tool 3000.

FIG. 52 shows the large diameter tool 3000 having passed through the collet 2000, allowing the collet 2000 to again revert to its non-expanded state. The non-expanded diameter is shown by dimension 3060 (which is schematically shown in FIG. 44 as D1).

The following is a Table of Reference Numerals and their descriptions.

TABLE OF REFERENCE NUMERALS

| Reference Numeral | Description |
|---|---|
| 10 | horizontal christmas tree |
| 15 | tree body |
| 16 | upper tree |
| 17 | shoulder |
| 18 | tubing hanger cavity |
| 19 | height |
| 20 | external tree cap |

-continued

TABLE OF REFERENCE NUMERALS

| Reference Numeral | Description |
|---|---|
| 30 | internal tree cap |
| 50 | tubing hanger |
| 60 | profile |
| 80 | bore |
| 85 | tubing |
| 90 | wellhead |
| 100 | crown plug |
| 300 | jacking system |
| 301 | body |
| 302 | stinger |
| 304 | lubricator |
| 305 | upper portion of lubricator |
| 306 | packoff |
| 309 | connector |
| 310 | first end |
| 312 | wire valve |
| 314 | tool trap |
| 315 | shoulder |
| 316 | height |
| 320 | second end |
| 322 | valve |
| 323 | valve |
| 324 | valve |
| 330 | central opening |
| 332 | diameter of central opening |
| 340 | cylinder section |
| 341 | interior |
| 342 | upper level |
| 344 | lower level |
| 346 | enlarged section |
| 348 | body |
| 350 | piston section |
| 352 | upper portion |
| 353 | upper seal |
| 354 | lower section |
| 355 | lower seal |
| 356 | radial portion of piston |
| 357 | upper portion |
| 358 | lower portion |
| 359 | seal |
| 360 | central opening of piston |
| 370 | landing section of piston |
| 372 | lower beveled or tapered section |
| 400 | upper fluid port |
| 410 | line to upper fluid port |
| 420 | lower fluid port |
| 430 | line to lower fluid port |
| 500 | jacking string |
| 502 | height |
| 504 | height |
| 505 | height |
| 506 | height |
| 510 | fishing neck |
| 520 | gross length adjustment tool or joint |
| 530 | fine length adjustment tool or joint |
| 532 | upper |
| 534 | lower |
| 560 | adapter |
| 570 | crown plug pulling tool |
| 600 | landing joint |
| 610 | landing shoulder |
| 630 | lower portion |
| 640 | fluid pathway |
| 800 | barge/vessel |
| 810 | deck |
| 900 | water surface |
| 910 | seabed |
| 1020 | first lift apparatus/crane |
| 1050 | lift line |
| 1100 | winch |
| 1110 | winch cable |
| 1200 | motor drive |
| 1210 | hydraulic control panel |
| 1220 | hydraulic lines |

-continued

TABLE OF REFERENCE NUMERALS

| Reference Numeral | Description |
|---|---|
| 1250 | cement lines |
| 1500 | arrow |
| 1510 | arrow |
| 1560 | height |
| 1570 | height |
| 1580 | height |
| 1582 | height |
| 1584 | height |
| 1600 | nozzle |
| 1610 | fluid spray |
| 1620 | fluid inlet |
| 1630 | fluid outlet |
| 1640 | fluid path |
| 1650 | volume |
| 2000 | collet |
| 2010 | first end |
| 2020 | second end |
| 2022 | enlarged area |
| 2024 | base |
| 2030 | non-collapsed state |
| 2040 | collapsed state |
| 2042 | collapsing arrows |
| 2050 | plurality of fingers |
| 2052 | interior face |
| 2060 | exterior portion |
| 2062 | wall |
| 2070 | interior portion |
| 2080 | landing area |
| 2082 | space between landing surface of landing sub and landing area of collet |
| 2100 | wall |
| 2100 | arrows |
| 2110 | gap |
| 2200 | recessed area |
| 2210 | angled surface |
| 2250 | recessed area |
| 2254 | angled surface of recessed area |
| 2300 | recessed area |
| 2350 | space between recessed areas |
| 2350 | space between recessed areas |
| 2400 | recessed area |
| 2500 | collet |
| 2510 | first end |
| 2520 | second end |
| 2550 | plurality of fingers |
| 2560 | exterior portion |
| 2570 | interior portion |
| 3000 | large diameter object to be placed downhole |
| 3010 | first end |
| 3020 | second end |
| 3050 | size |
| 3060 | diameter |
| 3065 | diameter to outer walls 2024 of enlarged area 2022 of plurality of fingers 2050 |
| 3070 | diameter |
| 3080 | diameter |
| 3090 | diameter |
| 3100 | arrow |
| 3200 | arrow |

All measurements disclosed herein are at standard temperature and pressure, at sea level on Earth, unless indicated otherwise. All materials used or intended to be used in a human being are biocompatible, unless indicated otherwise.

The foregoing description of presently preferred and other aspects of this invention has been presented by way of illustration and example. It does not present, nor is it intended to present, an exhaustive catalog of all structural and procedural forms by which the invention can be embodied. Variations upon and alterations of the described structures and procedures can be pursued without departing from the fair substance and scope of the invention consistent with the foregoing descriptions, and the following claims which are to be read and interpreted liberally in the context of the state of the art from which this invention has advanced.

The invention claimed is:

1. A method of pulling a crown plug from a subsea horizontal christmas tree, the method comprising:

(a) providing a subsea lubricator having a longitudinal through bore and a jack attached to the subsea lubricator, the jack having a landing area which remains radially static, and the landing area having an opening which is fluidly connected to the lubricator's through bore;

(b) providing a jacking string which includes a landing sub and a crown plug connector, the sub having a landing surface;

(c) lowering the subsea lubricator of step "a", to the horizontal christmas tree and attaching the lubricator to the christmas tree;

(d) lowering the jacking string to the lubricator, and, while the landing surface of the landing sub is spaced above and not supported by the landing area of the jack, connecting the plug connector to the crown plug while the landing sub is above and not touching the landing area of the jack;

(e) jacking up the jack such that the landing area of the jack contacts, but is not vertically locked with, the landing surface of the landing sub, and pushes up on the jacking sub and jacking string causing tensile forces to be placed on the crown plug and releasing the crown plug from the profile of the christmas tree, the landing area remaining radially static the entire time between steps "d" and "e";

(f) while the lubricator remains attached to the christmas tree, raising the jacking string and crown plug through and out of the lubricator and to the surface of the water to remove the plug; and (g) detaching the crown plug from the crown plug connector.

2. The method of claim 1, wherein the landing area of the landing surface is a landing ring.

3. The method of claim 1, wherein during step "d", the landing surface of the landing sub is at least about one half inch above the landing area of the jack.

4. The method of claim 1, wherein during step "d", the landing surface of the landing sub is at least about one inch above the landing area of the jack.

5. The method of claim 1, further including the step of before step "c", causing the jack to move to its lowermost position.

6. The method of claim 1, wherein before step "e", the area around the crown plug is washed.

7. The method of claim 1, wherein during step "d", wireline is used to lower the jacking string.

8. The method of claim 1, wherein before step "e", but after connection to the crown plug in step "d", wireline is used to pull up on the landing string to confirm that a connection has been made between the jacking string and the crown plug.

9. The method of claim 1, wherein during step "e", the jack is moved from a lower axial movement limiter to an upper axial movement limiter.

10. The method of claim 9, wherein during step "e", hydraulic pressure to the jack is monitored from a monitoring station above the surface of the water.

11. The method of claim 10, wherein contact between the jack and the upper axial movement limiter is determined by a spike in hydraulic pressure being monitored for hydraulic pump.

12. The method of claim 1, wherein in step "b", the jacking string includes a fine adjustment member which comprises upper and lower telescoping sections.

13. The method of claim 1, wherein during step "e", when contact is made between the landing area of the jack and the landing surface of the landing sub, the lubricator through bore is separated into upper and lower sections and the upper and lower sections remain fluidly connected.

14. The method of claim 13, wherein a plurality of axial openings in the jacking sub cause the upper and lower sections to remain fluidly connected.

15. The method of claim 13, wherein a plurality of axial openings in the landing area of the jack cause the upper and lower sections to remain fluidly connected.

16. A method of pulling a crown plug from a subsea horizontal christmas tree, the method comprising:

(a) providing a subsea lubricator having a longitudinal through bore and a jack attached to the subsea lubricator, the jack having a collapsible landing area having collapsed and non-collapsed states, the landing area having an opening which is fluidly connected to the lubricator's through bore;

(b) providing a jacking string which includes a landing sub and a crown plug connector, the sub having a landing surface;

(c) lowering the subsea lubricator of step "a", to the horizontal christmas tree and attaching the lubricator to the christmas tree;

(d) lowering the jacking string to the lubricator, and, while the landing surface of the landing sub is spaced above and not supported by the landing area of the jack, connecting the plug connector to the crown plug while the landing sub is above and not touching the landing area of the jack;

(e) jacking up the jack which vertical movement of the jack causes the landing area to enter a collapsed state, and causes the collapsed landing area of the jack to contact the landing surface of the landing sub, and pushes up on the jacking sub and jacking string causing tensile forces to be placed on the crown plug and releasing the crown plug from the profile of the christmas tree;

(f) while the lubricator remains attached to the christmas tree, raising the jacking string and crown plug through and out of the lubricator and to the surface of the water to remove the plug; and (g) detaching the crown plug from the crown plug connector.

17. A method of pulling a crown plug from a subsea horizontal christmas tree, the method comprising:

(a) providing a subsea lubricator having a longitudinal through bore and a jack attached to the subsea lubricator, the jack having a landing area having locked and unlocked expansion states, the landing area having an opening which is fluidly connected to the lubricator's through bore;

(b) providing a jacking string which includes a landing sub and a crown plug connector, the sub having a landing surface;

(c) lowering the subsea lubricator of step "a", to the horizontal christmas tree and attaching the lubricator to the christmas tree;

(d) after step "c" causing an object to contact the landing surface and such contact causing the landing surface to enter an expanded state, with the landing returning to a non expanded state by itself when the object no longer touches the landing surface;

(e) after step "d" lowering the jacking string to the lubricator, and, while the landing surface of the landing sub is spaced above and not supported by the landing area of the jack, connecting the plug connector to the crown plug while the landing sub is above and not touching the landing area of the jack;

(f) jacking up the jack which vertical movement of the jack causes the landing area to enter a locked state, and causing the locked landing area of the jack to contact the landing surface of the landing sub, and pushes up on the jacking sub and jacking string causing tensile forces to be placed on the crown plug and releasing the crown plug from the profile of the christmas tree;

(g) while the lubricator remains attached to the christmas tree, raising the jacking string and crown plug through and out of the lubricator and to the surface of the water to remove the plug; and (h) detaching the crown plug from the crown plug connector.

* * * * *